US010717283B2

(12) United States Patent
Shimizu et al.

(10) Patent No.: US 10,717,283 B2
(45) Date of Patent: Jul. 21, 2020

(54) CAP DEVICE AND LIQUID EJECTING APPARATUS

(71) Applicant: SEIKO EPSON CORPORATION, Tokyo (JP)

(72) Inventors: Kazutoshi Shimizu, Shimosuwa (JP); Toshio Nakata, Matsumoto (JP); Ryoji Fujimori, Suwa (JP); Shuhei Harada, Chino (JP); Noritaka Mitsuo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/111,050

(22) Filed: Aug. 23, 2018

(65) Prior Publication Data

US 2019/0061353 A1 Feb. 28, 2019

(30) Foreign Application Priority Data

Aug. 24, 2017 (JP) ..... 2017-160894
Aug. 24, 2017 (JP) ..... 2017-160895

(51) Int. Cl.
*B41J 2/165* (2006.01)

(52) U.S. Cl.
CPC ..... *B41J 2/16505* (2013.01); *B41J 2/165* (2013.01); *B41J 2/16508* (2013.01)

(58) Field of Classification Search
CPC .... B41J 2/16505; B41J 2/165; B41J 2/16508; B41J 2/14
See application file for complete search history.

(56) References Cited

U.S. PATENT DOCUMENTS

| | | | | |
|---|---|---|---|---|
| 4,947,187 | A | 8/1990 | Iwagami | |
| 5,608,432 | A | 3/1997 | Yamaguchi | |
| 6,074,037 | A | 6/2000 | Nakahara et al. | |
| 8,672,443 | B2 * | 3/2014 | Hazeyama ..... | B41J 2/16505 347/22 |
| 2005/0168517 | A1 | 8/2005 | Usuda | |
| 2006/0203032 | A1 | 9/2006 | Takagi | |
| 2007/0257957 | A1 | 11/2007 | Takagi | |
| 2008/0030540 | A1 | 2/2008 | Suzuki | |

(Continued)

FOREIGN PATENT DOCUMENTS

| | | | |
|---|---|---|---|
| JP | S63-221047 | A | 9/1988 |
| JP | H01-5852 | A | 1/1989 |
| JP | H05-166330 | A | 5/1993 |

(Continued)

OTHER PUBLICATIONS

Machine translation of JP 2015-063076, published on Apr. 2015. (Year: 2015).*

(Continued)

*Primary Examiner* — Huan H Tran
(74) *Attorney, Agent, or Firm* — Workman Nydegger

(57) ABSTRACT

A cap device is designed to form a space surrounding an opening of a nozzle of a liquid ejecting head when the cap device is in contact with the liquid ejecting head including the nozzle for ejecting a liquid, and includes a moisturizing chamber to which a moisturizing fluid for moisturizing the above space is supplied, and a partition wall having gas permeability and configured to partition the space and the moisturizing chamber, where part of the partition wall is formed of a flexible portion.

20 Claims, 26 Drawing Sheets

(56) References Cited

U.S. PATENT DOCUMENTS

| | | | | |
|---|---|---|---|---|
| 2009/0109257 | A1* | 4/2009 | Shimazaki | B41J 2/16505 347/31 |
| 2018/0029368 | A1* | 2/2018 | Nakata | B41J 2/16505 |

FOREIGN PATENT DOCUMENTS

| | | | | | |
|---|---|---|---|---|---|
| JP | H07-32601 | A | | 2/1995 | |
| JP | H07-164642 | A | | 6/1995 | |
| JP | H07-186405 | A | | 7/1995 | |
| JP | H08-150734 | A | | 6/1996 | |
| JP | H08-310051 | A | | 11/1996 | |
| JP | H10-16246 | A | | 1/1998 | |
| JP | H10-193626 | A | | 7/1998 | |
| JP | H11-268294 | A | | 10/1999 | |
| JP | H11-291509 | A | | 10/1999 | |
| JP | 2003-276214 | | * | 9/2003 | B41J 2/165 |
| JP | 2003-276214 | A | | 9/2003 | |
| JP | 2003-334962 | | * | 11/2003 | B41J 2/165 |
| JP | 2006-7455 | A | | 1/2006 | |
| JP | 2006-130659 | A | | 5/2006 | |
| JP | 2006-239936 | A | | 9/2006 | |
| JP | 2007-268852 | A | | 10/2007 | |
| JP | 2008-229932 | A | | 10/2008 | |
| JP | 2009-101634 | A | | 5/2009 | |
| JP | 2015-063076 | | * | 4/2015 | B41J 2/165 |
| JP | 2015-63076 | A | | 4/2015 | |

OTHER PUBLICATIONS

Machine translation of JP 2003-334962, published on Nov. 2003 (Year: 2003).*

Machine translation of JP 2003-276214, published on Sep. 2003 (Year: 2003).*

Partial European Search Report issued in Application No. 18190397 dated Jan. 10, 2019.

* cited by examiner

CAP DEVICE AND LIQUID EJECTING APPARATUS

The entire disclosure of Japanese Patent Application No.: 2017-160895, filed Aug. 24, 2017 and 2017-160894, filed Aug. 24, 2017 are expressly incorporated by reference herein.

BACKGROUND

1. Technical Field

The present invention relates to a cap device and a liquid ejecting apparatus.

2. Related Art

As an example of a liquid ejecting apparatus, there is a fluid ejecting apparatus including a moisturizing cap for moisturizing a nozzle for ejecting a fluid, and a moisturizing liquid supply device for supplying a moisturizing liquid to the moisturizing cap (for example, JP-A-2009-101634).

When the inside of the moisturizing cap covering the nozzle is sealed, the pressure may change due to an environmental change such as an increase in temperature. Further, foreign matter such as dust may be adhered when the moisturizing cap is at a position separate from the head, whereby a sufficient moisturizing effect may not be obtained in some case when the head being covered.

SUMMARY

An advantage of some aspects of the invention is to provide a cap device and a liquid ejecting apparatus capable of moisturizing a nozzle.

A cap device for solving the above problems is a cap device that is capable of forming a space surrounding an opening of a nozzle of a liquid ejecting head when the cap device is in contact with the liquid ejecting head having the nozzle for ejecting a liquid, and includes a moisturizing chamber to which a moisturizing fluid for moisturizing the above space is supplied, and a partition wall having gas permeability and configured to partition the space and the moisturizing chamber, where part of the partition wall is formed of a flexible portion.

A liquid ejecting apparatus for solving the above problems includes a liquid ejecting head having a nozzle for ejecting a liquid, and a cap device capable of forming a space surrounding an opening of the nozzle when the cap device is in contact with the liquid ejecting head; the cap device includes a moisturizing chamber to which a moisturizing fluid for moisturizing the space is supplied, and a partition wall having gas permeability and configured to partition the space and the moisturizing chamber, where part of the partition wall is formed of a flexible portion.

A cap device for solving the above problems includes a cap having a recessed portion capable of forming a space surrounding an opening of a nozzle of a liquid ejecting head when the cap is in contact with the liquid ejecting head having the nozzle for ejecting a liquid, and a cap cover for covering the recessed portion at a cover position when the cap is at a separate position distanced from the liquid ejecting head.

A liquid ejecting apparatus for solving the above problems includes a liquid ejecting head having a nozzle for ejecting a liquid, a cap having a recessed portion capable of forming a space surrounding an opening of the nozzle when the cap is in contact with the liquid ejecting head, and a cap cover for covering the recessed portion at a cover position when the cap is at a separate position distanced from the liquid ejecting head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus will be described with reference to the drawings. The liquid ejecting apparatus of the present embodiment is an ink jet printer that prints on a medium such as a recording paper by ejecting ink as an example of a liquid.

First Embodiment

Figure 1:
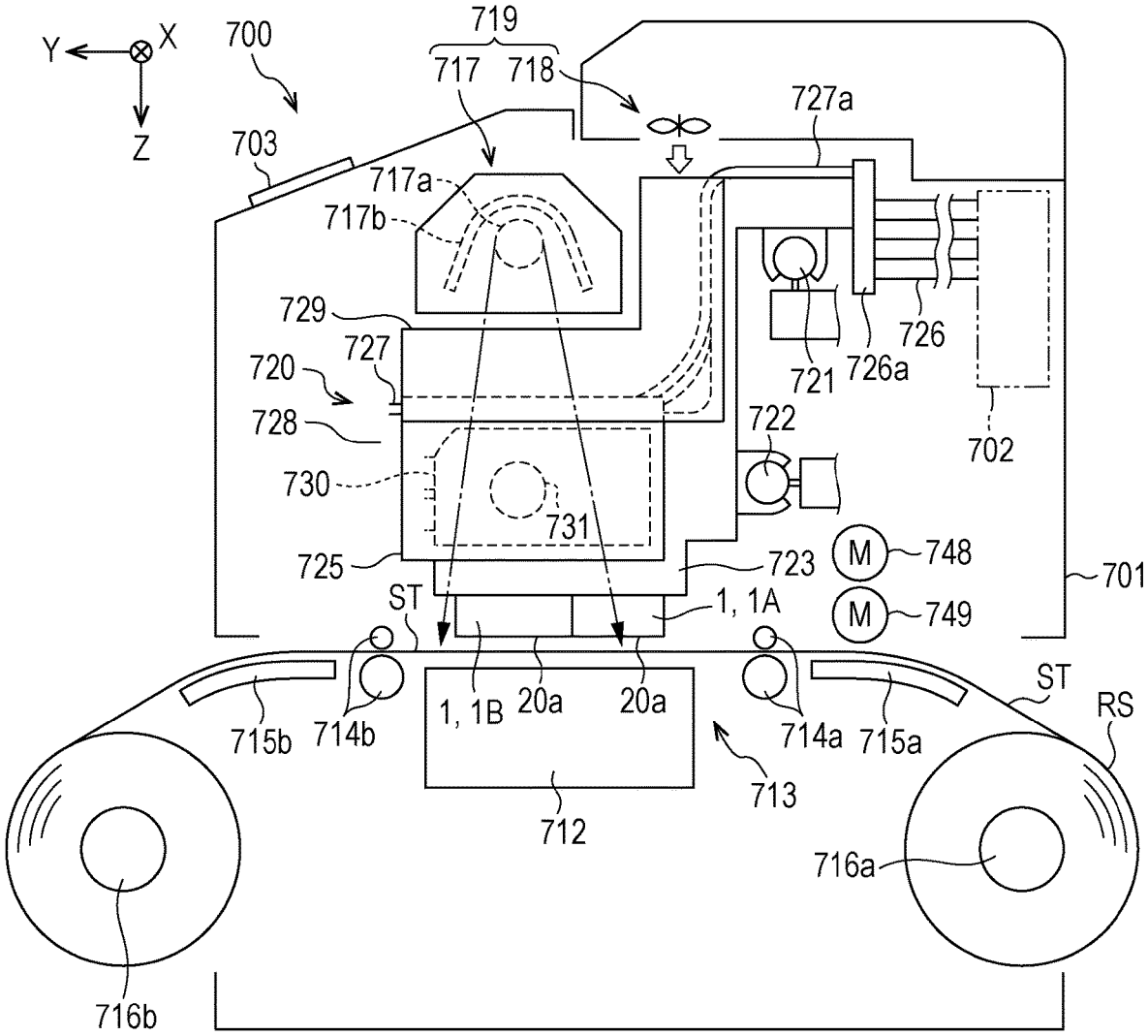
FIG. 1 is a schematic diagram illustrating a first embodiment of a liquid ejecting apparatus.

As shown in FIG. 1, a liquid ejecting apparatus 700 includes a support base 712, a transport unit 713, a printing unit 720, a drying unit 719, guide shafts 721 and 722, and a housing 701 that houses these constituent elements. The support base 712 and the guide shafts 721, 722 extend in an X-axis direction which is a width direction of a medium ST. The housing 701 has an operation panel 703 through which operation is performed and on which operating states are displayed.

The transport unit 713 transports a sheet-like medium ST. At a printing position set on the support base 712, the printing unit 720 ejects a liquid droplet toward the medium ST to be transported. A Y-axis direction is a transport direction of the medium ST at the printing position. The drying unit 719 facilitates drying of the liquid attached on the medium ST. The X-axis and Y-axis intersect with a Z-axis. In this embodiment, a Z-axis direction is a gravity direction and is a liquid ejection direction of the liquid.

The transport unit 713 includes a pair of transport rollers 714*a* disposed upstream of the support base 712 in the transport direction, a guide plate 715*a*, a supply reel 716*a*, a pair of transport rollers 714*b* disposed downstream of the support base 712 in the transport direction, a guide plate 715*b*, and a take-up reel 716*b*. The transport unit 713 includes a transport motor 749 for rotating the pairs of transport rollers 714*a* and 714*b*.

The medium ST is fed out of a roll sheet RS wound in a roll form on the supply reel 716*a*. When the pairs of transport rollers 714*a* and 714*b* respectively rotate while nipping the medium ST, the medium ST is transported along surfaces of the guide plate 715*a*, the support base 712, and the guide plate 715*b*. The printed medium ST is wound on the take-up reel 716*b*.

The printing unit 720 includes a carriage 723 supported by the guide shafts 721 and 722, and a carriage motor 748. By driving of the carriage motor 748, the carriage 723 reciprocates above the support base 712 along the guide shafts 721 and 722.

The liquid ejecting apparatus 700 includes a plurality of supply tubes 726 which can be deformed following the reciprocating carriage 723, and a connecting portion 726*a* attached to the carriage 723. An upstream end of the supply tube 726 is connected to a liquid supply source 702, and a downstream end of the supply tube 726 is connected to the connecting portion 726*a*. The liquid supply source 702 may be, for example, a tank storing a liquid, or a cartridge detachable from the housing 701.

The printing unit 720 includes, as constituent elements held by the carriage 723, two liquid ejecting heads 1 (1A and 1B), a liquid supply path 727, a storage section 730, a storage section holding body 725 configured to hold the storage section 730, and a flow path adapter 728 connected to the storage section 730. The liquid ejecting heads 1A and 1B are held at a lower portion of the carriage 723, and the storage section 730 is held at an upper portion of the carriage 723. The liquid supply path 727 supplies a liquid supplied from the liquid supply source 702 to the liquid ejecting heads 1A and 1B.

The storage section 730 temporarily stores a liquid between the liquid supply path 727 and the liquid ejecting head 1. The storage section 730 is provided at least for each type of liquid. In a case where the liquid ejecting apparatus 700 has a plurality of storage sections 730 and stores color inks of different colors in the plurality of storage sections 730, color printing can be performed.

Examples of ink colors include cyan, magenta, yellow, black, and white. Color printing may be performed with four colors of cyan, magenta, yellow and black, or with three colors of cyan, magenta and yellow. Further, at least one color among light cyan, light magenta, light yellow, orange, green, gray, and the like may be further added to the three colors of cyan, magenta, and yellow. These inks preferably contain preservatives.

In a case where printing is to be performed on a medium ST of transparent or translucent film, or a medium ST of dark color, white ink can be used for background printing (also referred to as solid printing or fill printing) before color printing.

The storage section 730 includes a differential pressure regulating valve 731 provided midway in the liquid supply path 727. The differential pressure regulating valve 731 is a so-called pressure reducing valve. In other words, in the case where the liquid is consumed by the liquid ejecting head 1 and a liquid pressure in the liquid supply path 727 between the differential pressure regulating valve 731 and the liquid ejecting head 1 drops below a predetermined negative pressure lower than the atmospheric pressure, the differential pressure regulating valve 731 opens and permits the liquid to flow from the storage section 730 toward the liquid ejecting head 1. The differential pressure regulating valve 731 closes when the liquid pressure in the liquid supply path 727 between the differential pressure regulating valve 731 and the liquid ejecting head 1 returns to the predetermined negative pressure due to the flow of the liquid, and stops the flow of the liquid. The differential pressure regulating valve 731 does not open even if the liquid pressure in the liquid supply path 727 between the differential pressure regulating valve 731 and the liquid ejecting head 1 increases. Therefore, the differential pressure regulating valve 731 functions as a one way valve (check valve), which allows the liquid to flow from the storage section 730 to the liquid ejecting head 1 and prevents the liquid from flowing in the opposite direction.

The liquid supply path 727 includes a supply tube 727*a* whose upstream end is connected to the connecting portion 726*a*. The downstream end of the supply tube 727*a* is connected to the flow path adapter 728 at a position above the storage section 730. The liquid is supplied to the storage section 730 through the supply tube 726, the supply tube 727*a* and the flow path adapter 728 in that order.

The drying unit 719 includes a heating mechanism 717 and a blowing mechanism 718. The heating mechanism 717 is disposed above the carriage 723. When the carriage 723 reciprocates between the heating mechanism 717 and the support base 712, the liquid ejecting head 1 ejects a liquid droplet toward the medium ST being stopped on the support base 712.

The heating mechanism 717 includes a heat generation member 717*a* and a reflection plate 717*b* extending in the X-axis direction. The heat generation member 717*a* is, for example, an infrared heater. The heating mechanism 717 generates heat (e.g., radiant heat) such as infrared heat from the heat generation member 717*a*, and heats the medium ST within an area indicated by a dot-dash line arrow in FIG. 1. The blowing mechanism 718 blows air to the area heated by the heating mechanism 717, and accelerates drying of the medium ST.

The carriage 723 is provided with a heat insulating member 729, which blocks heat transfer from the heating mechanism 717, between the storage section 730 and the heating mechanism 717. The heat insulating member 729 is formed of a metal material having excellent heat conductivity such as stainless steel or aluminum, for example. Preferably, the heat insulating member 729 covers at least an upper surface of the storage section 730.

Figure 2:
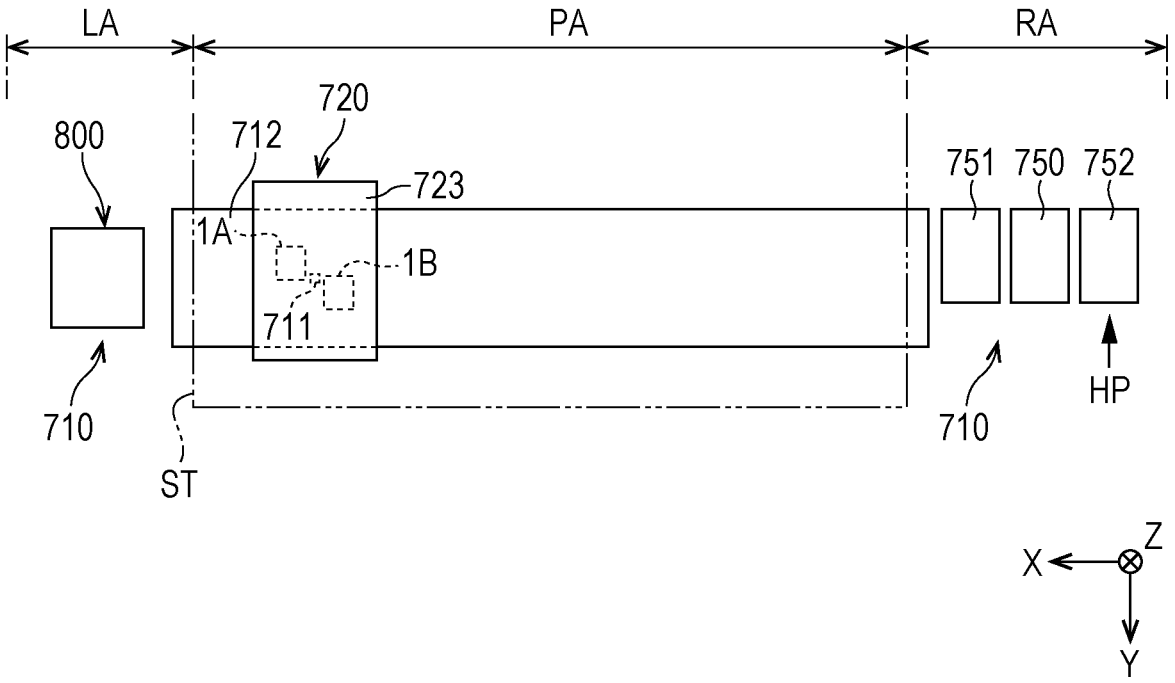
FIG. 2 is a plan view schematically illustrating arrangement of constituent elements of the liquid ejecting apparatus shown in FIG. 1.

As shown in FIG. 2, the liquid ejecting heads 1A and 1B are disposed under the carriage 723 so as to be separated from each other by a predetermined distance in the X-axis direction and shifted from each other by a predetermined distance in the Y-axis direction. The carriage 723 holds a temperature sensor 711 at a position between the liquid ejecting heads 1A and 1B in the X-axis direction.

A movement region in which the liquid ejecting heads 1A and 1B can move in the X-axis direction includes an ejection region PA in which printing is performed on the medium ST and maintenance regions RA and LA outside the ejection region PA. The maintenance regions RA and LA are respectively located on both the outsides of the ejection region PA in the X-axis direction. The ejection region PA is a region in which the liquid ejecting heads 1A and 1B can eject liquid droplets with respect to the medium ST having the maximum width. If the printing unit 720 has an edgeless printing function, the ejection region PA is slightly wider in the X-axis direction than the maximum-width medium ST. A heating region in which the heating mechanism 717 (see FIG. 1) heats the medium ST overlaps with the ejection region PA.

The liquid ejecting apparatus 700 includes a maintenance unit 710 for maintaining the liquid ejecting head 1. The maintenance unit 710 includes a cap device 800 disposed in the maintenance region LA, and also includes a wiping mechanism 750, a liquid receiving mechanism 751, and a cap mechanism 752 that are disposed in the maintenance region RA. The upper side of the cap mechanism 752 is a home position HP of the liquid ejecting heads 1A and 1B. The home position HP is a start point of forward movement of the liquid ejecting heads 1A and 1B.

Configuration of Head Unit

Next, a configuration of a head unit 2 will be described in detail.

Figure 6:
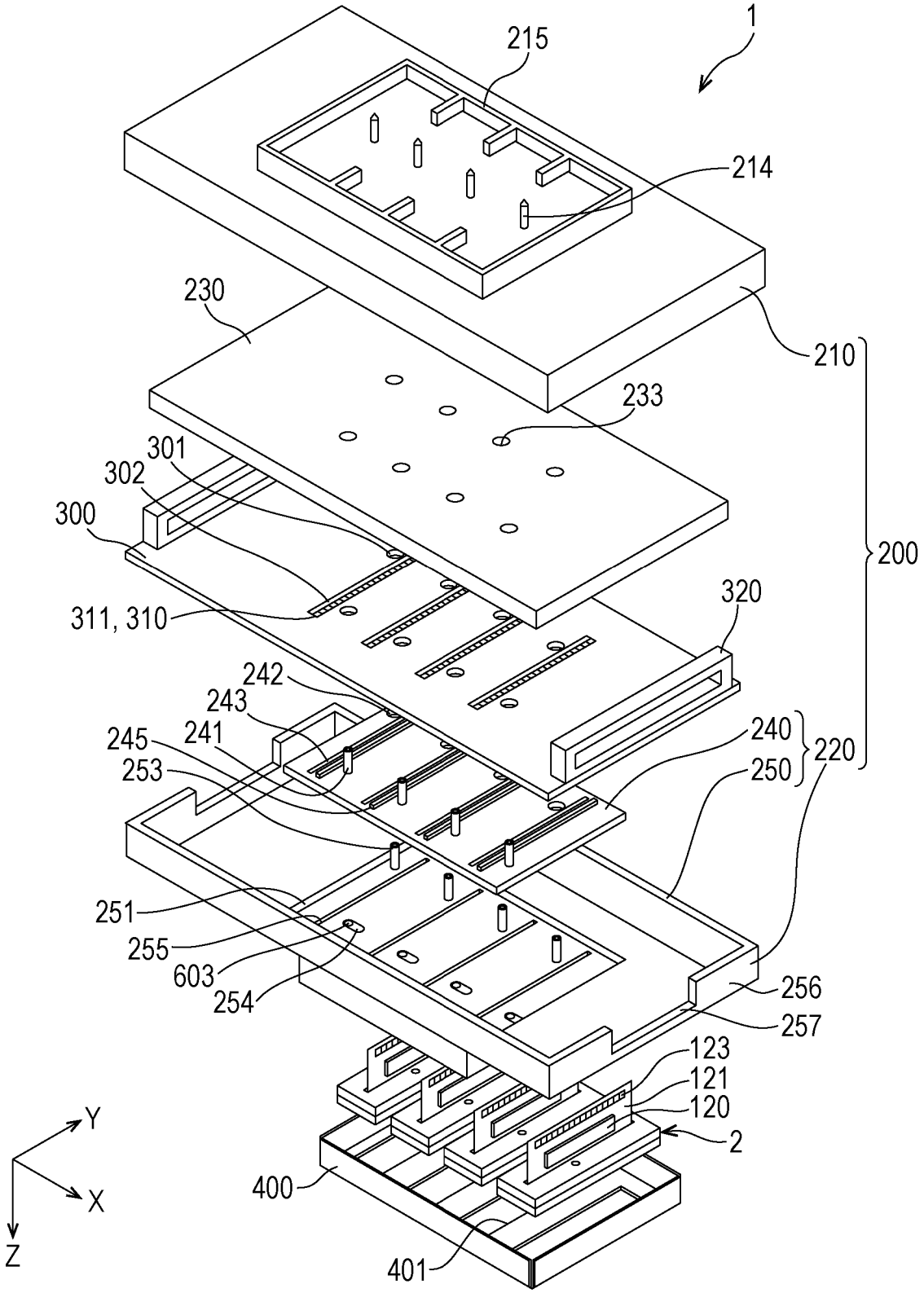
FIG. 6 is an exploded perspective view of a liquid ejecting head included in the liquid ejecting apparatus shown in FIG. 1.

One liquid ejecting head 1 includes a plurality of (four in this embodiment) head units 2 (see FIG. 6). The head unit 2 is provided for each type of liquid.

Figure 3:
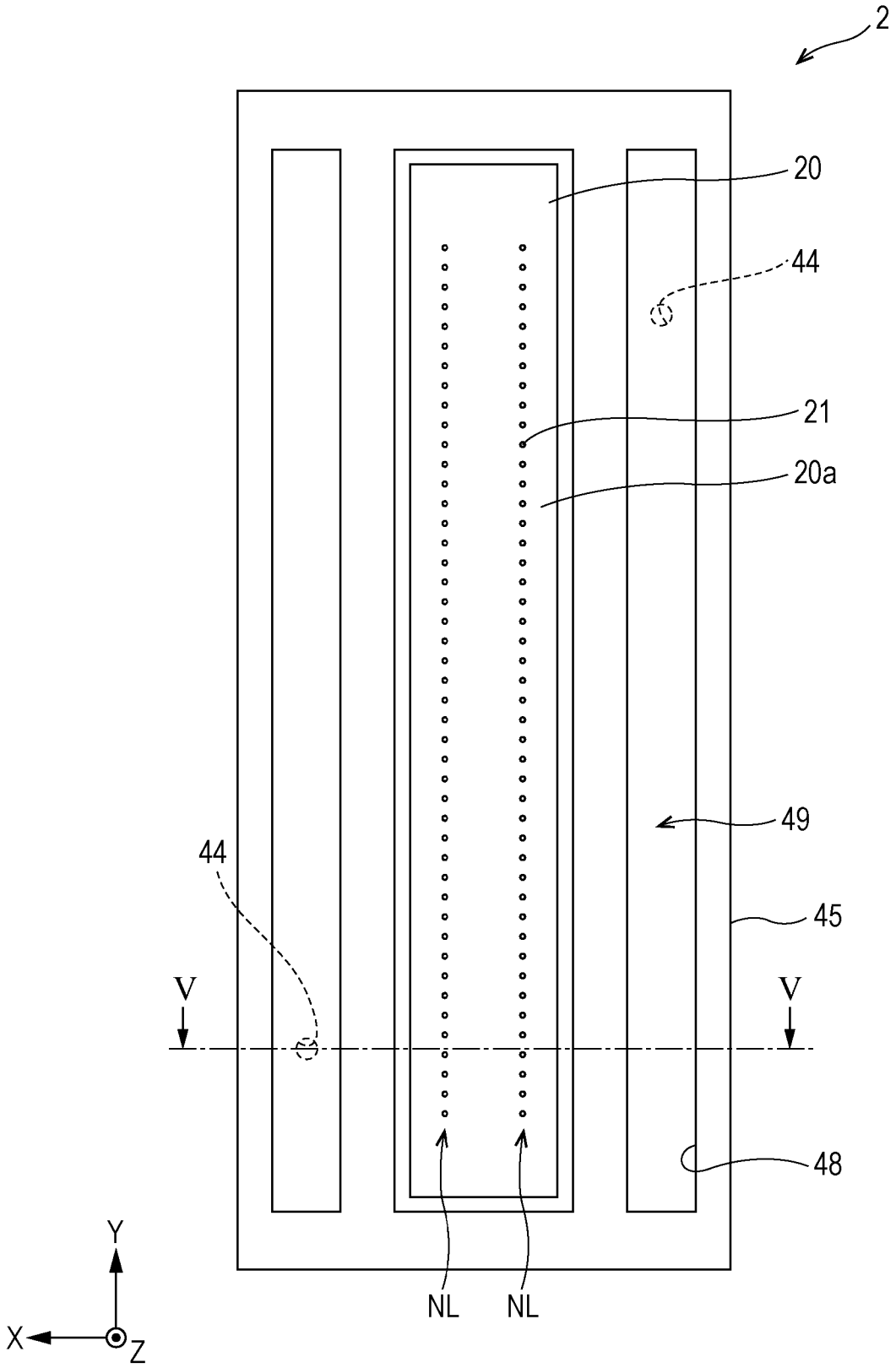
FIG. 3 is a bottom view of a head unit included in the liquid ejecting apparatus shown in FIG. 1.

As shown in FIG. 3, one head unit 2 includes a plurality of nozzles 21 for ejecting liquid droplets. A large number (e.g., 180) of nozzles 21 arranged at regular intervals in one direction (in the present embodiment, in the Y-axis direction) constitute a nozzle row NL. In this embodiment, two nozzle rows NL aligned in the X-axis direction are provided in one head unit 2. Two nozzle rows NL aligned close to each other are referred to as a nozzle group.

Four nozzle groups (a total of eight nozzle rows NL) are disposed per liquid ejecting head 1 at regular intervals in the X-axis direction. The positions in the Y-axis direction of two liquid ejecting heads 1 are adjusted such that, when the positions of the nozzles 21 are projected in the X-axis direction, the endmost nozzles 21 of the respective nozzle rows NL are aligned at the same intervals as those of the nozzles 21 constituting one nozzle row NL.

Figure 4:
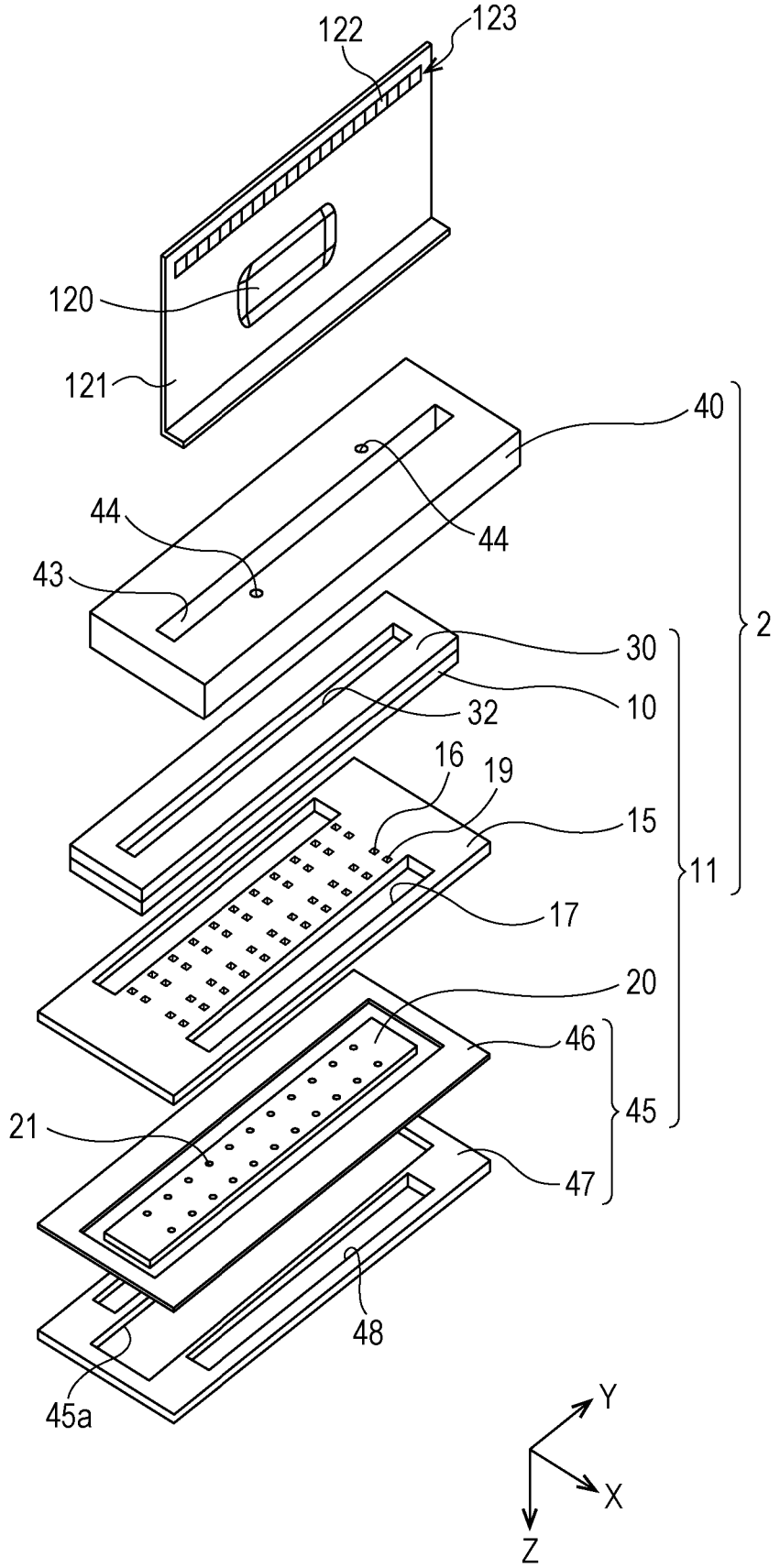
FIG. 4 is an exploded perspective view of the head unit shown in FIG. 3.

As shown in FIG. 4, the head unit 2 includes a head body 11 and a flow path forming member 40 fixed to an upper surface side of the head body 11. The head body 11 includes a protective substrate 30, a flow path forming substrate 10, a communication plate 15, a nozzle plate 20, and a compliance substrate 45 that are laminated in that order from a side closer to the flow path forming member 40. The communication plate 15 is provided on a lower surface side of the flow path forming substrate 10. The protective substrate 30 is provided on the upper side of the flow path forming substrate 10. The nozzle plate 20 is provided on a lower surface side of the communication plate 15. The compliance substrate 45 is provided on a side of the surface of the communication plate 15 on which the nozzle plate 20 is provided.

For the flow path forming substrate 10, a metal such as stainless steel or Ni, a ceramic material represented by $ZrO_2$ or $Al_2O_3$, a glass ceramic material, an oxide such as MgO or $LaAlO_3$, or the like can be used. In this embodiment, the flow path forming substrate 10 is formed of a silicon single crystal substrate.

Figure 5:
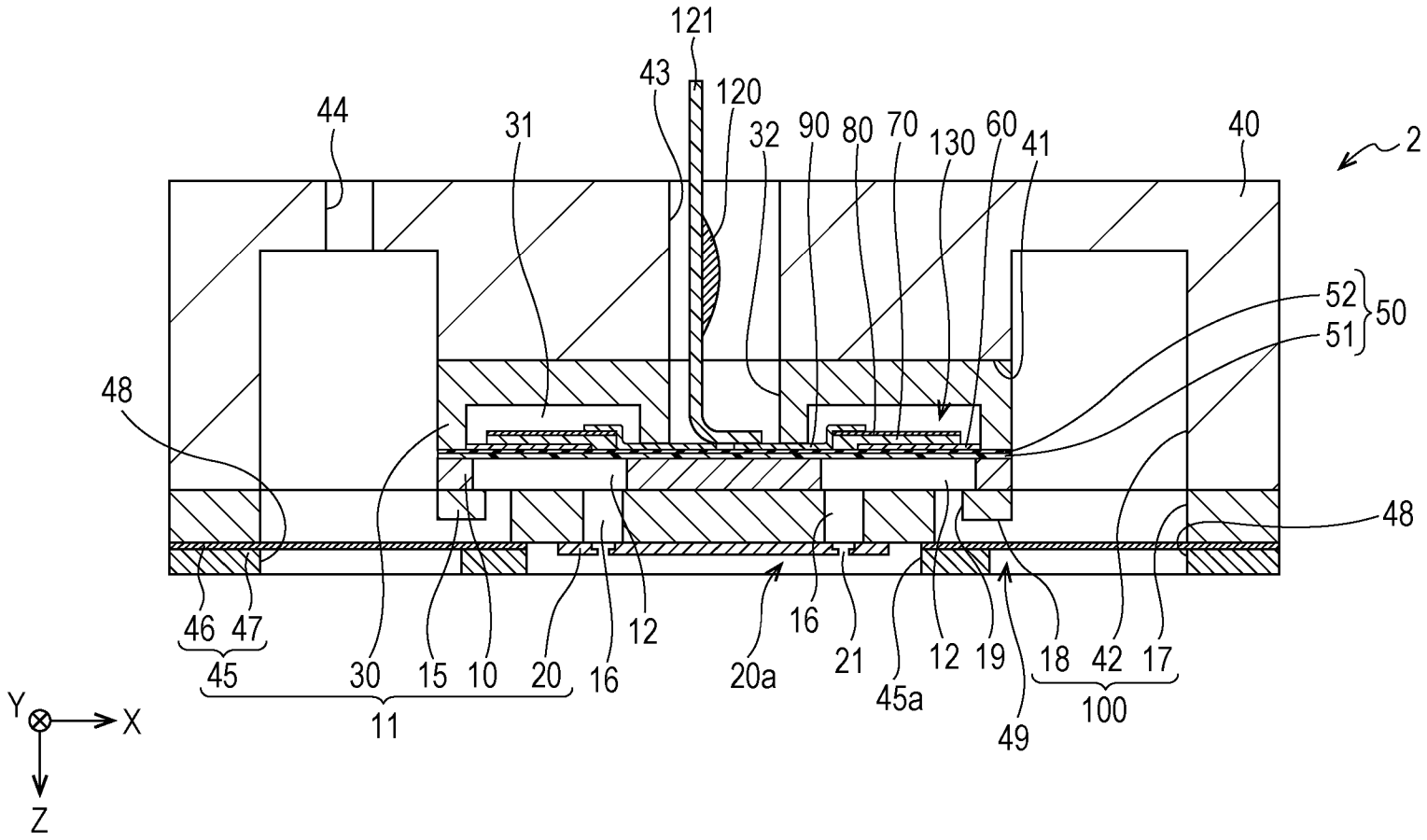
FIG. 5 is a cross-sectional view taken along an arrow line V-V in FIG. 3.

As shown in FIG. 5, a plurality of pressure chambers 12 partitioned by partition walls are formed in the flow path forming substrate 10. The pressure chamber 12 is arranged above the nozzle 21. The flow path forming substrate 10 may be provided with a supply path or the like at one end portion in the Y-axis direction of the pressure chamber 12. In this case, an opening area of the supply path is smaller than that of the pressure chamber 12 to provide flow path resistance for the liquid flowing into the pressure chamber 12.

As shown in FIG. 4 and FIG. 5, the nozzle plate 20 has a hole forming the nozzle 21. A downstream end of the nozzle 21 is opened to a nozzle surface 20*a* as a lower surface of the nozzle plate 20.

A nozzle communication path 16 for making the pressure chamber 12 communicate with the nozzle 21 is provided in the communication plate 15. The communication plate 15 has a larger planar area than the flow path forming substrate 10, and the nozzle plate 20 has a smaller planar area than the flow path forming substrate 10. By providing the communication plate 15, since the nozzle 21 of the nozzle plate 20 and the pressure chamber 12 can be separated from each other, the liquid in the pressure chamber 12 is unlikely to be thickened due to evaporation of moisture in the liquid from the nozzle 21. In addition, since the nozzle plate 20 is only required to cover the opening of the nozzle communication path 16 for making the pressure chamber 12 communicate with the nozzle 21, it is possible to make the area of the nozzle plate 20 relatively small and consequently reduce the cost.

As shown in FIG. 5, the communication plate 15 is provided with a first manifold portion 17 and a second manifold portion 18 (a throttle flow path, an orifice flow path) constituting a common liquid chamber 100. The first manifold portion 17 passes through the communication plate 15 in a thickness direction thereof (the Z-axis direction, which is a lamination direction of the communication plate 15 and the flow path forming substrate 10). The second manifold portion 18 is opened to the nozzle plate 20 side of the communication plate 15 without passing through the communication plate 15 in the thickness direction.

In the communication plate 15, a supply communication path 19 communicating with one end portion of the pressure chamber 12 in the Y-axis direction is provided independently for each pressure chamber 12. The supply communication path 19 connects the second manifold portion 18 and the pressure chamber 12.

For forming the communication plate 15, a metal such as stainless steel or nickel (Ni), or ceramic such as zirconium (Zr) can be used. It is preferable that the communication plate 15 have the same coefficient of linear expansion as that of the flow path forming substrate 10. In a case where a material having a coefficient of linear expansion significantly different from that of the flow path forming substrate 10 is used as the communication plate 15, the flow path forming substrate 10 and the communication plate 15 may be warped in some case by being heated or cooled. In this embodiment, the same material as that of the flow path forming substrate 10 is used as the communication plate 15, i.e., a silicon single crystal substrate is used to suppress a warp caused by heat, a crack or peeling-off caused by heat, or the like.

For forming the nozzle plate 20, for example, a metal such as stainless steel (SUS), an organic material such as a polyimide resin, a silicon single crystal substrate, or the like can be used. When a silicon single crystal substrate is used as the nozzle plate 20, the coefficients of linear expansion of the nozzle plate 20 and the communication plate 15 become equal to each other. Thus, it is possible to suppress warps caused by heat, cracks or peeling-off caused by heat, or the like.

A vibration plate 50 is disposed on a surface side of the flow path forming substrate 10 opposite to the communication plate 15. In this embodiment, as the vibration plate 50, there are provided an elastic film 51 made of silicon oxide provided on the flow path forming substrate 10 side and an insulator film 52 made of zirconium oxide provided on the elastic film 51. Liquid flow paths such as the pressure chamber 12 are each formed by performing anisotropic etching on the flow path forming substrate 10 from one surface side (the surface side to which the nozzle plate 20 is bonded), and the other surface of each of the liquid flow paths such as the pressure chamber 12 is defined by the elastic film 51.

An actuator 130 as a pressure generating unit of this embodiment is provided on the vibration plate 50 of the flow path forming substrate 10. The actuator 130 is, for example, a piezoelectric actuator. The actuator 130 includes a first electrode 60, a piezoelectric layer 70, and a second electrode 80.

In general, one of the electrodes of the actuator 130 is used as a common electrode, and the other electrode is formed by patterning for each of the pressure chambers 12. In this embodiment, the first electrode 60 is provided continuously over a plurality of actuators 130 so as to be a common electrode, and the second electrodes 80 are provided independently for each of the actuators 130 so as to be individual electrodes. Of course, it is possible to reverse this electrode configuration for the convenience of the drive circuit or wiring.

In the above example, although a case in which the vibration plate 50 is formed of the elastic film 51 and the insulator film 52 is exemplified, the vibration plate is not limited to the above case. For example, any one of the elastic film 51 and the insulator film 52 may be provided as the vibration plate 50, or only the first electrode 60 may function as a vibration plate without providing the elastic film 51 and the insulator film 52 as the vibration plate 50. In addition, the actuator 130 itself may be substantially used as a vibration plate.

The piezoelectric layer 70 is made of an oxide piezoelectric material having a polarized structure, can be made of, for example, a perovskite-type oxide represented by the general formula $ABO_3$, and can use a lead-based piezoelectric material containing lead, a lead-free piezoelectric material containing no lead, or the like.

A leading end of a lead electrode 90 is connected to the second electrode 80, which is an individual electrode of the actuator 130. The lead electrode 90 is extended from the vicinity of an end portion on the opposite side to the supply communication path 19 and is further extended over the vibration plate 50. The lead electrode 90 is made of gold (Au) or the like, for example.

A wiring substrate 121 is connected to the other end of the lead electrode 90. For the wiring substrate 121, a flexible sheet-like substrate, for example, a COF substrate or the like can be used. A drive circuit 120 for driving the actuator 130 is provided on the wiring substrate 121.

As shown in FIG. 6, a second terminal row 123 is formed on one surface of the wiring substrate 121. The second terminal row 123 is configured of a plurality of second terminals (wiring terminals) 122 aligned in the Y-axis direction. The wiring substrate 121 is not limited to a COF substrate, and may be an FFC, an FPC, or the like.

As shown in FIG. 5, a protective substrate 30 having substantially the same size as the flow path forming substrate 10 is bonded to a surface of the flow path forming substrate 10 on the side of the actuator 130. The protective substrate 30 has a holding portion 31, which is a space for protecting the actuator 130.

The holding portion 31 has a concave shape which opens toward the flow path forming substrate 10 side without passing through the protective substrate 30 in the Z-axis direction as the thickness direction. The holding portion 31 is provided independently for each row configured of the actuators 130 arranged side by side in the X-axis direction. In other words, the holding portions 31 are provided so as to accommodate the rows of the actuators 130 arranged side by side in the X-axis direction, and are provided for each row of the actuators 130, that is, two holding portions 31 are arranged side by side in the Y-axis direction. Such holding portion 31 preferably has a space that does not hinder the movement of the actuator 130, and the space may be sealed or may not be sealed.

The protective substrate 30 has a through-hole 32 passing through in the Z-axis direction as the thickness direction. The through-hole 32 is provided along the X-axis direction, which is a direction in which the plurality of actuators 130 are arranged side by side, between the two holding portions 31 arranged side by side in the Y-axis direction. In other words, the through-hole 32 is an opening having a long side in the direction in which the plurality of actuators 130 are arranged side by side. A base end of the lead electrode 90 is extended so as to be exposed in the through-hole 32, and the lead electrode 90 and the wiring substrate 121 are electrically connected in the through-hole 32.

As the protective substrate 30, it is preferable to use a material having substantially the same thermal expansion coefficient as that of the flow path forming substrate 10, e.g., glass, ceramic material, or the like. In this embodiment, the protective substrate 30 is formed using a silicon single crystal substrate of the same material as that of the flow path forming substrate 10. There is no particular limitation on the method of bonding the flow path forming substrate 10 and the protective substrate 30, and for example, in the present embodiment, the flow path forming substrate 10 and the protective substrate 30 are bonded to each other via an adhesive (not shown).

The head unit 2 includes the flow path forming member 40. The flow path forming member 40 defines the common liquid chamber 100 communicating with the plurality of pressure chambers 12 along with the head body 11. The flow path forming member 40 has substantially the same shape as that of the communication plate 15 in a plan view, and is bonded to the protective substrate 30 and is also bonded to the communication plate 15.

Specifically, the flow path forming member 40 includes a recessed portion 41 having a depth enough to accommodate the flow path forming substrate 10 and the protective substrate 30 on the side of the protective substrate 30. The recessed portion 41 has an opening area wider than a surface of the protective substrate 30 bonded to the flow path forming substrate 10. In a state in which the flow path forming substrate 10 or the like is accommodated in the recessed portion 41, the opening surface of the recessed portion 41 on the side of the nozzle plate 20 is sealed by the communication plate 15. Thus, a third manifold portion 42 is defined by the flow path forming member 40 and the head body 11 on an outer peripheral portion of the flow path forming substrate 10. The common liquid chamber 100 of this embodiment is constituted by the first manifold portion 17 and the second manifold portion 18 provided in the communication plate 15, and the third manifold portion 42 defined by the flow path forming member 40 and the head body 11.

In other words, the common liquid chamber 100 includes the first manifold portion 17, the second manifold portion 18, and the third manifold portion 42. In addition, the common liquid chamber 100 of this embodiment is disposed on both outer sides of the pressure chambers 12 of two rows in the Y-axis direction, and the two common liquid chambers 100 provided on both the outer sides of the pressure chambers 12 of two rows are independently provided so as not to communicate with each other in the head unit 2. In other words, one common liquid chamber 100 is provided for each row of the pressure chambers 12 (rows arranged side by side in the X-axis direction) of the present embodiment while communicating with the row. In other words, the common liquid chamber 100 is provided for each nozzle row NL. Of course, two common liquid chambers 100 may communicate with each other.

As described above, the flow path forming member 40 is a member forming the common liquid chamber 100 and has an inlet 44 communicating with the common liquid chamber 100. In other words, the inlet 44 is an opening portion which serves as an entrance for introducing the liquid, to be supplied to the head body 11, into the common liquid chamber 100. As a material of the flow path forming member 40, for example, a resin, a metal, or the like can be used. In the case where the material of the flow path forming member 40 is a resin material, mass production can be performed at low cost.

A connection port 43 communicating with the through-hole 32 of the protective substrate 30 is provided in the flow path forming member 40. The wiring substrate 121 is inserted into the connection port 43. An upper end portion of the wiring substrate 121 extends in a passing-through direction of the through-hole 32 and the connection port 43, i.e., extends, in the Z-axis direction, toward the opposite side of the ejection direction of the liquid droplets.

A compliance substrate 45 is provided on a surface where the first manifold portion 17 and the second manifold portion 18 of the communication plate 15 are opened. The compliance substrate 45 has substantially the same size as the above-described communication plate 15 in a plan view, and is provided with a first exposure opening portion **45*a* that exposes the nozzle plate 20. Then, in a state in which the compliance substrate 45 exposes the nozzle plate 20 by the first exposure opening portion 45*a*, the opening on the nozzle surface 20*a* side of the first manifold portion 17 and the second manifold portion 18 is sealed. In other words, the compliance substrate 45 defines part of the common liquid chamber 100**.

The compliance substrate 45 includes a sealing film 46 and a fixed substrate 47. The sealing film 46 is made of a flexible thin film (e.g., a thin film having a thickness of 20 μm or less formed of polyphenylene sulfide (PPS) or the like). The fixed substrate 47 is formed of a hard material such as a metal like stainless steel (SUS). Since an area of the fixed substrate 47 opposing the common liquid chamber 100 is an opening portion 48 completely removed in the thickness direction, one surface of the common liquid chamber 100 is a compliance portion 49, which is a flexible portion sealed by only the flexible sealing film 46. In this embodiment, one compliance portion 49 is provided corresponding to one common liquid chamber 100. In other words, in this embodiment, since two common liquid chambers 100 are provided, two compliance portions 49 are provided on both sides in the Y-axis direction with the nozzle plate 20 interposed therebetween.

In the head unit 2, when ejecting a liquid droplet, the liquid is taken in through the inlet 44, and the inside of a flow path from the common liquid chamber 100 to the nozzle 21 is filled with the liquid. Thereafter, in accordance with a signal from the drive circuit 120, a voltage is applied to the actuator 130 corresponding to the pressure chamber 12, thereby causing deflection and displacement of the vibration plate 50 together with the actuator 130. With this, the pressure in the pressure chamber 12 increases, and liquid droplets are ejected through the nozzle 21 communicating with the pressure chamber 12.

Structure of Liquid Ejecting Head

Next, the liquid ejecting head 1 will be described in detail.

As shown in FIG. 6, the liquid ejecting head 1 includes four head units 2, a flow path member 200 configured to hold the head units 2, a head substrate 300 held by the flow path member 200, and the wiring substrate 121 as an example of a flexible wiring substrate. The flow path member 200 includes a holder member that supplies a liquid to the head unit 2.

Figure 7:
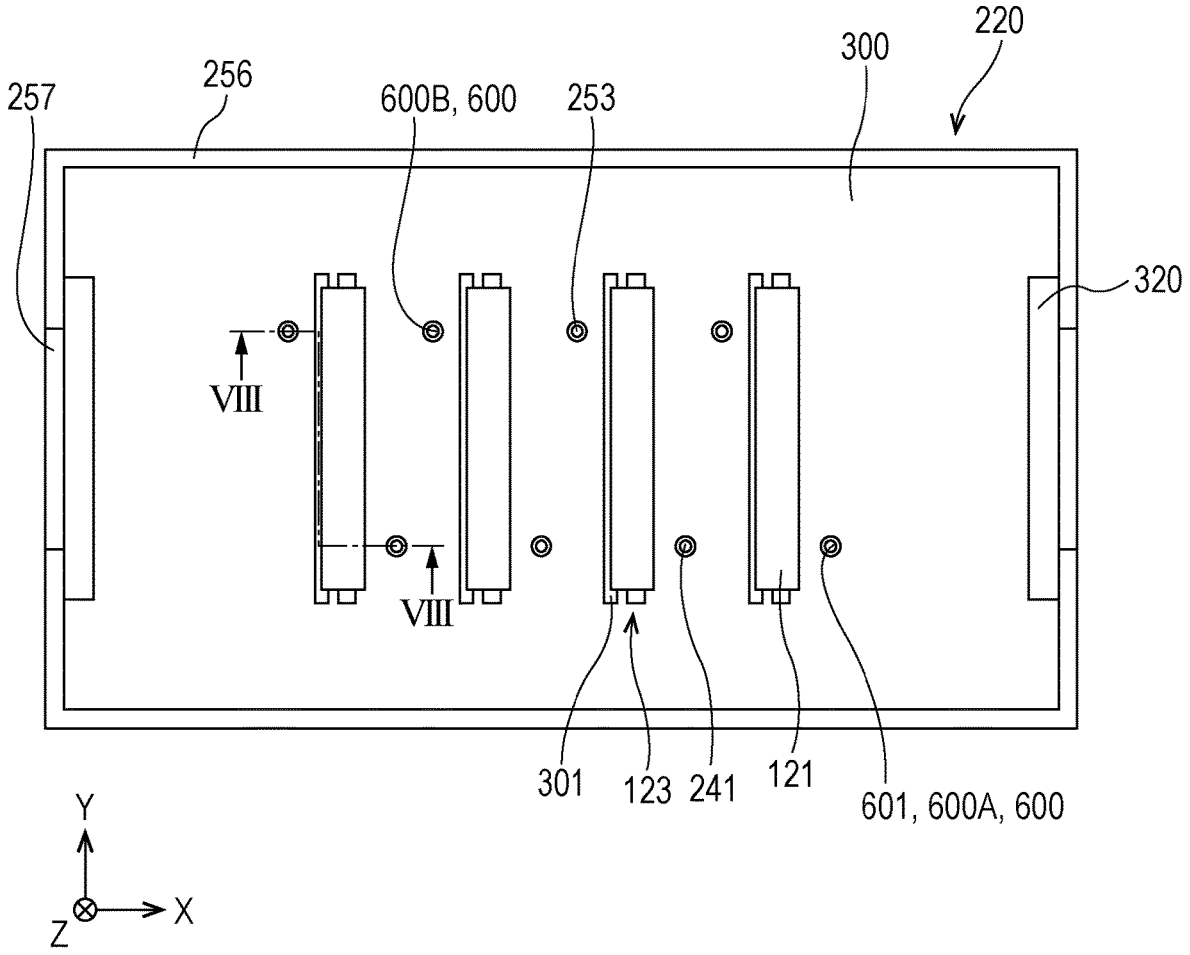
FIG. 7 is a plan view of the liquid ejecting head shown in FIG. 6.

FIG. 7 is a plan view illustrating the liquid ejecting head 1 in which a seal member 230 and an upstream flow path member 210 are omitted.

Figure 8:
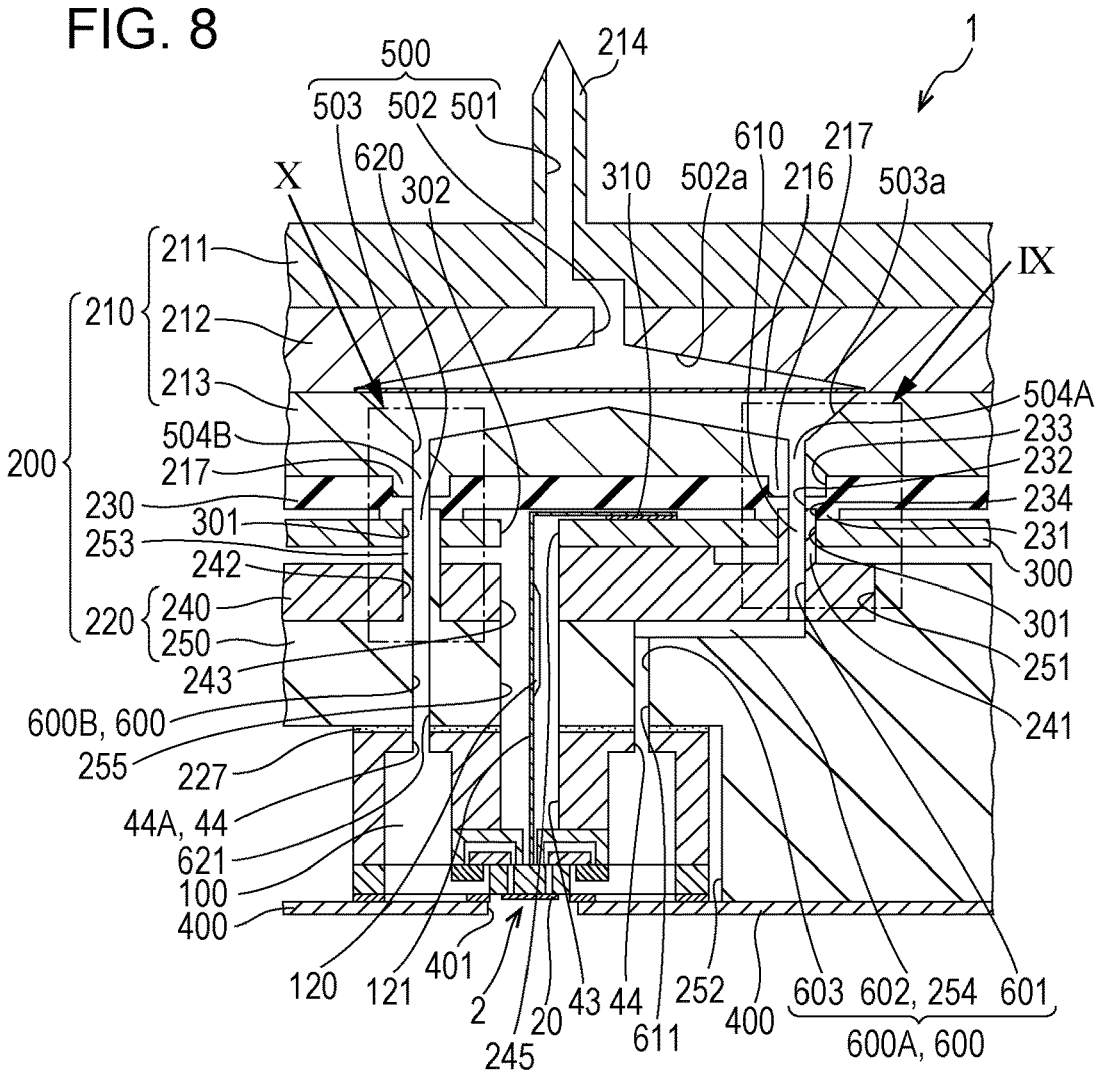
FIG. 8 is a cross-sectional view taken along an arrow line VIII-VIII in FIG. 7.

As shown in FIG. 8, the flow path member 200 includes the upstream flow path member 210, a downstream flow path member 220 as an example of a holder member, and the seal member 230 disposed between the upstream flow path member 210 and the downstream flow path member 220.

The upstream flow path member 210 includes an upstream flow path 500, which serves as a fluid flow path. In this embodiment, the upstream channel member 210 is configured such that a first upstream flow path member 211, a second upstream flow path member 212, and a third upstream flow path member 213 are laminated in the Z-axis direction. The first upstream flow path member 211, the second upstream flow path member 212, and the third upstream flow path member 213 are provided with a first upstream flow path 501, a second upstream flow path 502, and a third upstream flow path 503, respectively. By connecting the first upstream flow path 501, the second upstream flow path 502, and the third upstream flow path 503, the upstream flow path 500 is formed.

The upstream flow path member 210 is not limited to the above mode, and may be constituted with a single member or two or more members. Further, the lamination direction of the plurality of members constituting the upstream flow path member 210 is not particularly limited, and may be the X-axis direction or the Y-axis direction.

The first upstream flow path member 211 includes a connecting portion 214 connected to a liquid container body such as a tank or a cartridge for storing a liquid, on the side opposite to the downstream flow path member 220. In this embodiment, the connecting portion 214 is formed protruding like a needle. A liquid container body such as a cartridge may be directly connected to the connecting portion 214; alternatively, a liquid container such as a tank may be connected thereto via a supply pipe such as a tube.

The first upstream flow path 501 is provided in the first upstream flow path member 211. The first upstream flow path 501 is opened to a top face of the connecting portion 214, and is configured of a flow path extending in the Z-axis direction and a flow path extending in a direction orthogonal to the Z-axis direction, that is, extending in a surface including the X-axis direction and the Y-axis direction, and the like, according to the position of the second upstream flow path 502 to be described later. A guide wall 215 (see FIG. 6) for positioning a liquid holding portion is provided around the connecting portion 214 of the first upstream flow path member 211.

The second upstream flow path member 212 includes the second upstream flow path 502, which is fixed on the side opposite to the connecting portion 214 of the first upstream flow path member 211 and communicates with the first upstream flow path 501. Further, on the downstream side of the second upstream flow path 502 (on the side of the third upstream flow path member 213), there is provided a first liquid reservoir 502*a* whose inner diameter is widened to be larger than that of the second upstream flow path 502.

The third upstream flow path member 213 is provided on the opposite side of the second upstream flow path member 212 to the first upstream flow path member 211. Further, the third upstream flow path 503 is provided in the third upstream flow path member 213. An opening portion of the third upstream flow path 503 on the side of the second upstream flow path 502 is a second liquid reservoir 503*a* whose width is widened in accordance with the first liquid reservoir 502*a*. A filter 216 for removing foreign objects such as bubbles contained in the liquid is provided in an opening portion of the second liquid reservoir 503*a* (between the first liquid reservoir 502*a* and the second liquid reservoir 503*a*). Thus, the liquid supplied from the second upstream flow path 502 (the first liquid reservoir 502*a*) is supplied to the third upstream flow path 503 (the second liquid reservoir 503*a*) through the filter 216.

As the filter 216, for example, a mesh-like body such as a wire net or a resin net, a porous body, or a metal plate with a fine through-hole formed therein can be used. As a specific example of the mesh-like body, a metal mesh filter, metal fiber, a felt-like member made of thin wires of SUS or the like, a metal sintered filter having been pressurized and sintered, an electroforming metal filter, an electron beam-processed metal filter, a laser beam-processed metal filter, or the like can be used.

As a property of the filter 216, it is preferable for the bubble point pressure not to vary, and a filter having a highly defined hole diameter is suitable. Note that "bubble point pressure" refers to a pressure at which a meniscus formed by a filter opening breaks. It is preferable for the filtration particle size of the filter 216 to be smaller than the diameter of the nozzle opening in a case of the nozzle opening being circular in shape, for example, so as to prevent foreign matter in the liquid from reaching the nozzle opening.

In a case where a stainless mesh filter is used as the filter 216, it is preferable to prevent the foreign matter in the liquid from reaching the nozzle opening. For this purpose, it is preferable that the mesh filter be a twill Dutch weave (with a filtration particle size of 10 μm) whose filtration particle size is smaller than the nozzle opening (e.g., with a nozzle opening diameter of 20 μm in a case of the nozzle opening being circular in shape). In this case, the bubble point pressure generated in the liquid (surface tension 28 mN/m) is 3 to 5 kPa. In addition, in a case where a twill Dutch weave (with a filtration particle size of 5 μm) is adopted, the bubble point pressure generated in the liquid is 0 to 15 kPa.

The third upstream flow path 503 is branched into two paths on the downstream side (the side opposite to the second upstream flow path) relative to the second liquid reservoir 503*a*, and the third upstream flow path 503 is opened as a first discharge port 504A and a second discharge port 504B to the surface of the third upstream flow path member 213 on the side of the downstream flow path member 220. Hereinafter, when the first discharge port 504A and the second discharge port 504B are not distinguished from each other, they will be referred to as a discharge port 504.

In other words, the upstream flow path 500 corresponding to one connecting portion 214 includes the first upstream flow path 501, the second upstream flow path 502 and the third upstream flow path 503, and the upstream flow path 500 is opened, to the downstream flow path member 220 side, as two discharge ports 504 (the first discharge port 504A and the second discharge port 504B). To rephrase, the two discharge ports 504 (the first discharge port 504A and the second discharge port 504B) are provided in communication with the common flow path.

On the downstream flow path member 220 side of the third upstream flow path member 213, a third projection portion 217 protruding toward the downstream flow path member 220 side is provided. The third projection portion 217 is provided for each of the third upstream flow paths 503, and the discharge port 504 is provided opening to the leading end surface of the third projection portion 217.

The first upstream flow path member 211, the second upstream flow path member 212 and the third upstream flow path member 213 provided with the above-discussed upstream flow path 500, are integrally laminated by, for example, adhesion with an adhesive agent, welding, or the like. The first upstream flow path member 211, the second upstream flow path member 212, and the third upstream flow path member 213 can also be fixed by screws, clamps, or the like. However, in order to suppress the leakage of liquid from connecting portions from the first upstream flow path 501 to the third upstream flow path 503, bonding is preferably performed by adhesion, welding, or the like.

In this embodiment, four connecting portions 214 are provided in one upstream flow path member 210, and four independent upstream flow paths 500 are provided in one upstream flow path members 210. The liquid is supplied to each of the upstream flow paths 500 corresponding to each of the four head units 2. One upstream flow path 500 branches into two paths and communicates with a downstream flow path 600, which will be described later, to be connected to each of two inlets 44 of the head unit 2.

In this embodiment, an example has been described in which the upstream flow path 500 is branched into two paths downstream of the filter 216 (the downstream flow path member 220 side); however, the embodiment is not limited thereto, and the upstream flow path 500 may be branched into three or more paths downstream of the filter 216. Further, it is not absolutely necessary that one upstream flow path 500 is branched downstream of the filter 216.

The downstream flow path member 220 is an example of a holder member that is bonded to the upstream flow path member 210 and includes the downstream flow path 600 communicating with the upstream flow path 500. The downstream flow path member 220 according to the present embodiment is constituted of a first downstream flow path member 240, which is an example of a first member, and a second downstream flow path member 250, which is an example of a second member.

The downstream flow path member 220 includes the downstream flow path 600, which serves as a liquid flow path. The downstream flow path 600 according to the present embodiment is constituted of two types of flow paths having different shapes, that is, downstream flow paths 600A and 600B.

The first downstream flow path member 240 is a member formed in a substantially flat plate shape. The second downstream flow path member 250 is a member in which a first container 251 as a recessed portion is provided on a surface on the upstream flow path member 210 side, and a second container 252 is provided as a recessed portion on a surface on the opposite side to the upstream flow path member 210.

The first container 251 has such a size that the first downstream flow path member 240 can be accommodated therein. The second container 252 has such a size that four head units 2 can be accommodated therein. The second container 252 according to the present embodiment can accommodate four head units 2.

In the first downstream flow path member 240, a plurality of first projection portions 241 are formed on the surface on the upstream flow path member 210 side. Each of the first projection portions 241 is so provided as to oppose the third projection portion 217 provided with the first discharge port 504A among the third projection portions 217 provided in the upstream flow path member 210. In this embodiment, four first projection portions 241 are provided.

The first downstream flow path member 240 is provided with a first flow path 601 passing through in the Z-axis direction and being opened to the top face of the first projection portion 241 (the surface opposing the upstream flow path member 210). The third projection portion 217 and the first projection portion 241 are bonded with the seal member 230 interposed therebetween, and the first discharge port 504A communicates with the first flow path 601.

A plurality of second through-holes 242 passing through in the Z-axis direction are formed in the first downstream flow path member 240. Each of the second through-holes 242 is formed at a position where a second projection portion 253 formed in the second downstream flow path member 250 is inserted therein. In this embodiment, four second through-holes 242 are provided.

A plurality of first insertion holes 243 into which the wiring substrate 121 electrically connected to the head unit 2 is inserted, are formed in the first downstream flow path member 240. Specifically, each of the first insertion holes 243 is so formed as to pass through in the Z-axis direction and communicate with a second insertion hole 255 of the second downstream flow path member 250 and a third insertion hole 302 of the head substrate 300. In this embodiment, four first insertion holes 243 are provided corresponding to the respective wiring substrates 121 provided in four head units 2. Further, the first downstream flow path member 240 is provided with a support portion 245 protruding toward the head substrate 300 side and having a receiving surface.

A plurality of second projection portions 253 are formed on a bottom surface of the first container 251 in the second downstream flow path member 250. Each of the second projection portions 253 is so provided as to oppose the third projection portion 217 provided with the second discharge port 504B among the third projection portions 217 provided in the upstream flow path member 210. In this embodiment, four second projection portions 253 are provided. Further, in the second downstream flow path member 250, there is provided the downstream flow path 600B passing through in the Z-axis direction and being opened to the top face of the second projection portion 253 and the bottom surface of the second container 252 (the surface opposing the head unit 2). The third projection portion 217 and the second projection portion 253 are bonded to each other with the seal member 230 interposed therebetween, and the second discharge port 504B communicates with the downstream flow path 600B.

A plurality of third flow paths 603 passing through in the Z-axis direction are formed in the second downstream flow path member 250. Each of the third flow paths 603 opens to the bottom surfaces of the first container 251 and the second container 252. In this embodiment, four third flow paths 603 are provided.

A plurality of grooves 254 continuous with the third flow path 603 are formed on the bottom surface of the first container 251 of the second downstream flow path member 250. The groove 254 is sealed with the first downstream flow path member 240 accommodated in the first container 251, thereby constituting a second flow path 602. In other words, the second flow path 602 is a flow path defined by the groove 254 and the surface of the first downstream flow path member 240 on the side of the second downstream flow path member 250. Note that the second flow path 602 corresponds to a flow path provided between a first member and a second member described in the aspects of the invention.

A plurality of second insertion holes 255 into which the wiring substrate 121 electrically connected to the head unit 2 is inserted, are formed in the second downstream flow path member 250. Specifically, each of the second insertion holes 255 is so formed as to pass through in the Z-axis direction and communicate with the first insertion hole 243 of the first downstream flow path member 240 and the connection port 43 of the head unit 2. In this embodiment, four second insertion holes 255 are provided corresponding to the respective wiring substrates 121 provided in four head units 2.

The downstream flow path 600A is formed by the above-described first flow path 601, second flow path 602, and third flow path 603 communicating with each other. Here, the second flow path 602 is formed by sealing a groove formed on one surface of the first downstream flow path member 240 with the second downstream flow path member 250. By bonding the above-discussed first downstream flow path member 240 and second downstream flow path member 250, the second flow path 602 can be easily formed in the downstream flow path member 220.

The second flow path 602 is an example of a flow path extending in the horizontal direction. The fact that the second flow path 602 extends in the horizontal direction means that a component (vector) of the X-axis direction or the Y-axis direction is included in the extending direction of the second flow path 602. Since the second flow path 602 extends in the horizontal direction, the height of the liquid ejecting head 1 in the Z-axis direction can be reduced. If the second flow path 602 is inclined with respect to the horizontal direction, the height dimension of the liquid ejecting head 1 increases.

The extending direction of the second flow path 602 is a direction in which the liquid in the second flow path 602 flows. Therefore, the second flow path 602 includes a flow path provided in the horizontal direction (a direction orthogonal to the Z-axis direction), and a flow path provided so as to intersect with the gravity direction and the horizontal direction (an in-plane direction of the X-axis direction and the Y-axis direction). In this embodiment, the first flow path 601 and the third flow path 603 are aligned in the Z-axis direction, and the second flow path 602 is aligned in the horizontal direction (Y-axis direction). Note that the first flow path 601 and the third flow path 603 may be aligned in an axial direction intersecting with the Z-axis.

The downstream flow path 600A is not limited thereto, and a flow path other than the first flow path 601, the second flow path 602, and the third flow path 603 may be present. Further, the downstream flow path 600A may not be configured of the first flow path 601, the second flow path 602 and the third flow path 603, and may be configured of a single flow path.

As described above, the downstream flow path 600B is formed as a through-hole passing through the second downstream flow path member 250 in the Z-axis direction. It goes without saying that the downstream flow path 600B is not limited to the above mode, and may be, for example, configured to extend in an axial direction intersecting with the Z-axis or may have a configuration in which a plurality of flow paths communicate with each other as in the downstream flow path 600A.

The downstream flow path 600A and the downstream flow path 600B are formed one by one for each head unit 2. In other words, a total of four pairs of the downstream flow path 600A and the downstream flow path 600B are provided in the downstream flow path member 220.

Of the openings at both ends of the downstream flow path 600A, the opening of the first flow path 601 with which the first discharge port 504A communicates is defined as a first inflow port 610, and the opening of the third flow path 603 open to the second container 252 is defined as a first outflow port 611.

Of the openings at both ends of the downstream flow path 600B, the opening of the downstream flow path 600B with which the second discharge port 504B communicates is defined as a second inflow port 620, and the opening of the downstream flow path 600B open to the second container 252 is defined as a second outflow port 621. Hereinafter, when the downstream flow path 600A and the downstream flow path 600B are not distinguished from each other, they will be referred to as the downstream flow path 600.

As shown in FIG. 6, the downstream flow path member 220 (holder member) holds the head unit 2 at a lower side. Specifically, the plurality of (four in this embodiment) head units 2 are accommodated in the second container 252 of the downstream flow path member 220.

As shown in FIG. 8, two inlets 44 are provided for each head unit 2. The first outflow port 611 and the second outflow port 621 of the downstream flow path 600 (the downstream flow path 600A and the downstream flow path 600B) are provided in the downstream flow path member 220 being adjusted to the opening position of each of the inlets 44.

Each of the inlets 44 of the head unit 2 is positioned so as to communicate with the first outflow port 611 and the second outflow port 621 of the downstream flow path 600 opened to the bottom surface portion of the second container 252. The head unit 2 is fixed to the second container 252 by an adhesive 227 provided around each inlet 44. By fixing the head unit 2 to the second container 252 in this manner, the first outflow port 611 and the second outflow port 621 of the downstream flow path 600 communicate with the inlet 44, and then the liquid is supplied to the head unit 2.

On an upper side of the downstream flow path member 220, the head substrate 300 is mounted. Specifically, the head substrate 300 is mounted on a surface of the downstream flow path member 220 on the upstream flow path member 210 side. The head substrate 300 is a member to which the wiring substrate 121 is connected, and on which a circuit to control, via the wiring substrate 121, an ejection operation and the like of the liquid ejecting head 1 or electrical components such as a resistor are mounted.

As shown in FIG. 6, a first terminal row 310 in which a plurality of first terminals (electrode terminals) 311 to which the second terminal row 123 of the wiring substrate 121 is electrically connected are provided side by side, is formed on the surface of the head substrate 300 on the upstream flow path member 210 side. In this embodiment, the first terminal row 310 is an example of a mounting area electrically connected to the wiring substrate 121.

A plurality of third insertion holes 302 into which the wiring substrate 121 electrically connected to the head unit 2 is inserted are formed in the head substrate 300. Specifically, each of the third insertion holes 302 is so formed as to pass through in the Z-axis direction and communicate with the first insertion hole 243 of the first downstream flow path member 240. In this embodiment, four third insertion holes 302 are provided corresponding to the respective wiring substrates 121 provided in the four head units 2.

In the head substrate 300, a third through-hole 301 passing through in the Z-axis direction is provided. In the third through-hole 301, the first projection portion 241 of the first downstream flow path member 240 and the second projection portion 253 of the second downstream flow path member 250 are inserted. In this embodiment, a total of eight third through-holes 301 are provided so as to oppose the first projection portion 241 and the second projection portion 253.

The shape of the third through-hole 301 formed in the head substrate 300 is not limited to the above-described mode. For example, a common through-hole into which the first projection portion 241 and the second projection portion 253 are inserted may be used as an insertion hole. In other words, it is sufficient that, in the head substrate 300, an insertion hole, a cutout, and the like are formed so as not to hinder the connection of the downstream flow path 600 of the downstream flow path member 220 and the upstream flow path 500 of the upstream flow path member 210.

Figure 9:
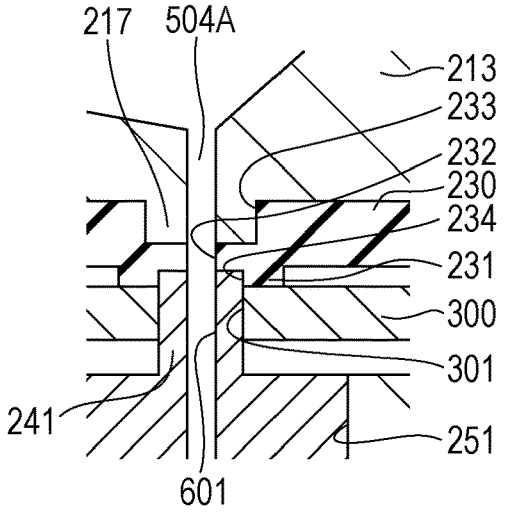
FIG. 9 is an enlarged view of a portion inside a dot-dash line frame on the right side in FIG. 8.
Figure 10:
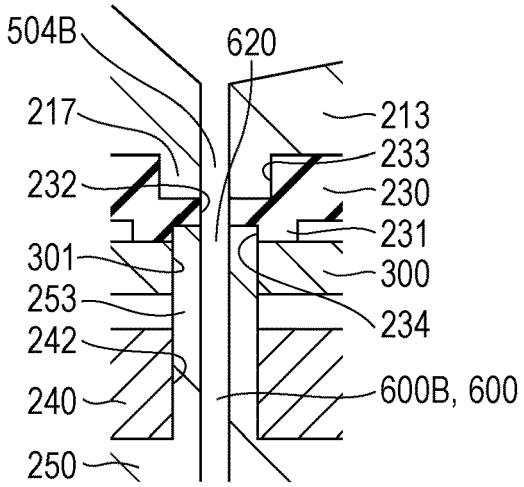
FIG. 10 is an enlarged view of a portion inside a dot-dash line frame on the left side in FIG. 8.

As shown in FIGS. 8, 9, and 10, the seal member 230 is provided between the head substrate 300 and the upstream flow path member 210. As a material of the seal member 230, a material having liquid resistance with respect to liquid such as ink used in the liquid ejecting head 1 and being capable of elastic deformation (elastic material), e.g., rubber, elastomer, or the like can be used.

The seal member 230 is a plate-like member in which a communication path 232 passing through in the Z-axis direction and a fourth projection portion 231 protruding toward the downstream flow path member 220 side are formed. In the present embodiment, eight communication paths 232 and eight fourth projection portions 231 are formed corresponding to the respective upstream and downstream flow paths 500 and 600.

An annular first recessed portion 233 into which the third projection portion 217 is inserted is provided in the seal member 230 on the upstream flow path member 210 side thereof. The first recessed portion 233 is provided at a position opposing the fourth projection portion 231.

The fourth projection portion 231 protrudes toward the downstream flow path member 220 side and is provided at a position opposing the first projection portion 241 and the second projection portion 253 of the downstream flow path member 220. A second recessed portion 234 into which the first projection portion 241 and the second projection portion 253 are inserted is provided on a top face (a surface opposing the downstream flow path member 220) of the fourth projection portion 231.

The communication path 232 passes through the seal member 230 in the Z-axis direction, and one end thereof is opened to the first recessed portion 233 and the other end thereof is opened to the second recessed portion 234. Then, the fourth projection portion 231 is held between the leading end surface of the third projection portion 217 inserted into the first recessed portion 233 and the leading end surfaces of the first projection portion 241 and the second projection portion 253 inserted into the second recessed portion 234, in a state in which a predetermined pressure is applied to the fourth projection portion 231 in the Z-axis direction. Accordingly, the upstream flow path 500 and the downstream flow path 600 communicate with each other in a sealed state via the communication path 232.

A cover head 400 is mounted on the second container 252 side (lower side) of the downstream flow path member 220. The cover head 400 is a member to which the liquid ejecting head 1 is fixed and which is fixed to the downstream flow path member 220, and a second exposure opening portion 401 for exposing the nozzle 21 is provided therein. In this embodiment, the second exposure opening portion 401 has a size to expose the nozzle plate 20, i.e., has substantially the same opening size as the first exposure opening portion 45*a* of the compliance substrate 45.

The cover head 400 is bonded to a surface of the compliance substrate 45 on the opposite side to the communication plate 15, and seals a space on the opposite side to the flow path (the common liquid chamber 100) of the compliance portion 49. By covering the compliance portion 49 with the cover head 400 as described above, it is possible to suppress the compliance portion 49 being broken even if the compliance portion 49 contacts the medium ST. In addition, it is possible to suppress the adhesion of liquid to the compliance portion 49 and to wipe off the liquid adhering to the surface of the cover head 400 by, for example, a wiper blade, thereby making it possible to suppress contamination of the medium ST by the liquid or the like adhering to the cover head 400. Although not specifically shown, the space between the cover head 400 and the compliance portion 49 is opened to the atmosphere. The cover head 400 may be provided independently for each of the liquid ejecting heads 1.

Electrical Configuration of Liquid Ejecting Apparatus

Next, an electrical configuration of the liquid ejecting apparatus 700 will be described.

Figure 11:
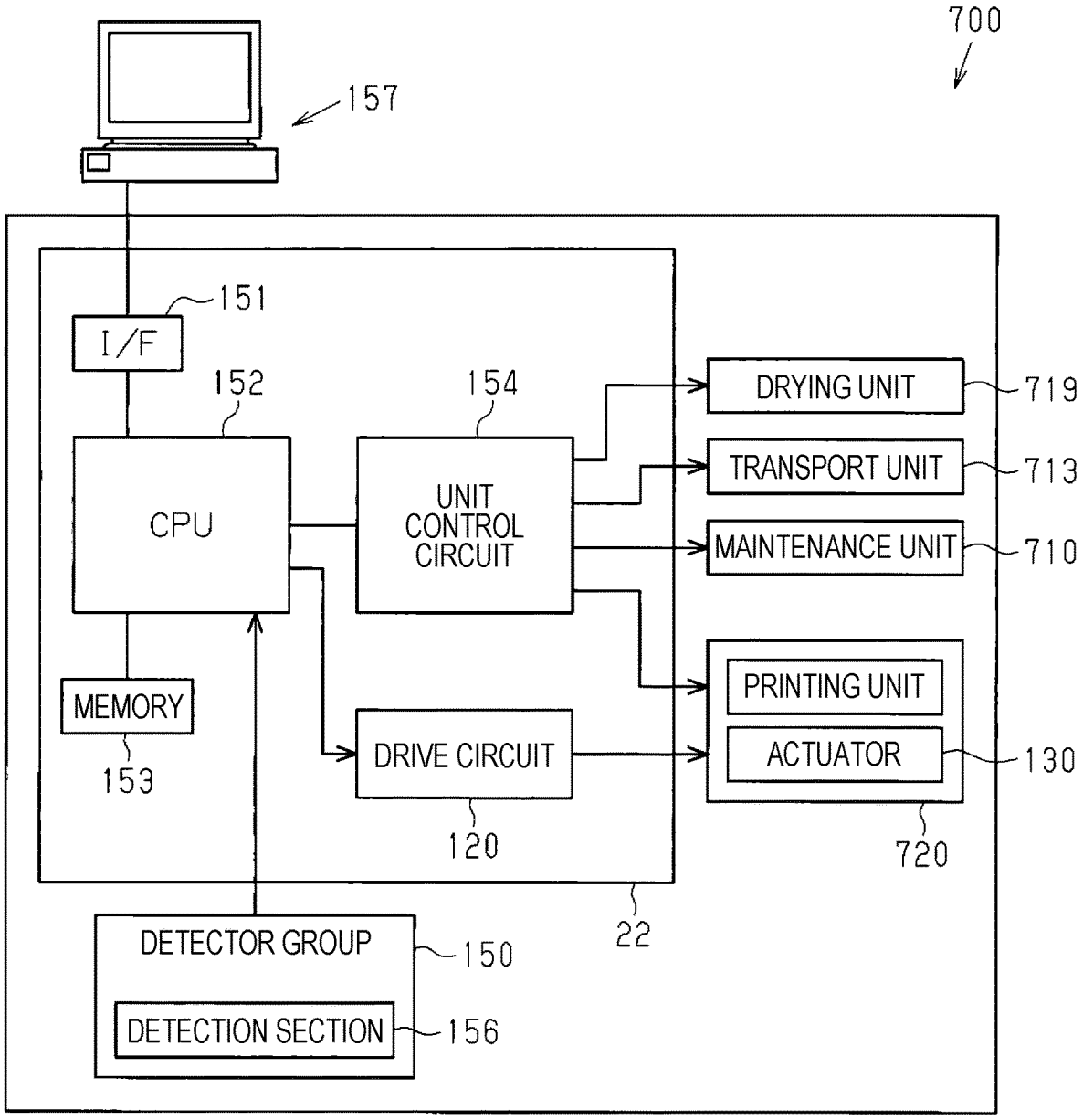
FIG. 11 is a block diagram illustrating an electrical configuration of the liquid ejecting apparatus shown in FIG. 1.

As shown in FIG. 11, the liquid ejecting apparatus 700 includes a control section 22 configured to comprehensively control constituent elements of the liquid ejecting apparatus 700, and a detector group 150 for monitoring states in the liquid ejecting apparatus 700.

The control section 22 includes an interface section 151, a CPU 152, a memory 153, a unit control circuit 154, and the drive circuit 120. The interface section 151 transmits and receives data between a computer 157 as an external apparatus and the liquid ejecting apparatus 700. The drive circuit 120 generates a drive signal for driving the actuator 130.

The CPU 152 is an arithmetic processing unit. The memory 153 is a storage device that secures an area for storing a program of the CPU 152, a working area or the like, and has storage elements such as a RAM and an EEPROM. In accordance with a program stored in the memory 153, the CPU 152 controls the drying unit 719, the transport unit 713, the maintenance unit 710, and the printing unit 720 via the unit control circuit 154.

The detector group 150 includes, for example, a linear encoder (not shown) for detecting a moving state of the carriage 723, a medium detection sensor (not shown) for detecting the medium ST, and a detection section 156 as a circuit for detecting residual vibration of the pressure chamber 12. The detector group 150 outputs detection results to the CPU 152. The control section 22 detects clogging of the nozzle 21 based on a detection result of the detection section 156. The detection section 156 may include a piezoelectric element constituting the actuator 130.

Structure of Maintenance Unit

Next, the structure of the maintenance unit 710 will be described.

Figure 12:
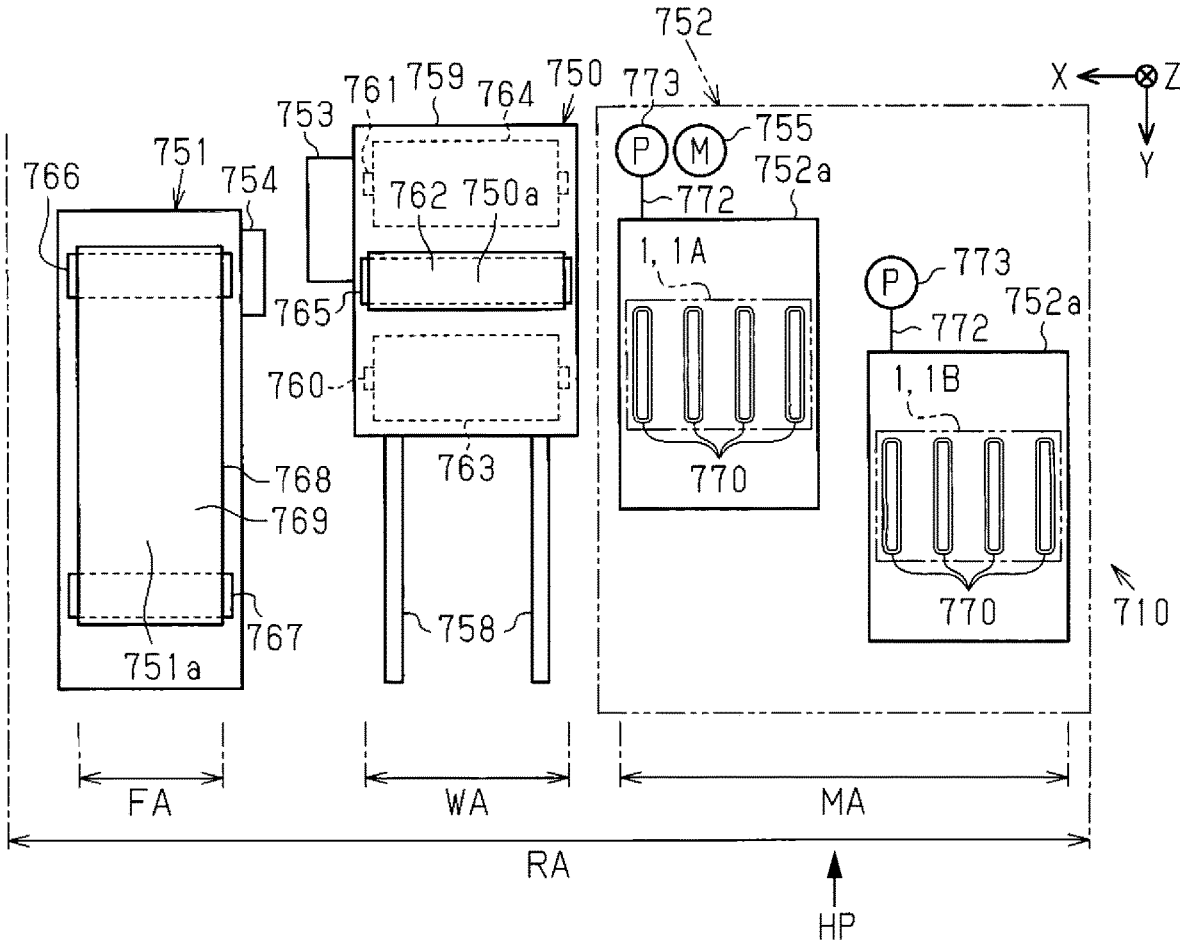
FIG. 12 is a plan view of a maintenance unit included in the liquid ejecting apparatus shown in FIG. 1.

As shown in FIG. 12, the maintenance region RA includes a receiving region FA provided with the liquid receiving mechanism 751, a wiping region WA provided with the wiping mechanism 750, and a suction region MA provided with the cap mechanism 752. In the maintenance region RA, the receiving region FA is disposed at a position closest to the ejection region PA, and the suction region MA is disposed at a position farthest from the ejection region PA.

The wiping mechanism 750 includes a wiping member 750*a* for wiping the liquid ejecting head 1 and a wiping motor 753. The wiping member 750*a* of this embodiment is movable, and wipes the liquid ejecting head 1 by the power of the wiping motor 753. Maintenance carried out by the above-discussed wiping operation is called "wiping".

The wiping mechanism 750 includes a pair of rails 758 extending in the Y-axis direction by the power of the wiping motor 753 and a movable case 759 supported by the rails 758. The power of the wiping motor 753 is transmitted to the case 759 by a power transmission mechanism (e.g., a rack and pinion mechanism), which is not shown, and the case reciprocates on the rails 758 by the stated power.

The case 759 rotatably supports a feed shaft 760, a press roller 765, and a take-up shaft 761 arranged at predetermined intervals in the Y-axis direction. The case 759 has an opening portion (not shown) above the press roller 765.

The feed shaft 760 supports a feed roll 763 on which an unused cloth sheet 762 is wound in a cylindrical shape, and the take-up shaft 761 supports a take-up roll 764 formed by a used cloth sheet 762. The press roller 765 pushes up the cloth sheet 762 between the feed roll 763 and the take-up roll 764 and projects the stated cloth sheet from the opening portion.

The case 759 moves forward in the Y-axis direction from a retracted position shown in FIG. 12 by normal rotation of the wiping motor 753, and reaches the wiping position. Thereafter, the case 759 moves backward from the wiping position to the retracted position by reverse rotation of the wiping motor 753. During the forward movement of the case 759, the wiping member 750*a* wipes the liquid ejecting head 1. The case 759 may move forward in a direction opposite to the Y-axis direction and move backward in the Y-axis direction taking the position thereof shown in FIG. 12 as a folded position.

It is sufficient that the power transmission mechanism switches, when the forward movement of the case 759 ends, the output destination of the driving force of the wiping motor 753 to the take-up shaft 761, and performs the backward movement of the case 759 and the winding of the cloth sheet 762 using the power when the wiping motor 753 is reversely driven. The case 759 wipes one liquid ejecting head 1 by one reciprocation movement and completes the wiping of two liquid ejecting heads 1A and 1B by two-time reciprocation movements.

The liquid receiving mechanism 751 includes a liquid receiving portion 751*a* for receiving liquid droplets ejected by the liquid ejecting head 1, and a flushing motor 754. "Flushing" refers to maintenance in which the liquid ejecting head 1 ejects liquid as a waste liquid for the purpose of preventing and eliminating clogging of the nozzle 21. The liquid receiving portion 751*a* of this embodiment is a belt, and the stated belt is moved by the power of the flushing motor 754 at a time when the amount of ink contamination of the belt due to the flushing exceeds a regulation amount.

The liquid receiving mechanism 751 includes a drive roller 766, a driven roller 767, and an annular belt 768 wound on both rollers 766 and 767. An outer peripheral surface of the belt 768 becomes a liquid receiving surface 769 for receiving the liquid. The X-axis direction is an axial direction of each of the rollers 766 and 767, and the rollers 766 and 767 are disposed being distanced from each other in the Y-axis direction. The belt 768 has a width dimension (length in the X-axis direction) capable of receiving the waste liquid ejected simultaneously by all the nozzles 21 included in one liquid ejecting head 1.

The liquid receiving mechanism 751 includes a moisturizing liquid supply section (not shown) capable of supplying a moisturizing liquid to the liquid receiving surface 769 under the belt 768, and a liquid scraping section (not shown) for scraping off a waste liquid or the like adhering to the liquid receiving surface 769 in a moisture retaining state. When the belt 768 is moved by the rotation of the drive roller 766, the waste liquid received by the liquid receiving surface 769 is scraped off from the belt 768 by the liquid scraping section. With this, the liquid receiving surface 769 for receiving the liquid droplets next is updated to a portion thereof without a waste liquid.

The cap mechanism 752 includes two cap portions 752*a* and a capping motor 755. The two cap portions 752*a* move between a capping position and a separate position with the power of the capping motor 755. The capping position is a position where the cap portion 752*a* contacts the liquid ejecting heads 1A and 1B, and the separate position is a position where the cap portion 752*a* is distanced from the liquid ejecting heads 1A and 1B. When the liquid ejecting heads 1A and 1B stop at the home position HP as indicated by a double-dot dash line in FIG. 12 and the cap portion 752*a* moves from the separate position to the capping position, the cap portion 752*a* comes into contact with the liquid ejecting heads 1A and 1B so as to surround the opening of the nozzle 21. As described above, maintenance in which the cap portion 752*a* surrounds the opening of the nozzle 21 is called "capping", and a state in which the cap portion 752*a* is in contact with the liquid ejecting heads 1A and 1B is called a capping state.

One cap portion 752*a* includes four suction caps 770. The suction cap 770 makes contact with the liquid ejecting head 1 to form a space surrounding the nozzle group (two nozzle rows NL as shown in FIG. 3). The suction cap 770 is connected to a suction pump 773 via a tube 772. When the suction pump 773 is driven at a time of capping, a negative pressure is generated in the suction cap 770, and the inside of the liquid ejecting head 1 is sucked. By this suction, a thickened liquid and bubbles inside the liquid ejecting head 1 are discharged. In this manner, maintenance for discharging the liquid from the nozzle 21 by suction is referred to as suction cleaning.

When suction cleaning is performed, the liquid discharged from the nozzle 21 adheres to the liquid ejecting head 1. Therefore, it is preferable to remove the adhering liquid droplets and the like by wiping after suction cleaning. In addition, there is a possibility that foreign matter adhering to the liquid ejecting head 1 and bubbles may be pushed into the nozzle 21 or the meniscus (gas-liquid interface in the nozzle 21) may be broken due to wiping, resulting in defective ejection. Therefore, it is preferable to perform flushing after wiping so as to discharge the foreign matter having entered, arrange the meniscus, or the like.

Figure 13:
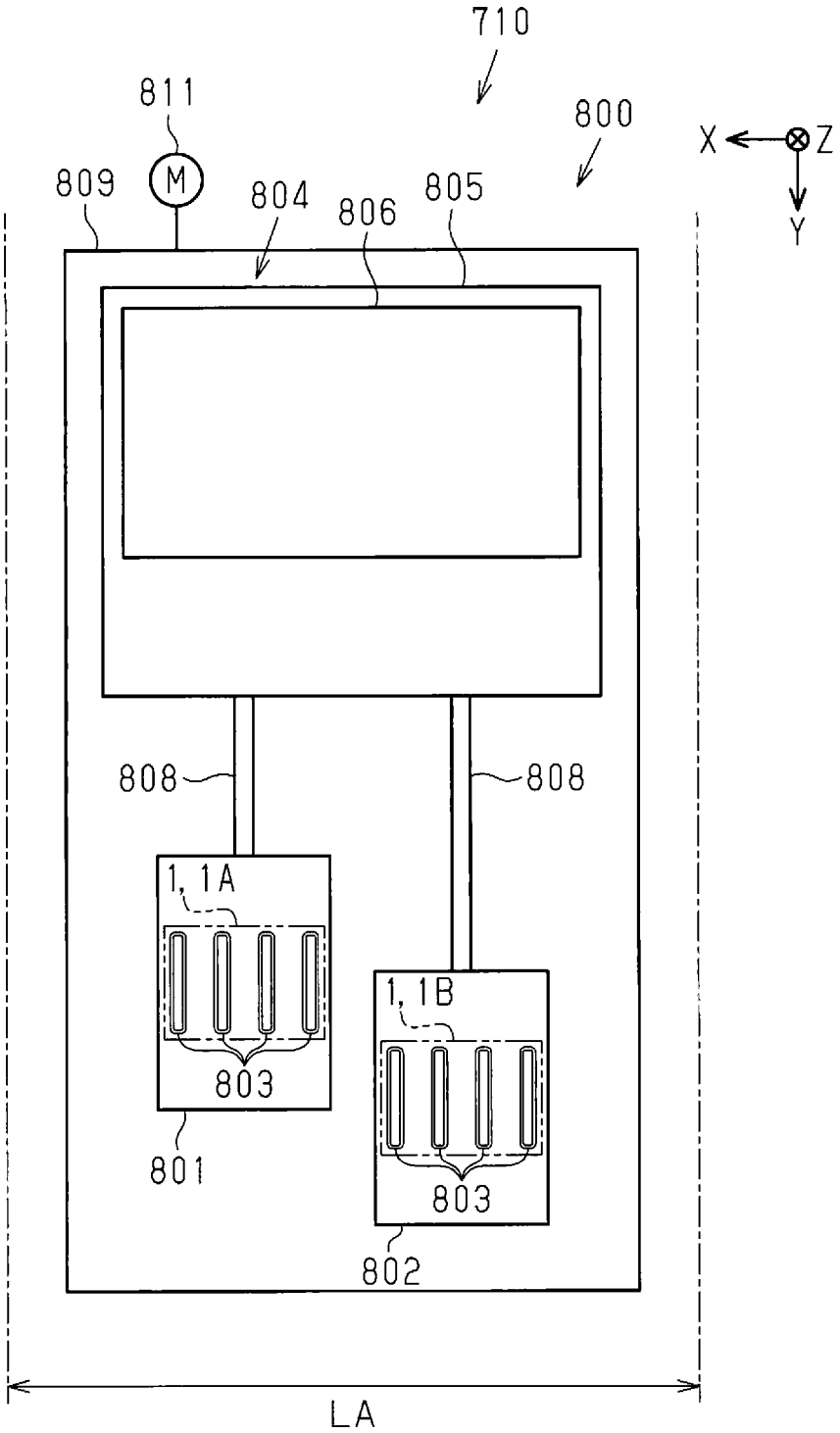
FIG. 13 is a plan view of a cap device included in the liquid ejecting apparatus shown in FIG. 1.

As shown in FIG. 13, the cap device 800 includes cap units 801 and 802 for moisture retention, connection flow paths 808, and a supply mechanism 804, which can supply a moisturizing liquid to the cap units 801 and 802 through the connection flow paths 808. In FIG. 13, a single connection flow path 808 is illustrated for each of the cap units 801 and 802, but in practice, four connection flow paths 808 each are provided corresponding to the number of caps 803 so that a total of eight connection flow paths 808 extend from a moisturizing liquid storage section 805.

When the liquid ejecting heads 1A and 1B stop in the maintenance region LA, the cap units 801 and 802 respectively contact the liquid ejecting heads 1A and 1B in such a manner as to surround the opening of the nozzle 21. In this manner, maintenance in which the cap units 801 and 802 each form a space surrounding the opening of the nozzle 21 is called "moisture retention capping". Moisture retention capping is a type of capping. Due to the moisture retention capping, drying of the nozzle 21 is suppressed. Each of the cap units 801 and 802 has four caps 803 for moisture retention. The stated four caps 803 are aligned in the X-axis direction corresponding to four nozzle groups of the liquid ejecting head 1.

Figure 14:
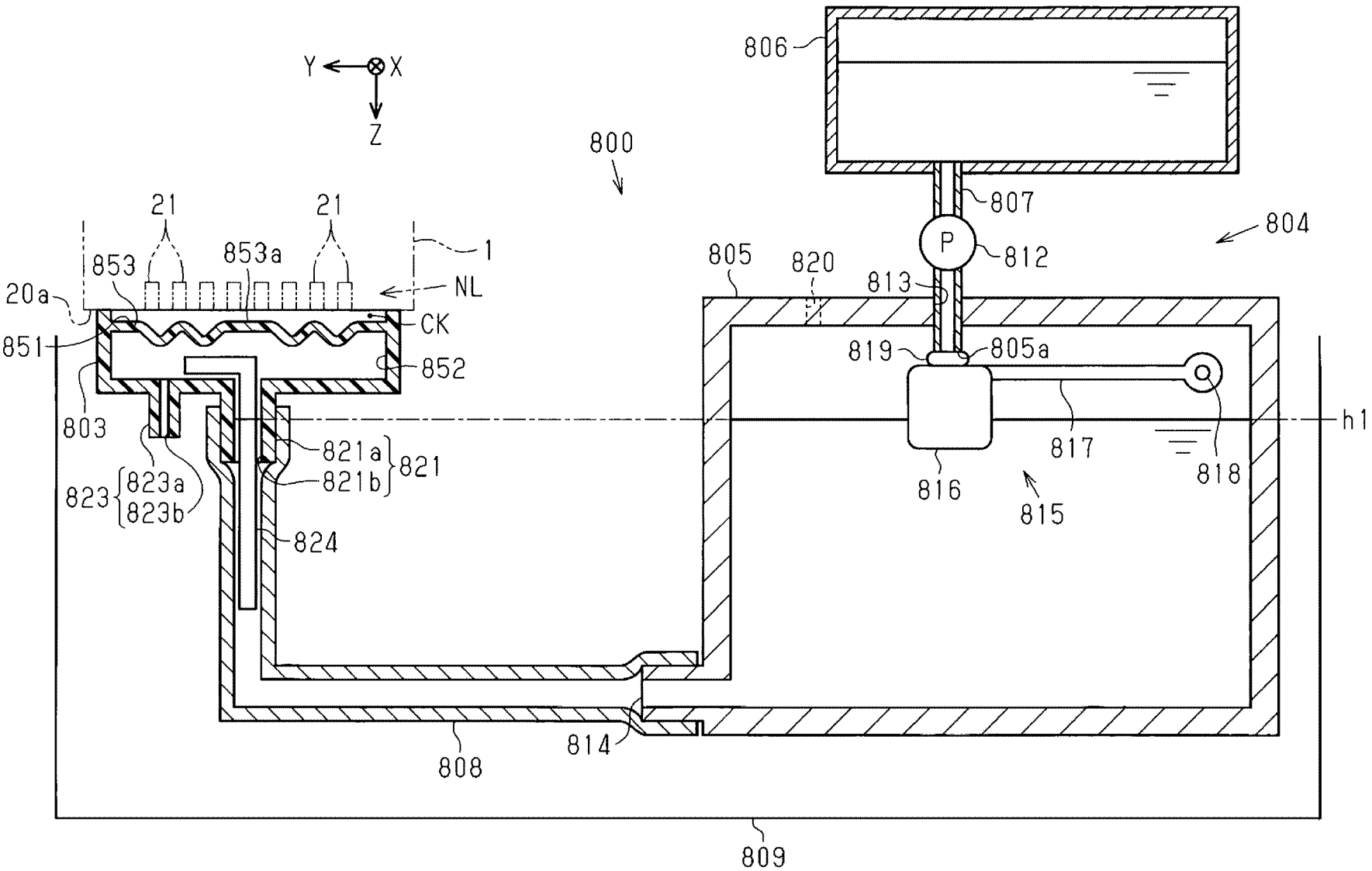
FIG. 14 is a cross-sectional view schematically illustrating the configuration of the cap device shown in FIG. 13.

As shown in FIG. 14, the supply mechanism 804 includes a moisturizing liquid storage section 805 capable of storing the moisturizing liquid, a moisturizing liquid container 806 capable of storing the moisturizing liquid to be supplied to the moisturizing liquid storage section 805, and a supply flow path 807 connecting the moisturizing liquid storage section 805 and the moisturizing liquid container 806. In the case where the moisturizing liquid container 806 is disposed above the moisturizing liquid storage section 805, the moisturizing liquid can be caused to flow down from the moisturizing liquid container 806 toward the moisturizing liquid storage section 805 through the supply flow path 807.

The cap device 800 includes a holding body 809 for holding the cap units 801 and 802 as well as the moisturizing liquid storage section 805, and a moisturizing motor 811 (see FIG. 13) for vertically moving the holding body 809. The cap 803 and the moisturizing liquid storage section 805 move up and down along with the holding body 809. Due to this vertical movement, the cap 803 moves to a capping position where the cap 803 makes contact with the liquid ejecting head 1 and a separate position distanced from the liquid ejecting head 1. In other words, the cap 803 can be in a capping state in which the cap 803 makes contact with the liquid ejecting head 1 to form a space CK in which the nozzle 21 opens, and a non-capping state in which the cap 803 separates from the liquid ejecting head 1.

The supply mechanism 804 supplies the moisturizing liquid to the cap 803. The moisturizing liquid is an example of a moisturizing fluid for moisturizing the space CK. The supply flow path 807 is a flow path for supplying the moisturizing liquid from the moisturizing liquid container 806 toward the moisturizing liquid storage section 805. An upstream end of the supply flow path 807 is connected to the moisturizing liquid container 806, and a downstream end thereof is accommodated inside the moisturizing liquid storage section 805. A hole 813 for passing through the supply flow path 807 is provided in an upper portion of the moisturizing liquid storage section 805. A pump 812 configured to deliver the moisturizing liquid stored in the moisturizing liquid container 806 toward the moisturizing liquid storage section 805 may be disposed halfway in the supply flow path 807. While the power of the liquid ejecting apparatus 700 is being turned on, the pump 812 continues to deliver the moisturizing liquid at a constant pressure.

In the supply mechanism 804, the moisturizing liquid storage section 805, the moisturizing liquid container 806 and the supply flow path 807 are separately formed, so that the moisturizing liquid container 806 can be replaced. In this case, it is possible to replenish the moisturizing liquid by replacing the moisturizing liquid container 806. In the supply mechanism 804, the moisturizing liquid storage section 805, the moisturizing liquid container 806, and the supply flow path 807 may be integrally formed. In this case, it is preferable to provide a replenishing port for replenishing the moisturizing liquid into the moisturizing liquid container 806.

The moisturizing liquid storage section 805 includes an outlet 814 to which the upstream end of the connection flow path 808 is connected, an inlet 805*a* for introducing the moisturizing liquid supplied from the moisturizing liquid container 806, and a float valve 815 for opening or closing the inlet 805*a* according to variation in the liquid level of the moisturizing liquid in the moisturizing liquid storage section 805. In this embodiment, the inlet 805*a* is the downstream end of the supply flow path 807.

The float valve 815 has a buoyancy body 816 floating on the moisturizing liquid, a shaft member 817, to the leading end of which the buoyancy body 816 is fixed, a shaft 818 rotatably holding a base end of the shaft member 817, and a valve portion 819 mounted on an upper portion of the buoyancy body 816. In the moisturizing liquid storage section 805, the buoyancy body 816 moves in such a manner as to draw an arc about the shaft 818 as the liquid level of the moisturizing liquid changes.

When the liquid level of the moisturizing liquid rises in the moisturizing liquid storage section 805 and reaches a first position h1 indicated by a dot-dash line in FIG. 14, the valve portion 819 is pushed against the inlet 805*a* by buoyancy of the buoyancy body 816. As a result, the valve portion 819 closes the supply flow path 807, and the supply of the moisturizing liquid from the moisturizing liquid container 806 is stopped.

When the liquid level of the moisturizing liquid drops below the first position h1, the valve portion 819 is separated from the inlet 805*a* to open the inlet 805*a*. Thus, the supply mechanism 804 supplies the moisturizing liquid from the moisturizing liquid container 806 so that the liquid level of the moisturizing liquid stored in the moisturizing liquid storage section 805 is maintained at the first position h1. It is preferable for the first position h1 to be lower in position than the nozzle 21 of the liquid ejecting head 1.

In an upper portion of the moisturizing liquid storage section 805, a communication portion 820 is provided through which the inside of the moisturizing liquid storage section 805 communicates with the atmosphere. The communication portion 820 has, for example, an elongated hole that is so extended as to meander. This communication portion 820 opens the inside of the moisturizing liquid storage section 805 to the atmosphere while suppressing the discharge, to the exterior, of the evaporated moisturizing liquid inside the moisturizing liquid storage section 805.

An upstream end of the connection flow path 808 is connected to the outlet 814, and a downstream end thereof is connected to the cap 803. The moisturizing liquid stored in the moisturizing liquid storage section 805 is supplied into the cap 803 through the connection flow path 808 due to a water head difference.

It is preferable for the cap device 800 to include a capillary member 824 arranged to extend from the inside of the connection flow path 808 into the cap 803. The capillary member 824 is a thin string-like member having capillary force. In this case, the supply mechanism 804 preferably supplies the moisturizing liquid so that the liquid level of the moisturizing liquid is positioned within the capillary member 824.

The capillary member 824 is, for example, a sponge-like member with open cells of several μm to several hundred μm. As a material of the capillary member 824, a polyolefin such as EVA or polyethylene is preferable. The capillary member 824 supplies the moisturizing liquid passing through the capillary member 824 by the capillary force, toward the cap 803. In a case where the capillary member 824 is made of a highly liquid-repellent material, it is also possible to supply the moisturizing liquid toward the cap 803 through the outer side of the capillary member 824 by making use of the capillary force generated in a gap between a surface of the capillary member 824 and the inner surface of the connection flow path 808. In this case, air (air bubbles) in the connection flow path 808 is discharged toward the cap 803 side through the inside of the capillary member 824. In the case where the above-discussed capillary member 824 is disposed in the connection flow path 808, the moisturizing liquid is easily directed toward the cap 803 so that a moisturizing effect in the space CK is enhanced.

The moisturizing liquid stored in the moisturizing liquid storage section 805 is supplied toward the cap 803 by the water head difference through the connection flow path 808. Therefore, the connection flow path 808 is filled with the moisturizing liquid up to the same height as the liquid level of the moisturizing liquid stored in the moisturizing liquid storage section 805. In other words, the moisturizing liquid flows into the connection flow path 808 up to the first position h1. It is sufficient for the first position h1 to be set so that a lower end portion of the capillary member 824 is immersed in the moisturizing liquid having flowed within the connection flow path 808.

It is sufficient that the first position h1 is set at a position lower than the space CK. With this, the moisturizing liquid that has flowed into the connection flow path 808 and reached the first position h1 evaporates, and thus the evaporated moisturizing liquid suppresses the drying of the nozzle 21. In the case where the liquid level of the moisturizing liquid drops due to the evaporation, the supply mechanism 804 supplies the moisturizing liquid so that the moisturizing effect in the space CK is maintained.

It is preferable that the moisturizing liquid used in the cap device 800 be the same as the main solvent of the liquid used by the liquid ejecting apparatus 700. For example, in a case where the liquid is water-based resin ink, pure water is preferably used as the moisturizing liquid because the solvent is water. In a case where the solvent of ink is a solvent medium, it is preferable to use the same solvent as that of the ink, as the moisturizing liquid. In addition, a liquid in which a preservative is contained in pure water may be used as the moisturizing liquid.

The preservative to be contained in the moisturizing liquid is preferably the same as a preservative contained in the ink, and examples thereof include an aromatic halogen compound (e.g., Preventol CMK), methylene dithiocyanate, a halogen-containing nitrogen sulfur compound, 1, 2-benzisothiazolin-3-one (e.g., PROXEL GXL), and the like. In a case where PROXEL is employed as a preservative from the viewpoint of difficulty in bubbling, it is preferable that the content of the PROXEL be no more than 0.05 mass % with respect to the moisturizing liquid.

Cap for Moisture Retention

As shown in FIG. 14, the cap 803 for moisture retention includes a recessed portion 851, which forms the space CK surrounding the opening of the nozzle 21 when the cap makes contact with the liquid ejecting head 1.

The cap 803 for moisture retention includes a moisturizing chamber 852 to which a moisturizing fluid for moisturizing the space CK is supplied, and a partition wall 853 for partitioning the recessed portion 851 and the moisturizing chamber 852. The partition wall 853 is part of a wall constituting the recessed portion 851 and the moisturizing chamber 852, and has gas permeability (particularly, water vapor permeability). It is sufficient that at least part of the partition wall 853 is a gas permeable portion having gas permeability.

The leading end of the capillary member 824 extending from the inside of the connection flow path 808 is disposed in the moisturizing chamber 852. The moisturizing liquid supplied through the connection flow path 808 permeates into the capillary member 824 and evaporates, and the moisturizing fluid, which is the above-mentioned evaporated vapor, fills the moisturizing chamber 852. Thus, the moisturizing fluid supplied to the moisturizing chamber 852 passes through the partition wall 853 and moves into the recessed portion 851 to moisturize the space CK. With this, drying of the nozzle 21 is suppressed at the time of moisture retention capping.

It is preferable for the partition wall 853 to have higher gas permeability than other walls constituting the moisturizing chamber 852. For example, in the case where the partition wall 853 constitutes a ceiling of the moisturizing chamber 852, it is preferable that a wall for constituting a side wall, a bottom wall, and the like of the moisturizing chamber 852 be made of a material having lower gas permeability than the partition wall 853 (e.g., a polypropylene resin, a polybutylene terephthalate resin, or a modified polyphenylene ether resin), be thickened, or the like. As a result, the moisturizing fluid in the moisturizing chamber 852 is unlikely to go out of the cap 803.

It is preferable that part of the wall of the recessed portion 851 be configured of a flexible portion 853*a*, which deforms at a lower pressure than a pressure at which a gas-liquid interface (meniscus) formed inside the nozzle 21 breaks. In this embodiment, the partition wall 853 functions as the flexible portion 853*a*. In addition, part of the partition wall 853 may be formed of the flexible portion 853*a*, which is more easily deflected and displaced than other parts thereof. For example, the center portion of the partition wall 853 may be formed of the corrugated flexible portion 853*a* having a cross-sectional waveform which is more easily deflected and displaced than an outer edge portion thereof.

In the case where the partition wall 853 (flexible portion 853*a*) is deflected and displaced, pressure fluctuations are unlikely to occur in the space CK even if fluctuations in temperature or the like occur. In particular, in the case where the flexible portion 853*a* deforms at a pressure lower than the pressure at which the meniscus is broken, breaking of the meniscus due to the pressure fluctuation is suppressed.

It is preferable for the moisturizing chamber 852 to include an atmospheric communication portion 823, which communicates with the atmosphere, in a wall (e.g., a bottom wall thereof) different from the partition wall 853. For example, the atmospheric communication portion 823 includes an atmospheric communication pipe 823*a* extending downward from a bottom portion of the cap 803, and an atmospheric communication hole 823*b* formed inside the atmospheric communication pipe 823*a* and opening to the moisturizing chamber 852. The atmospheric communication portion 823 may be provided in a side wall of the moisturizing chamber 852.

It is preferable that the moisturizing chamber 852 include an introduction portion 821, for introducing the moisturizing fluid, below the partition wall 853. For example, the introduction portion 821 includes an introduction pipe 821*a* extending downward from the bottom portion of the cap 803, and an introduction hole 821*b* formed inside the introduction pipe 821*a* and opening to the moisturizing chamber 852.

The connection flow path 808 is connected to the introduction portion 821, and the supply mechanism 804 supplies the moisturizing liquid to be the moisturizing fluid, through the connection flow path 808, to the moisturizing chamber 852. It is preferable that the supply mechanism 804 supply the moisturizing liquid into the moisturizing chamber 852 in such a manner as to secure a space in which the partition wall 853 is deflected and displaced. In the case where the moisturizing chamber 852 is filled with the moisturizing liquid, the partition wall 853 is unlikely to be deflected and displaced. Therefore, it is preferable that the moisturizing chamber 852 be not filled with the moisturizing liquid, and that a gas be present in at least a space with which the partition wall 853 constituting the ceiling makes contact.

Figure 15:
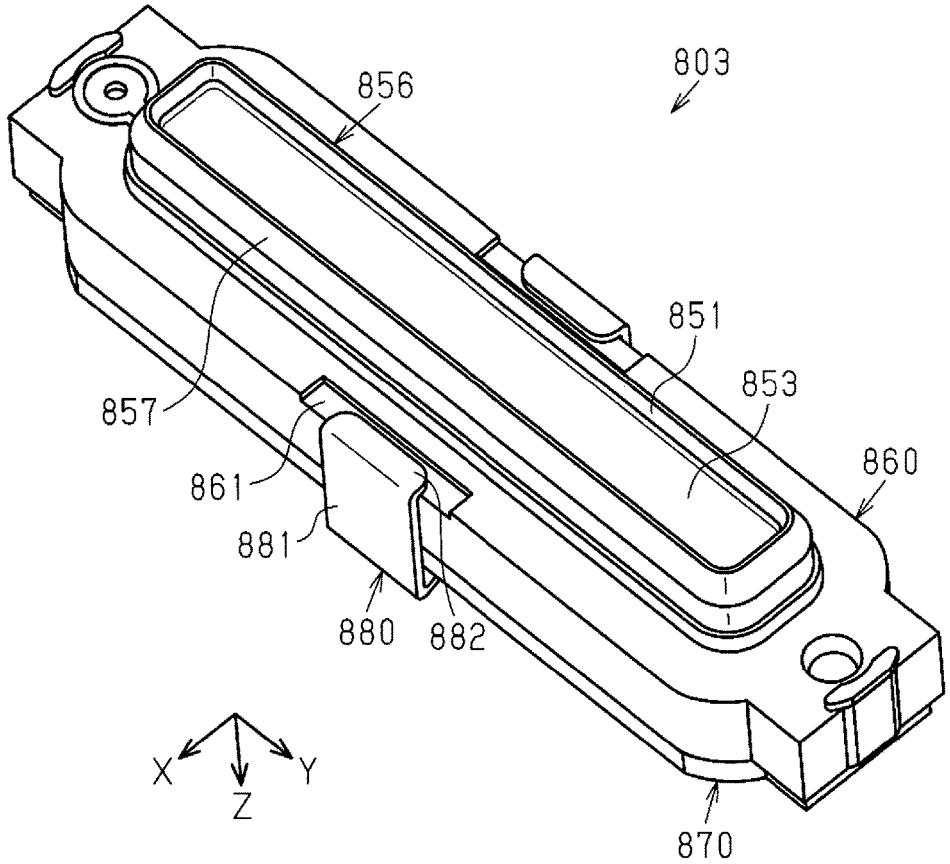
FIG. 15 is a perspective view of a cap provided in the cap device shown in FIG. 14.

As shown in FIG. 15, the cap 803 for moisture retention includes a lip body 856 having the recessed portion 851, a first member 860 for holding the lip body 856, a second member 870 to be combined with the first member 860, and a locking member 880. The locking member 880 includes an arm 881 for holding the first member 860 and the second member 870 in a vertically combined state, and a locking claw 882 provided at a leading end of the arm 881.

Figure 16:
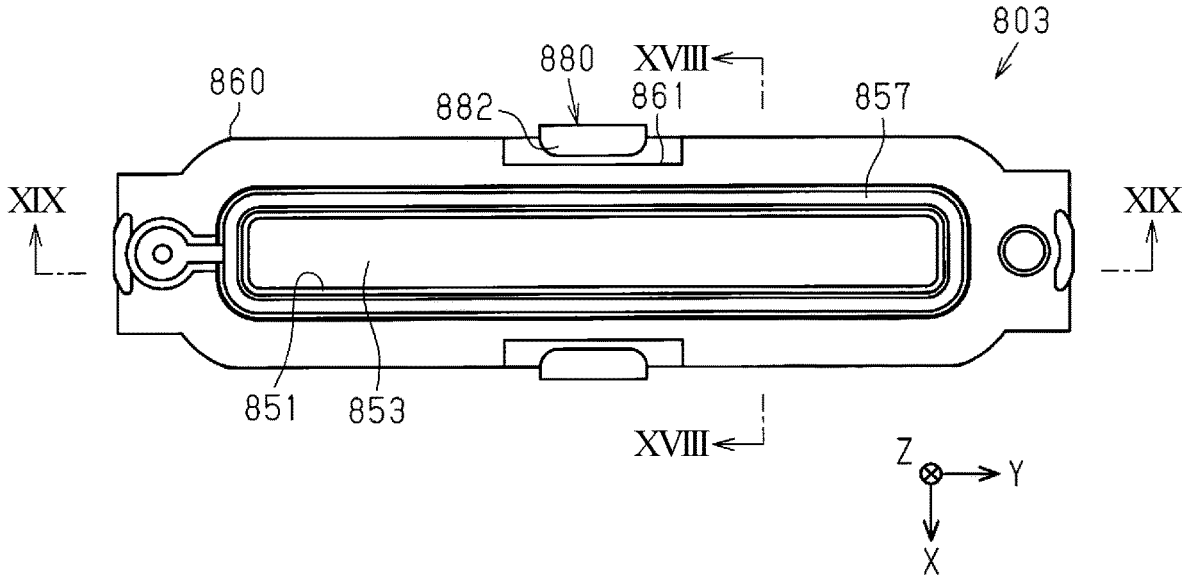
FIG. 16 is a plan view of the cap shown in FIG. 15.

As shown in FIG. 16, an inner bottom surface of the recessed portion 851 (the upper surface of the partition wall 853) may be a flat surface. In the case where the inner bottom surface of the recessed portion 851 is made flat, cleaning is easily performed when the recessed portion 851 is contaminated due to dripping of liquid droplets or the like.

Figure 17:
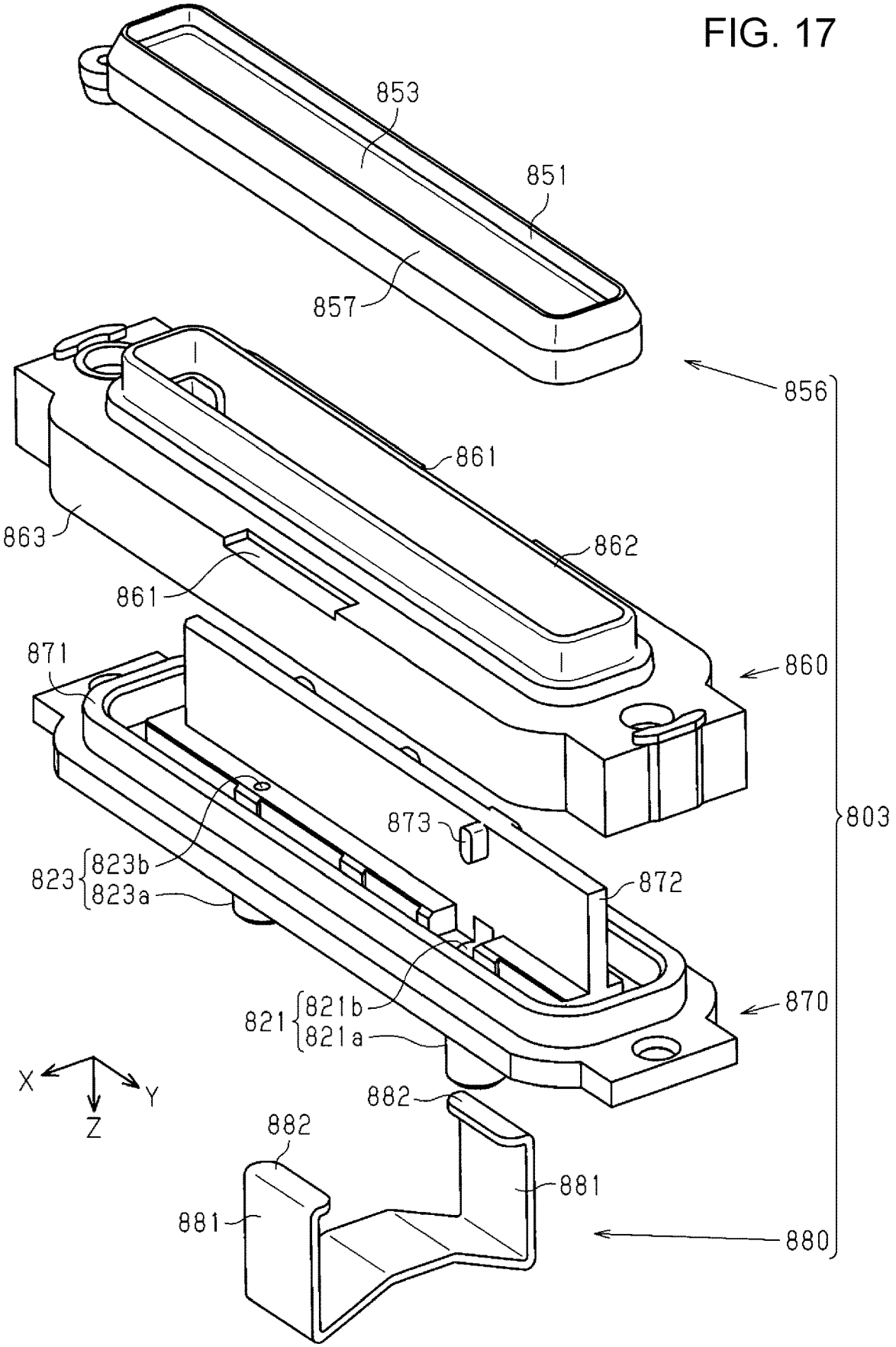
FIG. 17 is an exploded perspective view of the cap shown in FIG. 15.

As shown in FIG. 17, the lip body 856 has an annular contact portion 857 extending upward from an outer edge of the partition wall 853. The contact portion 857 and the partition wall 853 constitute the wall of the recessed portion 851. The contact portion 857 contacts the nozzle surface 20*a* (see FIG. 14) when the space CK (see FIG. 14) being formed. The lip body 856 has characteristics as the contact portion 857, and is made of an elastomer resin (e.g., a styrene-based elastomer resin) having gas permeability as the partition wall 853.

The first member 860 includes an engaging recessed portion 861 on which the locking claw 882 is hooked, an annular wall 862 to support the lip body 856, and an engaging leg portion 863, which is engaged with the second member 870.

The second member 870 includes an annular engaging wall 871, which is engaged with the engaging leg portion 863, the atmospheric communication portion 823, the introduction portion 821, and an inner wall 872 projecting upward from the inside of the annular engaging wall 871.

Figure 18:
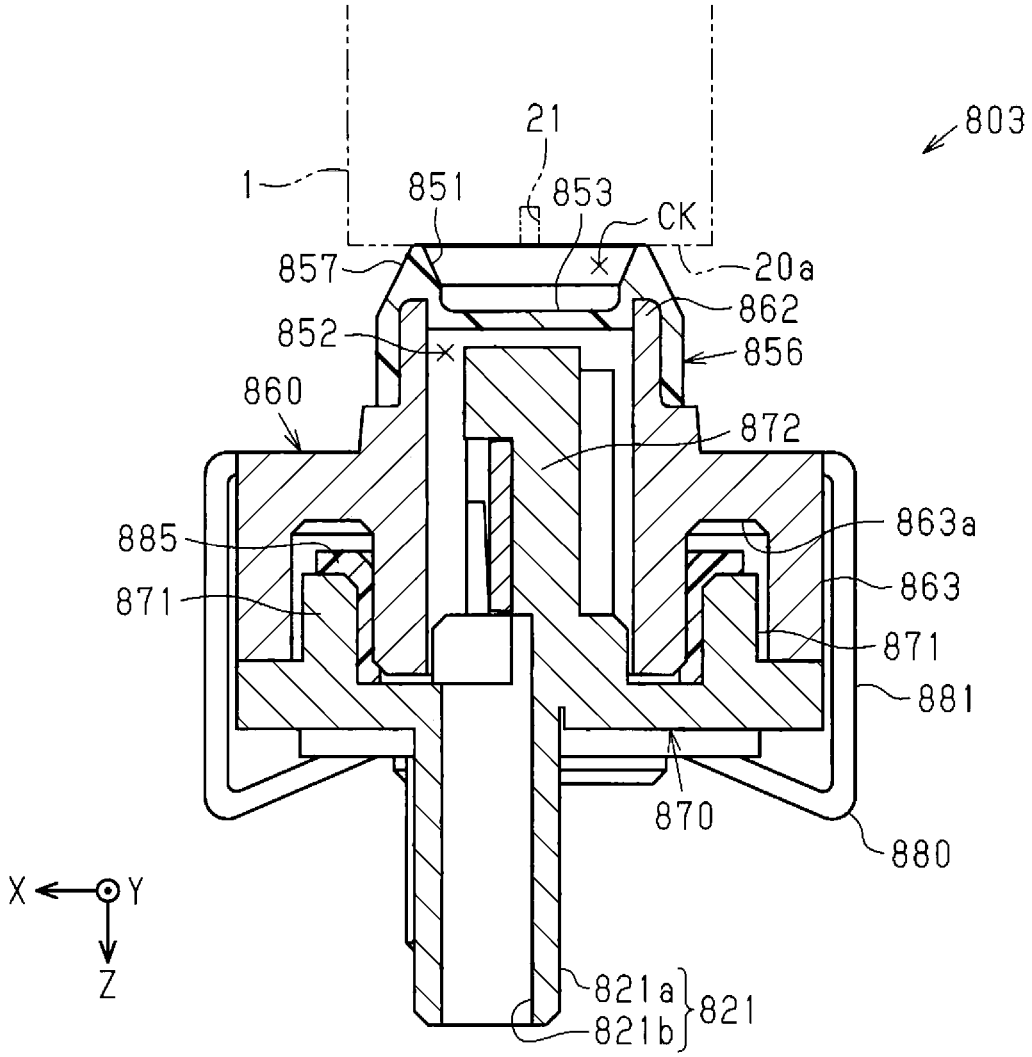
FIG. 18 is a cross-sectional view taken along an arrow line XVIII-XVIII in FIG. 16.

As shown in FIG. 18, in the case where the leading end of the inner wall 872 is disposed under the partition wall 853, when the upper surface of the partition wall 853 is cleaned, the partition wall 853 can be supported by the inner wall 872.

It is sufficient that the engaging leg portion 863 has a downwardly opening recessed portion 863*a* to allow the annular engaging wall 871 to enter the recessed portion 863*a*. The first member 860 and the second member 870 surround and form the moisturizing chamber 852. A seal member 885 made of an annular elastic body may be interposed between the recessed portion 863*a* and the annular engaging wall 871 so that no gap is generated between the first member 860 and the second member 870.

Figure 19:
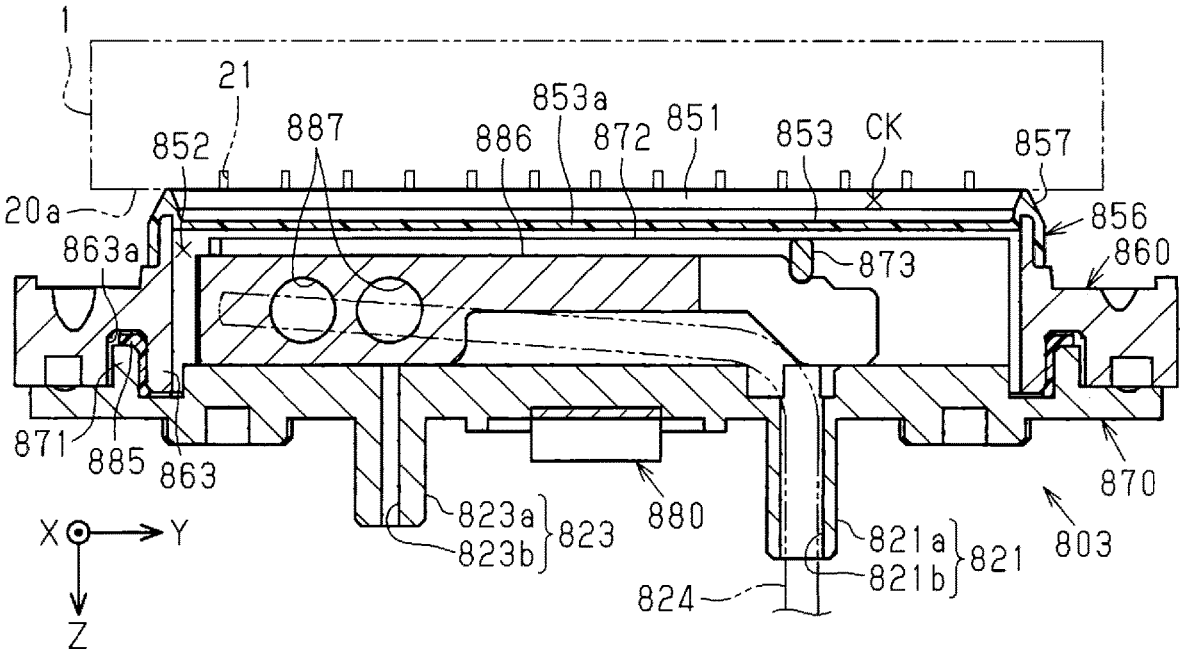
FIG. 19 is a cross-sectional view taken along an arrow line XIX-XIX in FIG. 16.

As shown in FIG. 19, a holding member 886 for holding the capillary member 824 may be accommodated in the moisturizing chamber 852. The holding member 886 includes, for example, a plurality of through holes 887 through which the capillary member 824 runs. In this case, when the capillary member 824 is run through the through hole 887, the leading end of the capillary member 824 can be fixed inside the moisturizing chamber 852. In the case where the through hole 887 is arranged at a position distanced upward from the atmospheric communication hole 823*b*, the capillary member 824 is separated from the atmospheric communication hole 823*b*, and the outflow of the moisturizing fluid from the atmospheric communication hole 823*b* can be suppressed. In the case where the holding member 886 is disposed, a locking projection 873 for locking the holding member 886 to the inner wall 872 is preferably provided.

Next, operations of the cap device 800 and the liquid ejecting apparatus 700 of the present embodiment will be described.

When the space CK becomes in a sealed state at the time of moisture retention capping, the pressure in the space CK may fluctuate, such as when the ambient temperature fluctuates, and the gas-liquid interface in the nozzle 21 may be broken. In this regard, the cap 803 has the flexible partition wall 853, and the partition wall 853 is deflected and displaced according to the pressure fluctuation, whereby the breaking of the gas-liquid interface in the nozzle 21 is suppressed.

According to the cap device 800 and the liquid ejecting apparatus 700 of the present embodiment, the following effects can be obtained.

(1-1) Since the partition wall 853 allows the moisturizing fluid in the moisturizing chamber 852 to permeate into the space CK, the nozzle 21 opening to the space CK can be moisturized by the moisturizing fluid. When a pressure fluctuation occurs in the space CK to which the nozzle 21 opens, the flexible portion 853*a* constituting the wall of the recessed portion 851 is deflected and displaced so that the breaking of the gas-liquid interface formed in the nozzle 21 is suppressed. As described above, the displacement of the flexible portion 853*a* can reduce the pressure fluctuation in the space CK for moisturizing the nozzle 21.

(1-2) When the gas permeability of the partition wall 853 is made higher than that of the other walls constituting the moisturizing chamber 852, the moisturizing fluid in the moisturizing chamber 852 can be introduced into the recessed portion 851 through the partition wall 853. Further, it is possible to suppress the permeation of the moisturizing fluid from the other walls constituting the moisturizing chamber 852 to the external space.

(1-3) Due to the deflection displacement of the partition wall 853, it is possible to reduce the pressure fluctuation in the space CK for moisturizing the nozzle 21.

(1-4) In the case where the inner bottom surface of the recessed portion 851 is made flat, cleaning in the recessed portion 851 is easily performed.

(1-5) In the case where the atmospheric communication portion 823 is provided in the moisturizing chamber 852, the pressure fluctuation in the moisturizing chamber 852 can be reduced by the gas flowing through the atmospheric communication portion 823. Thus, the deflection displacement of the partition wall 853 caused by the pressure fluctuation in the moisturizing chamber 852 is suppressed. As a result, it is possible to suppress the pressure fluctuation in the recessed portion 851 due to the deflection displacement of the partition wall 853.

(1-6) By the partition wall 853 being deflected and displaced, the pressure fluctuation in the moisturizing chamber 852 can be reduced.

(1-7) By allowing the moisturizing liquid to permeate into the capillary member 824, bubbling of the moisturizing liquid can be suppressed.

(1-8) By keeping the liquid level of the moisturizing liquid within the moisturizing liquid storage section 805 constant by the float valve 815, the liquid level of the moisturizing liquid supplied through the connection flow path 808 can be kept constant.

Second Embodiment

Figure 20:
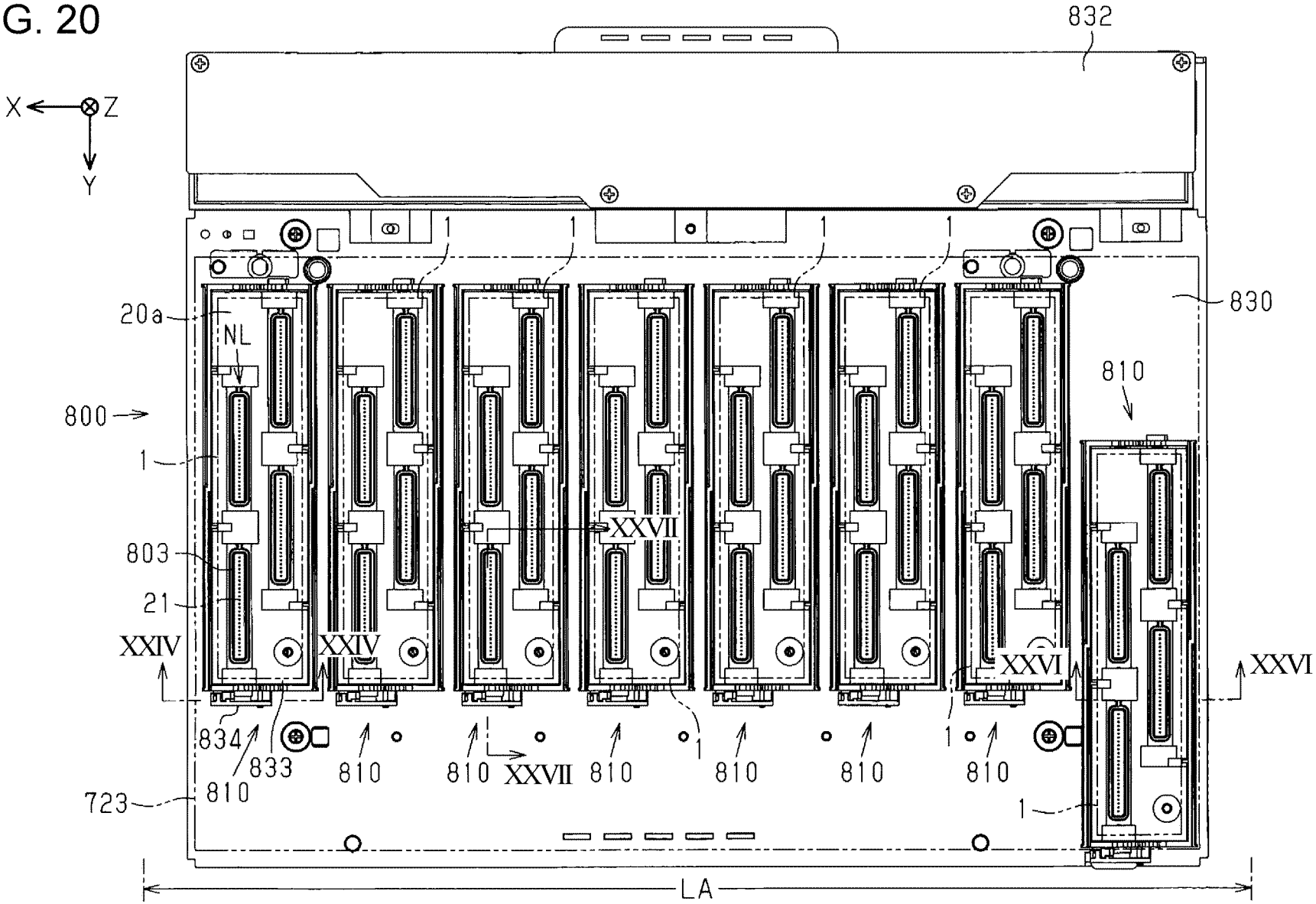
FIG. 20 is a plan view of a cap device included in a liquid ejecting apparatus according to a second embodiment.

As shown in FIG. 20, a liquid ejecting apparatus 700 of the present embodiment includes eight liquid ejecting heads 1 held by a carriage 723. The stated eight liquid ejecting heads 1 are aligned in the X-axis direction. Of the eight liquid ejecting heads 1, the liquid ejecting head 1 present at a position closest to the home position HP (see FIG. 2) ejects a processing liquid (curing agent) for promoting the curing of ink, and the remaining seven liquid ejecting heads 1 eject ink. The liquid ejecting head 1 for ejecting the processing liquid is disposed at a position shifted in the Y-axis direction relative to the other liquid ejecting heads 1.

Like in the first embodiment, the liquid ejecting head 1 includes a nozzle surface 20*a* to which a nozzle 21 opens, and reciprocates between the ejection region PA (see FIG. 2) in which a liquid is ejected toward the medium ST (see FIG.

1) and the maintenance region LA in which a cap 803 contacts the liquid ejecting head 1.

The liquid ejecting head 1 has four nozzle groups arranged in a staggered manner. Two of the four nozzle groups are aligned in the Y-axis direction, and two thereof are aligned in the X-axis direction. The nozzle groups aligned in the X-axis direction are shifted in position in the Y-axis direction. One nozzle group is configured of at least one nozzle row NL.

A cap device 800 of the present embodiment includes a plurality of cap units 810 disposed at positions corresponding to the plurality of liquid ejecting heads 1 individually, a support plate 830 configured to support the plurality of cap units 810, a support base 831 (see FIG. 24) disposed below the support plate 830, and a moving mechanism 832 configured to move the support plate 830 up and down.

Figure 21:
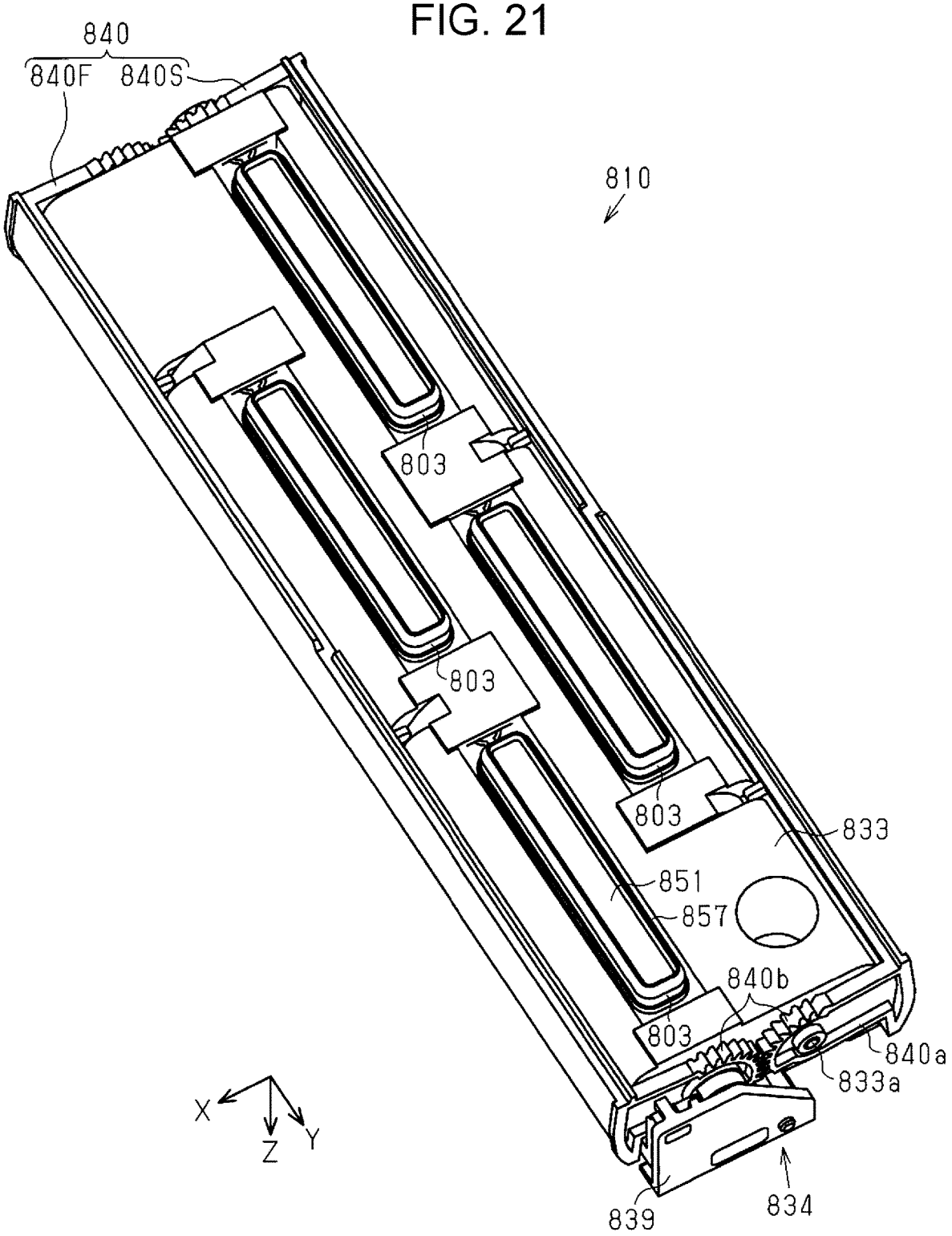
FIG. 21 is a perspective view of a cap unit constituting the cap device shown in FIG. 20.

As shown in FIG. 21, the cap unit 810 includes a plurality of (four in this embodiment) caps 803 individually corresponding to a plurality of nozzle groups, a cap cover 840, a cap holding portion 833 for holding the plurality of caps 803 and the cap cover 840, and an opening/closing mechanism 834 for opening and closing the cap cover 840.

Figure 22:
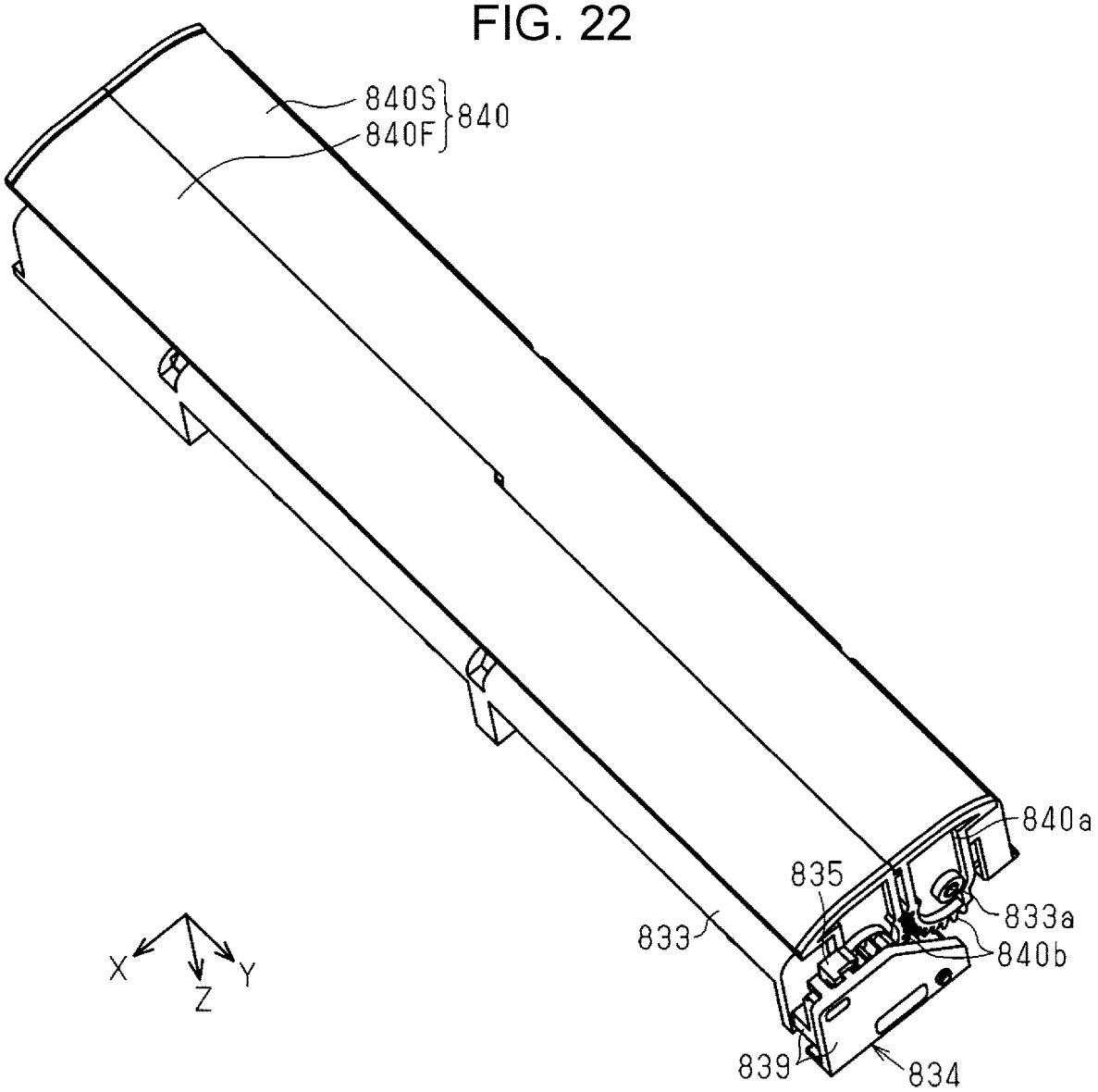
FIG. 22 is a perspective view of a cap and a cap cover constituting the cap device shown in FIG. 20.

As shown in FIG. 22, the cap cover 840 includes a first cover 840F and a second cover 840S configured to rotate in opposite directions to each other. It is preferable for the first cover 840F and the second cover 840S to have the same shape.

Figure 23:
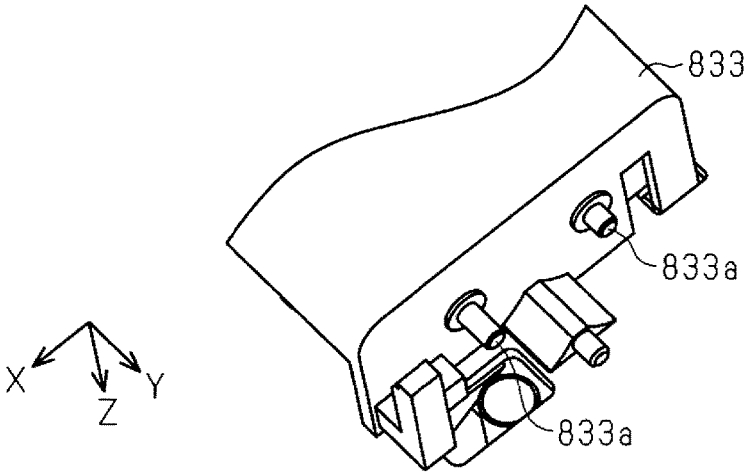
FIG. 23 is a partially enlarged view of a cap holding portion constituting the cap device shown in FIG. 20.

As shown in FIG. 23, the cap holding portion 833 has two rotation shafts 833*a* protruding in the Y-axis direction. As shown in FIG. 22, the cap cover 840 includes an engagement arm 840*a* that engages with the rotation shaft 833*a*, and a gear 840*b* disposed around the rotation shaft 833*a*. The rotation shaft 833*a* extends in a direction along the nozzle surface 20*a* (see FIG. 20) and intersects with a reciprocation path (X-axis) of the liquid ejecting head 1 (see FIG. 20).

As shown in FIG. 22, the gear 840*b* of the first cover 840F and the gear 840*b* of the second cover 840S mesh with each other. The first cover 840F and the second cover 840S rotate in opposite directions to each other about the corresponding rotation shafts 833*a*.

Figure 24:
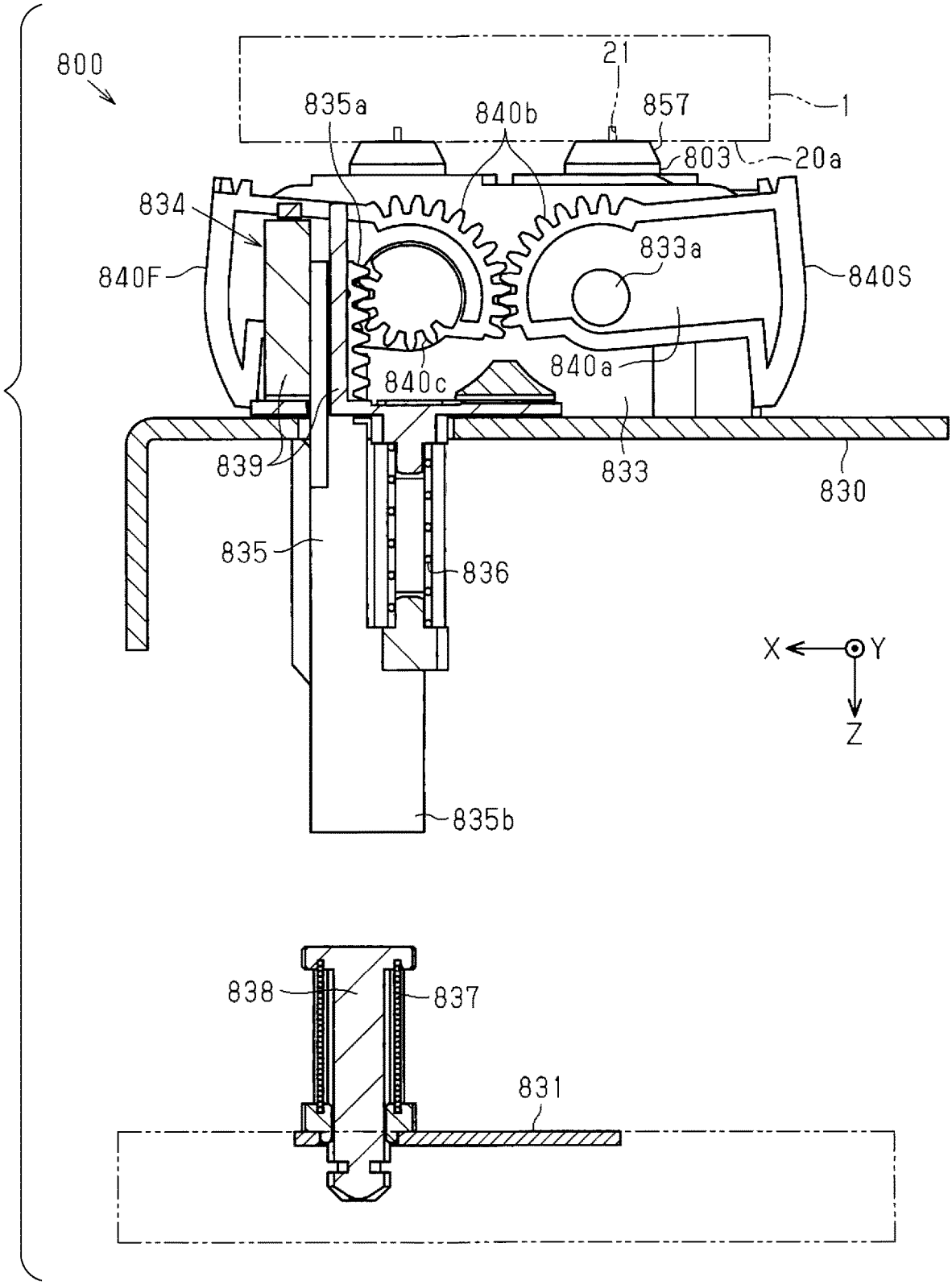
FIG. 24 is a cross-sectional view taken along an arrow line XXIV-XXIV in FIG. 20.

As shown in FIG. 24, the first cover 840F includes a pinion 840*c* located on an inner peripheral side of the gear 840*b*.

Figure 25:
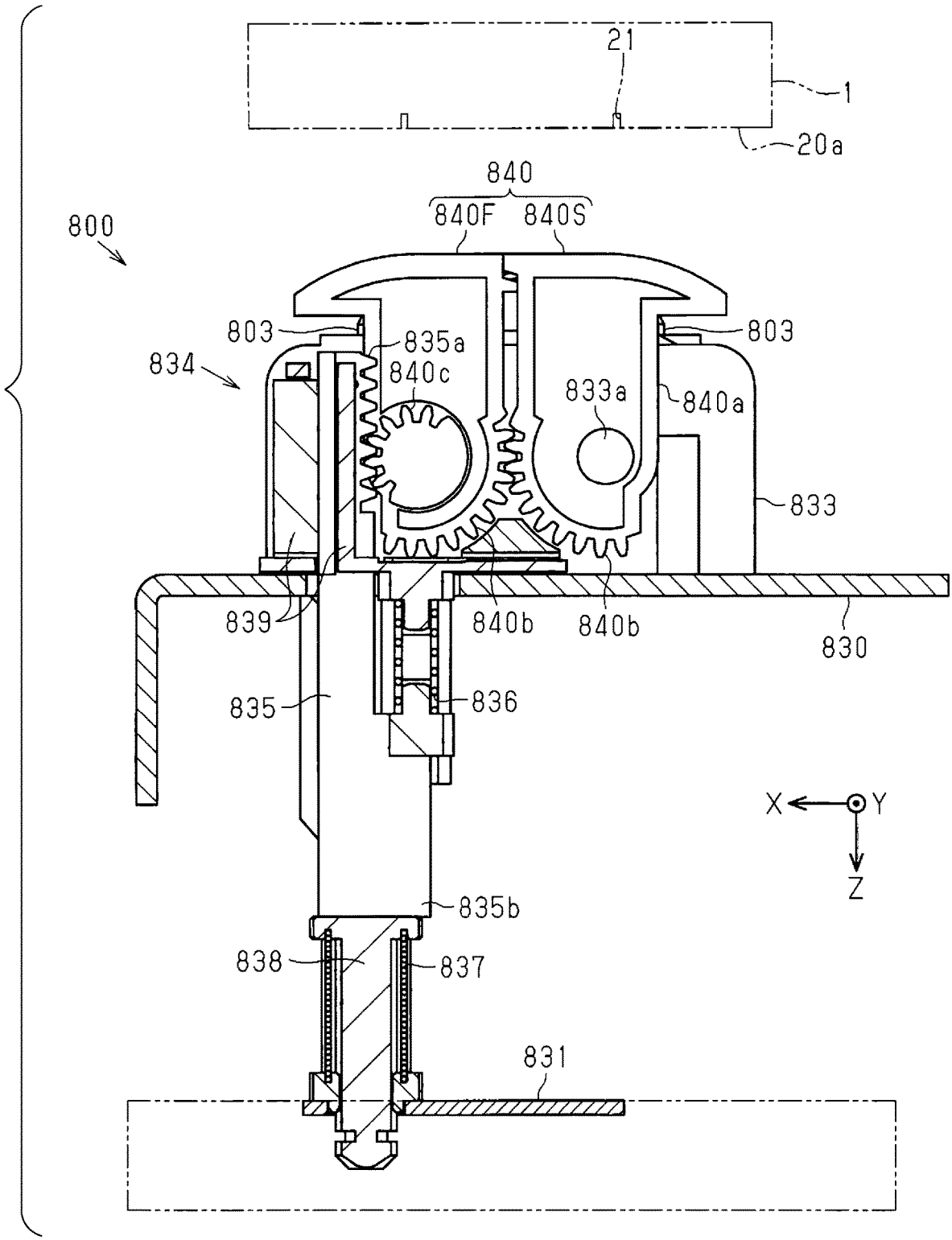
FIG. 25 is a cross-sectional view when the cap cover shown in FIG. 22 is at a cover position.

The position of the cap 803 when the cap 803 makes contact with the liquid ejecting head 1 to form the space CK (see FIG. 19) is referred to as a capping position (the position shown in FIG. 24), and the position where the cap 803 is distanced from the liquid ejecting head 1 is referred to as a separate position (the position shown in FIG. 25). The cap 803 moves from the separate position to the capping position as the cap holding portion 833 moves upward, and moves from the capping position to the separate position as the cap holding portion 833 moves downward. The cap holding portion 833 moves up and down as the support plate 830 moves up and down.

The cap cover 840 is disposed at a retracted position (the position shown in FIGS. 21 and 24) when the cap 803 is at the capping position, and is disposed at a cover position (the position shown in FIGS. 22 and 25) when the cap 803 is at the separate position. The cap cover 840 covers a recessed portion 851 at the cover position when the cap 803 is at the separate position distanced from the liquid ejecting head 1. The retracted position is a position at which the cap cover 840 is retracted from above the cap 803. The cap holding portion 833 supports the cap cover 840 so that the cap cover 840 is movable between the cover position and the retracted position.

When the cap holding portion 833 moves downward from the position shown in FIG. 24, the cap 803 moves from the capping position to the separate position, and the cap cover 840 moves from the retracted position to the cover position.

When the cap holding portion 833 moves upward from the position shown in FIG. 25, the cap 803 moves from the separate position to the capping position, and the cap cover 840 moves from the cover position to the retracted position.

As shown in FIG. 25, the opening/closing mechanism 834 includes a movable member 835 having a tooth portion 835*a* that meshes with the pinion 840*c*, a guide portion 839 that guides the movable member 835, a biasing member 836, an elastic member 837, and an engaging member 838. The guide portion 839 is fixed to the support plate 830. The elastic member 837 is disposed between the support base 831 and the engaging member 838. The engaging member 838 is supported on the support base 831 in a vertically movable manner via the elastic member 837. A lower end of the movable member 835 is provided with an engaging portion 835*b*, which is arranged at a position overlapping with the engaging member 838 in a plan view.

The support plate 830 supports the cap holding portion 833, and the support base 831 supports the cap holding portion 833 in a vertically movable manner via the support plate 830. While the cap holding portion 833 moving downward together with the support plate 830, the engaging member 838 engages with the engaging portion 835*b* of the movable member 835.

The movable member 835 has the tooth portion 835*a* meshed with the pinion 840*c* of the first cover 840F, and functions as a rack of a rack and pinion mechanism. When the pinion 840*c* of the first cover 840F is meshed with the upper portion of the tooth portion 835*a* as shown in FIG. 24, the cap cover 840 is present at the retracted position. When the pinion 840*c* of the first cover 840F is meshed with the lower portion of the tooth portion 835*a* as shown in FIG. 25, the cap cover 840 is present at the cover position.

The movable member 835 is held so as to be movable vertically with respect to the support plate 830 by the lateral movement thereof being restricted by the guide portion 839. When the support plate 830 moves downward, the movable member 835 moves downward together with the cap holding portion 833.

An upper end of the biasing member 836 is locked to the support plate 830, and a lower end thereof is locked to the movable member 835. The biasing member 836 is, for example, a coil spring, and biases the movable member 835 downward relative to the support plate 830. Thus, the biasing member 836 biases the cap cover 840 toward the retracted position shown in FIG. 24 via the movable member 835.

An upper end of the elastic member 837 is locked to the engaging member 838, and a lower end thereof is locked to the support base 831. The elastic member 837 is, for example, a coil spring and supports the engaging member 838 on the support base 831. In a case where both the biasing member 836 and the elastic member 837 are coil springs, when the members push each other, the biasing member 836 contracts earlier than the elastic member 837.

When the cap holding portion 833 and the movable member 835 move downward together with the support plate 830, the engaging portion 835*b* of the movable member 835 engages with the engaging member 838 during the downward movement. As a result, the movable member 835 moves relative to the cap holding portion 833 by receiving a reaction force from the engaging member 838. In other words, the cap holding portion 833 descends in a state in which the movement of the movable member 835 is restricted.

As described above, the movable member 835 moves relative to the cap holding portion 833 when engaged with the engaging member 838. When the movable member 835 moves upward relative to the support plate 830 from the position shown in FIG. 24, the cap cover 840 rotates together with the pinion 840*c*, and the cap cover 840 moves from the retracted position to the cover position. As described above, when the movable member 835 moves relatively to the cap holding portion 833, the stated member causes the cap cover 840 to move.

The elastic member 837 is elastically deformed when the force that the engaging member 838 receives from the movable member 835 becomes larger than a set value. This set value is larger than the biasing force of the biasing member 836. In a case where the opening/closing mechanism 834 does not include the elastic member 837, the biasing member 836 can be elastically deformed by causing the movable member 835 to make contact with the support base 831. Note that, however, in the case where the movement of the movable member 835 is restricted via the elastic member 837, even if there is a manufacturing error in the size and arrangement of the movable member 835 or the engaging member 838, the stated error can be eliminated by the elastic deformation of the elastic member 837, thereby making it possible to accurately move the cap cover 840.

When the cap holding portion 833 and the movable member 835 begin to move upward along with the support plate 830 from the positions shown in FIG. 25, the movable member 835 moves downward relative to the support plate 830. Then, the cap cover 840 rotates together with the pinion 840*c*, and moves from the cover position to the retracted position.

Figure 26:
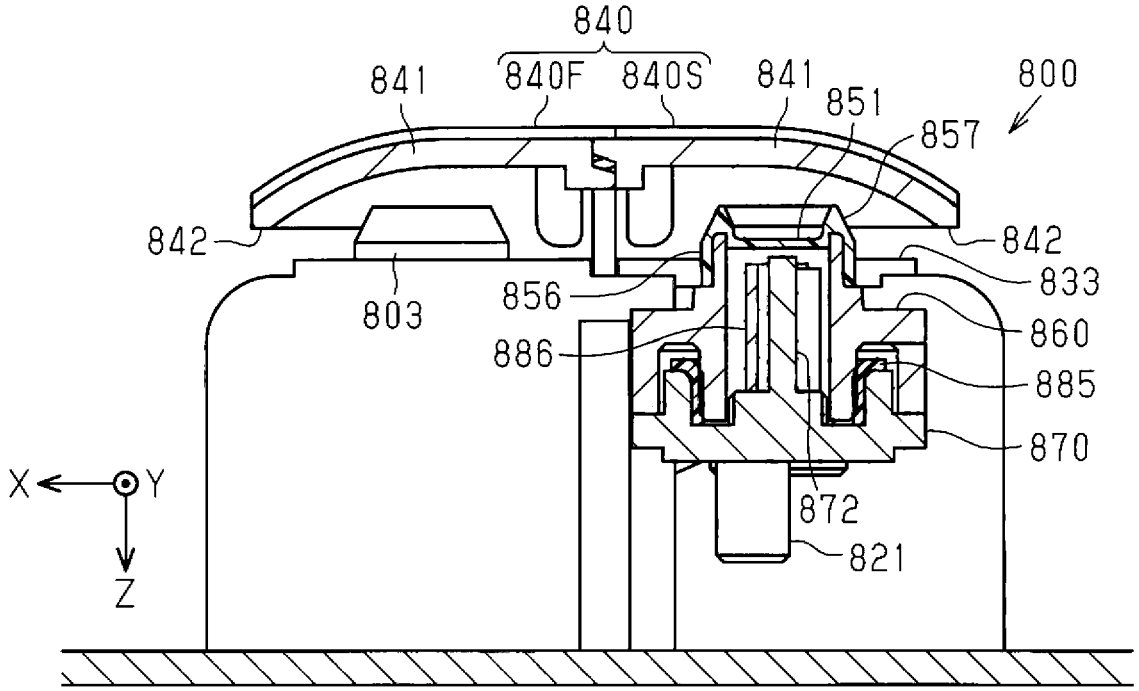
FIG. 26 is a cross-sectional view when the cap cover is at a cover position as seen from an arrow line XXVI-XXVI in FIG. 20.

As shown in FIG. 26, the cap cover 840 includes a cover portion 841 positioned above the recessed portion 851 when the cap cover 840 is at the cover position, and an enclosure portion 842 extending downward from the cover portion 841 in such a manner as to enclose an upper end of a contact portion 857 of the cap 803. As described above, it is preferable that the lower end of the cap cover 840 be positioned lower than the upper end of the cap cover 840.

The cap cover 840 at the cover position is disposed above the recessed portion 851 with a gap present between the cover portion 841 and the contact portion 857. The cover portions 841 included in the first cover 840F and the second cover 840S respectively are positioned above the recessed portion 851 and make contact with each other when being at the cover position.

In FIG. 26, although the lower end of the enclosure portion 842 is located above the upper end of the cap holding portion 833, the leading end of the enclosure portion 842 may be extended downward and the lower end of the enclosure portion 842 may be disposed below the upper end of the cap holding portion 833. When the cap cover 840 covers the cap 803 down to a lower position thereof, drying of the cap 803 is suppressed even if the cap cover 840 is separated from the cap 803.

In particular, in the case where water vapor lighter than air is used as the moisturizing fluid, water vapor having diffused from the moisturizing chamber 852 into the cap holding portion 833 moves upward from the gap between the cap holding portion 833 and the cap 803. When the water vapor is retained in the inner space of the cap cover 840 located above the lower end of the enclosure portion 842, the outer space of the cap 803 can also be moisturized. As a result, drying of the cap 803 can be effectively suppressed.

Figure 27:
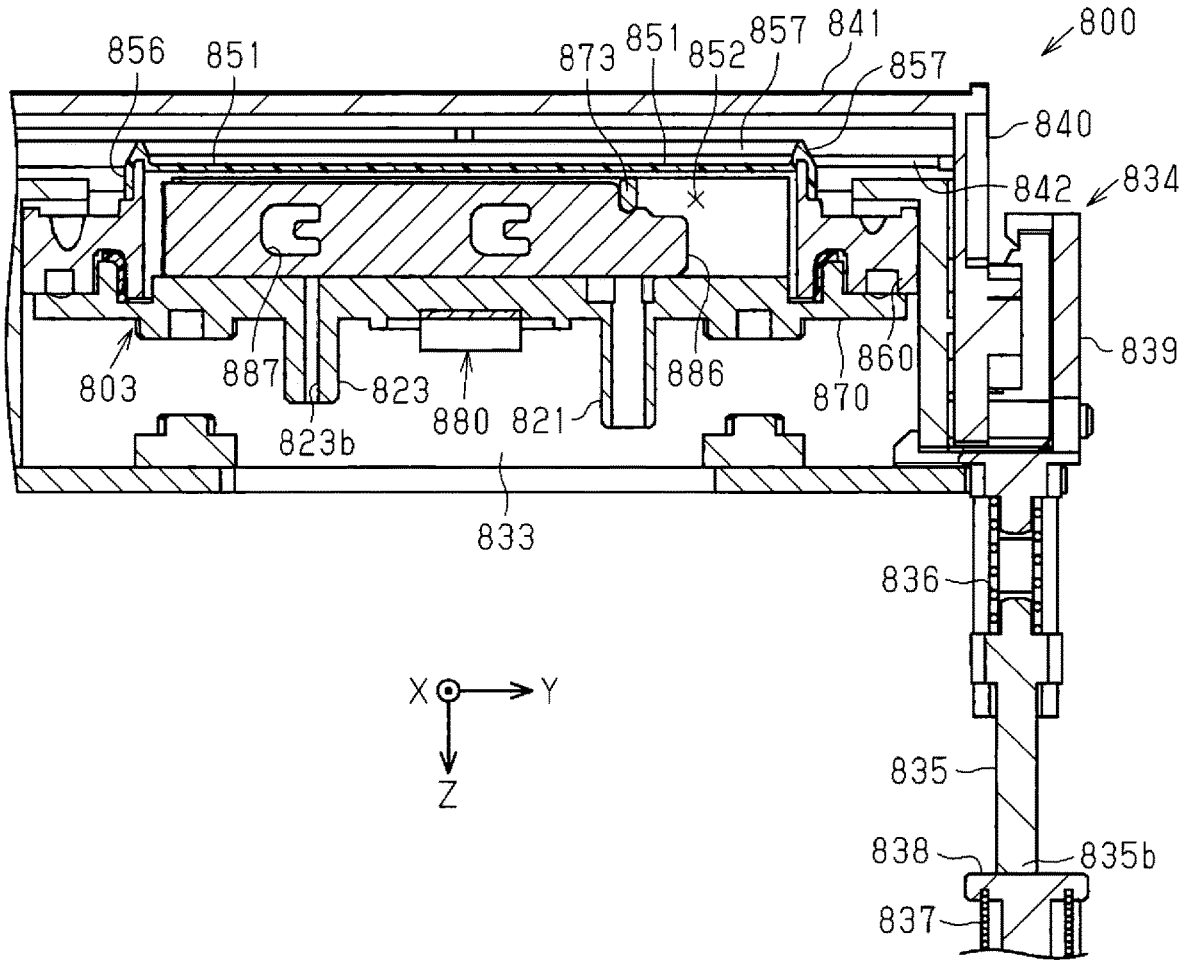
FIG. 27 is a cross-sectional view when the cap cover is at a cover position as seen from an arrow line XXVII-XXVII in FIG. 20.

As shown in FIG. 27, although the lower end of the cap cover 840 is positioned above an opening on the lower end side of an atmospheric communication portion 823, the leading end of the enclosure portion 842 may be extended downward and the lower end of the enclosure portion 842 may be disposed below the lower end of the atmospheric communication portion 823. Alternatively, as shown in FIG. 27, the lower end of the atmospheric communication portion 823 may be surrounded by the side wall of the cap holding portion 833. In this case, it is difficult for the moisturizing fluid to flow out from the moisturizing chamber 852 through the atmospheric communication portion 823.

In particular, in the case where water vapor lighter than air is used as the moisturizing fluid, when the water vapor having diffused from the moisturizing chamber 852 to the external space stays in the inner space of the cap holding portion 833 located higher than the lower end of the side wall of the cap holding portion 833, the space including the lower end of the atmospheric communication portion 823 can also be moisturized. Therefore, it is difficult for the moisturizing fluid to diffuse from the moisturizing chamber 852 through the atmospheric communication portion 823.

Next, operations of the cap device 800 and the liquid ejecting apparatus 700 of the present embodiment will be described.

When the cap 803 for moisture retention is distanced from the liquid ejecting head 1, the recessed portion 851 opens facing upward. Therefore, foreign matter such as liquid droplets or dust may enter into the recessed portion 851 or adhere to the contact portion 857. As described above, when the foreign matter is attached to the cap 803, a gap may be formed between the cap 803 and the liquid ejecting head 1 at the time of capping so that the nozzle 21 may not be properly moisturized in some case.

In the case where the moisture retention becomes insufficient and the nozzle 21 is dried, the nozzle 21 is clogged so that an ejection failure occurs, cleaning to resolve the ejection failure is performed so that a consumption amount of liquid is increased, or the like. As for this point, when the cap 803 is covered with the cap cover 840 when the cap 803 is distanced from the liquid ejecting head 1, adhesion of foreign matter to the cap 803 is suppressed.

According to the cap device 800 and the liquid ejecting apparatus 700 of the present embodiment, the following effects can be obtained.

(2-1) When the cap 803 is distanced from the liquid ejecting head 1, the cap cover 840 covers the recessed portion 851 of the cap 803 so that foreign matter is unlikely to adhere to the cap 803. Accordingly, when the cap 803 contacts the liquid ejecting head 1, the nozzle 21 can be efficiently moisturized.

(2-2) When the cap cover 840 makes contact with the cap 803, foreign matter attached to the cap 803 may adhere to the cap cover 840 in some case. When the foreign matter adheres to the cap cover 840, the stated foreign matter may adhere again to the cap 803 and may contaminate the cap 803 in some case. According to the above embodiment, since the cap cover 840 covers the cap 803 without contacting the cap 803, it is difficult for foreign matter attached to the cap 803 to be attached to the cap cover 840. Therefore, foreign matter attached to the cap cover 840 is unlikely to adhere again to the cap 803.

(2-3) By the moisturizing fluid supplied from the supply mechanism 804, the space CK to which the nozzle 21 is opened can be moisturized. Thus, drying of the nozzle 21 can be suppressed.

(2-4) The cap cover 840 can suppress foreign matter entering into the recessed portion 851 by the cover portion 841, and can also suppress the diffusion of moisture retention components from the inside of the recessed portion 851 by the enclosure portion 842.

(2-5) Since the cap holding portion 833 holds the cap 803 and the cap cover 840, the cap cover 840 can be moved together with the cap 803.

(2-6) The cap cover 840 can be stably disposed at the retracted position by the biasing force of the biasing member 836.

(2-7) When the cap 803 is moved from the capping position to the separate position in conjunction with the downward movement of the cap holding portion 833, the cap cover 840 can be moved from the retracted position to the cover position. Thus, after the capping is released, the cap cover 840 can quickly cover the cap 803.

(2-8) The movable member 835 moves the cap cover 840 by receiving the biasing force of the elastic member 837 via the engaging member 838. Therefore, even when there is a manufacturing error in the size and arrangement of the movable member 835 or the engaging member 838, the error can be eliminated by the elastic deformation of the elastic member 837 and the cap cover 840 can be accurately moved.

(2-9) Since the cap cover 840 rotates about the rotation shaft 833*a* intersecting with the reciprocation path of the liquid ejecting head 1, even if the cap cover 840 makes contact with the liquid ejecting head 1, the cap cover 840 easily moves to the retracted position. Because of this, damage to the cap cover 840 and the liquid ejecting head 1 due to the contact can be reduced.

(2-10) Since the cap cover 840 has a structure in which the cap cover 840 is divided into the first cover 840F and the second cover 840S, the distance of movement of the cap cover 840 can be shortened.

Modifications

The above embodiments may be modified as described below. The configurations included in the above embodiments can be arbitrarily combined with the configurations included in the following modifications. The configurations included in the following modifications can be arbitrarily combined.

Figure 28:
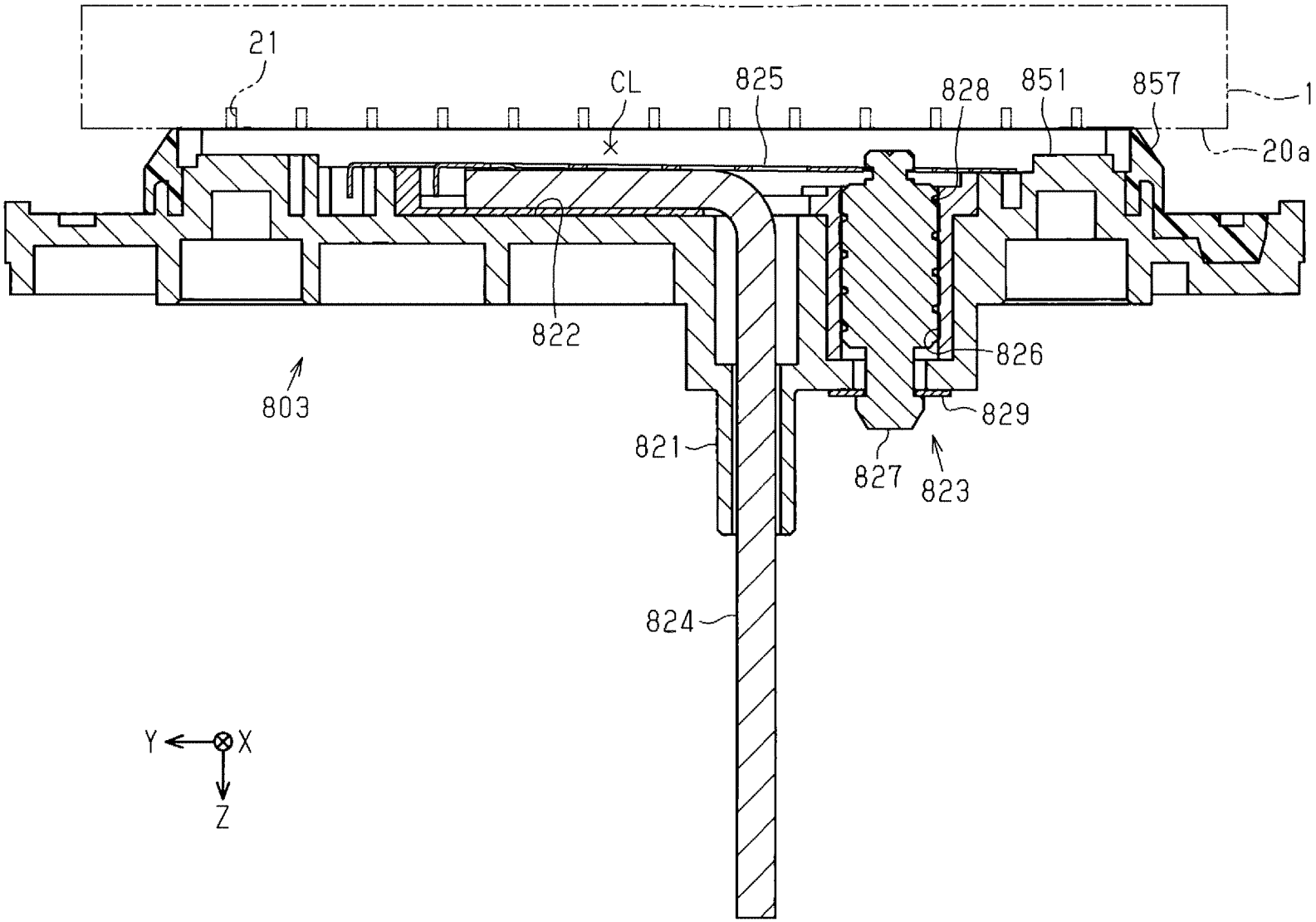
FIG. 28 is a perspective view illustrating a first modification on a cap device.
Figure 29:
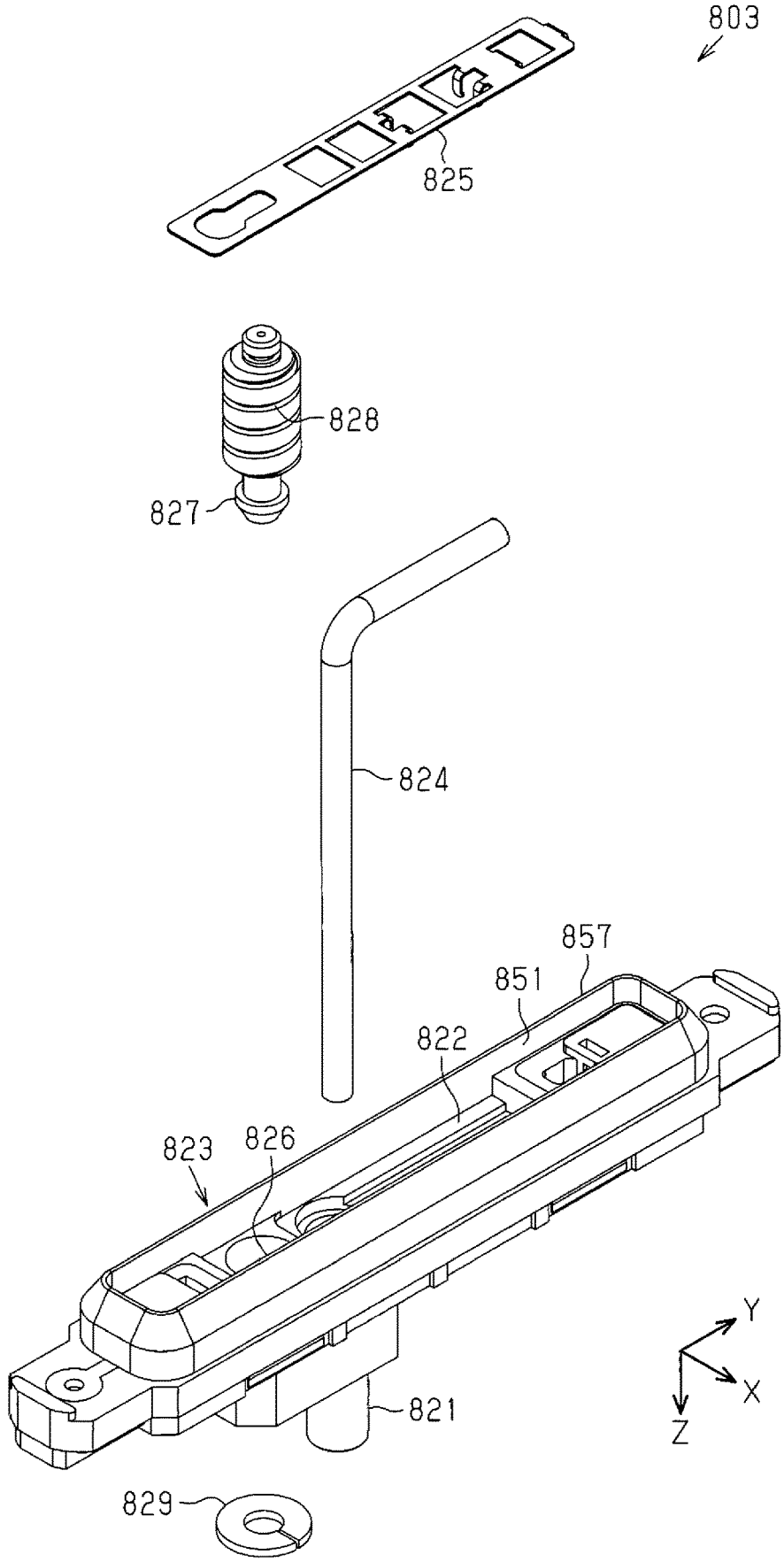
FIG. 29 is an exploded perspective view of the cap device shown in FIG. 28.

A cap 803 of a first modification shown in FIGS. 28 and 29 may be provided in the cap device 800. The cap cover 840 can cover the cap 803 of the first modification. The cap 803 of the first modification does not include a partition wall 853 and a moisturizing chamber 852, but includes an inner bottom surface 822 of the cap 803 that opposes the nozzle 21 at the time of moisture retention capping, an introduction portion 821 that opens to the inner bottom surface 822, and an atmospheric communication portion 823. The inner bottom surface 822 and a contact portion 857 form a recessed portion 851. The downstream end of the connection flow path 808 (see FIG. 14) is connected to the introduction portion 821. The atmospheric communication portion 823 is provided in the inner bottom surface 822 of the cap 803, and opens the space CK, formed by the moisture retention capping, to the atmosphere.

A capillary member 824 may be bent on the inner bottom surface 822 of the cap 803 toward a side opposite to the side where the atmospheric communication portion 823 is provided. In this case, it is preferable that a plate member 825 for pressing the capillary member 824 from above be disposed along the inner bottom surface 822 in the cap 803. When the capillary member 824 is pressed by the plate member 825, the capillary member 824 can be set along the inner bottom surface 822 of the cap 803.

It is sufficient that the atmospheric communication portion 823 is configured of a through-hole 826 passing through the inner bottom surface 822 and a pin 827 press-fitted into the through-hole 826. It is sufficient that a helically extending narrow groove 828 is formed on the outer periphery of the pin 827.

As shown in FIG. 29, when a helical gap (groove 828) is formed between the inner peripheral surface of the through-hole 826 and the outer peripheral surface of the pin 827, a space CL (see FIG. 28) can be made to communicate with the atmosphere through this gap. It is sufficient that the leading end of the pin 827 located on the inner bottom surface 822 is pressed by the plate member 825. Further, it is sufficient that the base end of the pin 327 is fastened by a washer 829. The atmospheric communication portion 823 opens the space CL (see FIG. 28) of the cap 803 to the atmosphere while suppressing a situation that the moisturizing liquid having been evaporated in the space CK goes out of the space CL at the time of moisture retention capping.

Figure 30:
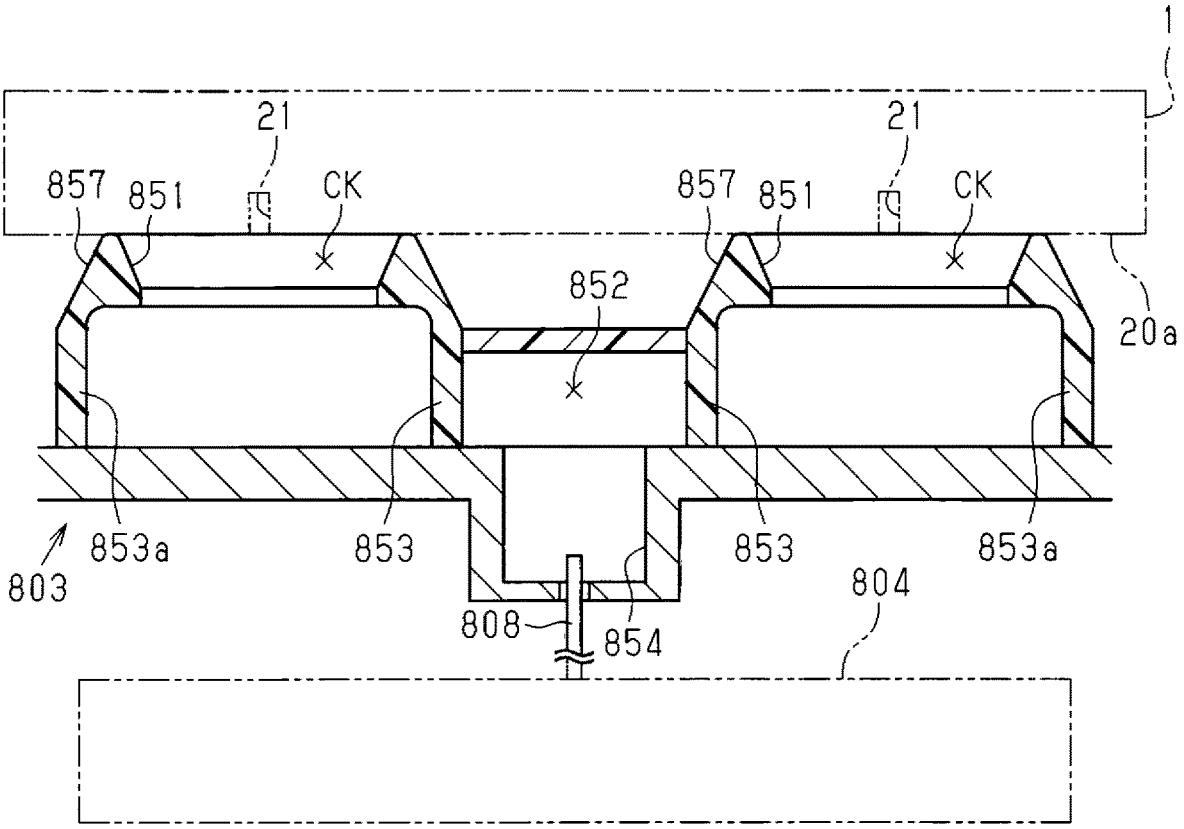
FIG. 30 is a cross-sectional view illustrating a second modification on a cap device.

As in a second modification shown in FIG. 30, a partition wall 853 may be provided on a side wall of a recessed portion 851. In this case, the recessed portion 851 and a moisturizing chamber 852 may be arranged side by side.

As in the second modification shown in FIG. 30, in a cap 803, the partition wall 853 and a flexible portion 853*a*, which transmit gas, may be provided in different portions. In this case, gas permeability of the partition wall 853 may be higher than that of other portions.

In the case where the partition wall 853 and the flexible portion 853*a* are provided in different portions, a pressure damper chamber (not shown) connected from the side wall of the recessed portion 851 with a communication pipe (not shown) may be provided, and the stated pressure damper chamber may be taken as the flexible portion 853*a*, for example. In this case, gas permeability of the pressure damper chamber may be low, and flexibility of the partition wall 853 having gas permeability may be low.

The cap device 800 may be provided with an open/close valve capable of blocking the communication with the atmosphere done by the atmospheric communication portion 823 connected to the moisturizing chamber 852, when the cap 803 is not performing the capping.

As in the second modification shown in FIG. 30, a storage section 854 for storing a moisturizing liquid may be provided under the moisturizing chamber 852 of the cap 803.

A supply mechanism 804 may supply the moisturizing liquid so that the liquid level of the moisturizing liquid stored in the storage section 854 is lower than an atmospheric communication portion 823 of the moisturizing chamber 852.

In a case where the partition wall 853 is integrally formed with a contact portion 857, a lip body 856 can be made of an elastomer resin, for example.

The partition wall 853 may be formed separately from the contact portion 857. In this case, it is sufficient that the partition wall 853 is made of, for example, an elastic material such as silicone rubber, and is provided as a wall (a ceiling portion or the like) of the moisturizing chamber 852. Silicone rubber is suitable for use as a material of the partition wall 853 because of its high gas permeability (particularly, water vapor permeability) and liquid repellency. In this case, the partition wall 853 may be in a mode in which the partition wall 853 covers a rigid member constituting a side wall of the moisturizing chamber 852 in a detachable manner.

A configuration may be adopted in which the plurality of caps 803 are individually movable vertically so that the liquid level of the moisturizing liquid is displaced between the first position h1 and a second position h2. According to this configuration, the position of each of the caps 803 relative to the moisturizing liquid storage section 805 can be changed.

In the second embodiment, the eight liquid ejecting heads 1 held by the cap device 800 and the carriage 723 may be disposed being rotated by 180 degrees taking the Z-axis in FIG. 20 as a rotation axis. In this case, of the eight liquid ejecting heads 1, the liquid ejecting head 1 located at a position most distanced from the home position HP ejects a processing liquid (curing agent) for promoting the curing of ink, and the remaining seven liquid ejecting heads 1 eject ink. The liquid ejecting head 1 for ejecting the processing liquid is disposed at a position shifted upstream of the other liquid ejecting head 1 in the transport direction.

The cap device 800 may be configured such that, when the position of the liquid level of the moisturizing liquid stored in the moisturizing liquid storage section 805 is displaced between the first position h1 and the second position h2, the moisturizing liquid is not supplied from the moisturizing liquid container 806 to the moisturizing liquid storage section 805. It is possible to displace the liquid level of the moisturizing liquid merely by changing a positional relationship between the cap 803 and the moisturizing liquid storage section 805 in the vertical direction.

The moisturizing liquid storage section 805 may be configured to be movable vertically relative to the cap 803.

In place of the float valve 815, an electromagnetic valve for opening or closing the supply flow path 807 may be provided. In this case, the electromagnetic valve may be opened or closed so that the liquid level of the moisturizing liquid stored in the moisturizing liquid storage section 805 comes to the first position h1.

The cap device 800 may be additionally provided with a control section. In this case, the driving of the moisturizing motor 811 and the pump 812 of the cap device 800 is controlled by the control section included in the cap device 800.

The capillary member 824 may be provided in the connection flow path 808 over the entire length thereof.

The capillary member 824 may not be a cylindrical member as long as it can be disposed in the connection flow path 808. For example, a band-shaped member having a polygonal cross section or a circular tube-like member may be used.

The supply mechanism 804 may supply the moisturizing liquid from the moisturizing liquid container 806 to the moisturizing liquid storage section 805 only by the water head difference.

The supply mechanism 804 may be configured to supply the moisturizing liquid from the moisturizing liquid container 806 toward the moisturizing liquid storage section 805 only by the pressure of the pump 812. In this case, since it is not necessary to consider the water head difference between the moisturizing liquid storage section 805 and the moisturizing liquid container 806, the degree of freedom in disposing the moisturizing liquid container 806 increases. In this modification, the driving of the pump 812 is controlled so that the liquid level of the moisturizing liquid stored in the moisturizing liquid storage section 805 comes to the first position h1.

The inlet 805*a* may be formed to be open to the inner wall of the moisturizing liquid storage section 805.

The atmospheric communication portion 823 may be provided in a side wall portion of the cap 803. According to this modification, it is difficult for the moisturizing liquid to reach the atmospheric communication portion 823.

A plurality of supply mechanisms 804 may be provided for each cap 803.

An open/close valve capable of opening and closing the connection flow path 808 may be provided at a midway position in the connection flow path 808. According to this modification, by closing the open/close valve, such as when carrying the cap device 800, it is possible to reduce a possibility that the moisturizing liquid spills out through the cap 803 due to an impact or the like.

The cap 803 may be provided so that all of the nozzles 21 of the liquid ejecting head 1 can be collectively capped.

The cap mechanism 752 may include another cap cover 840 configured to cover the suction caps 770.

A wiper for wiping the liquid ejecting head 1 may be additionally provided between the cap device 800 in the maintenance region LA and the ejection region PA.

The supply mechanism 804 may supply steam as a moisturizing fluid into the cap 803.

When the cap 803 is performing the capping, steam as a moisturizing fluid may be supplied to the moisturizing chamber 852 to pressurize the inside of the space CK. In this case, it is preferable to apply pressure to such an extent that the gas-liquid interface formed in the nozzle 21 is not broken.

The liquid ejecting apparatus 700 may be replaced with a so-called full-line type liquid ejecting apparatus which does not include a carriage 723 and has an elongated liquid ejecting head 1 corresponding to the entire width of the medium ST.

The liquid that is ejected from the liquid ejecting head 1 is not limited to ink, and may be, for example, a liquid body obtained by dispersing or mixing particles of a functional material in a liquid. For example, recording may be performed by ejecting such a liquid body that contains a material such as an electrode material or a coloring material (pixel material) used in the manufacture of a liquid crystal display, an EL (electroluminescence) display and a surface emitting display, or the like, in the form of dispersion or dissolution.

The medium ST is not limited to paper, and may be a plastic film, a thin plate, a cloth used in a printing apparatus, or the like. The medium ST may be a garment of any shape such as a T-shirt, or a three-dimensional object of any shape such as tableware or stationery.

Ink Ejected by Liquid Ejecting Head

Ink as a liquid ejected by the liquid ejecting apparatus 700 contains resin in its composition, and is substantially free from glycerin whose boiling point is 290° C. under 1 atm. In a case where ink substantially contains glycerin, drying characteristics of the ink are significantly degraded. As a result, in various media, in particular, in an ink non-absorbable or poorly-absorbable medium, not only unevenness of image density stands out but also fixing characteristics of the ink cannot be obtained. Furthermore, it is preferable that ink be substantially free from alkyl-polyols having a boiling point of equal to or higher than 280° C. under an atmospheric pressure equivalent to 1 atm (excluding the above-mentioned glycerin).

In this specification, the term "substantially free from" means not to contain a material in an amount equal to or more than the amount capable of sufficiently exhibiting the meaning of material addition. Quantitatively speaking, it is preferable for the content of glycerin to be less than 1.0 mass %, more preferable to be less than 0.5 mass %, still more preferable to be less than 0.1 mass %, still more preferable to be less than 0.05 mass %, and particularly preferably to be less than 0.01 mass %, with respect to the total mass of the inks (100 mass %). It is most preferable that the content of glycerin be less than 0.001 mass %.

Next, additives (ingredients) that are contained or can be contained in the ink will be described.

1. Coloring Material

Ink may contain a coloring material. The coloring material is selected from pigments and dyes.

1-1. Pigment

By using a pigment as a coloring material, light resistance of ink can be improved. Any of inorganic pigments and organic pigments can be used as the pigment. Although not specifically limited, examples of inorganic pigments include carbon black, iron oxide, titanium oxide, and silica oxide.

Although not specifically limited, examples of organic pigments include quinacridone-based pigments, quinacridone quinone-based pigments, dioxazine-based pigments, phthalocyanine-based pigments, anthrapyrimidine-based pigments, anthanthrone-based pigments, indanthrone-based pigments, flavanthrone-based pigments, perylene-based pigments, diketopyrrolopyrrole-based pigments, perinone-based pigments, quinophthalone-based pigments, anthraquinone-based pigments, thioindigo-based pigments, benzimidazolone-based pigments, isoindolinone-based pigments, azomethine-based pigments, and azo-based pigments. As specific examples of organic pigments, the following can be cited.

As pigments used in cyan ink, C.I. Pigment Blue 1, 2, 3, 15, 15:1, 15:2, 15:3, 15:4, 15:6, 15:34, 16, 18, 22, 60, 65, 66, and C.I. Vat Blue 4, 60 are given. Among these, any one of C.I. Pigment Blue 15:3 and 15:4 is preferable.

As pigments used in magenta ink, C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, 264, and C.I. Pigment Violet 19, 23, 32, 33, 36, 38, 43, 50 can be cited. Among them, at least one type selected from the group consisting of C.I. Pigment Red 122, C.I. Pigment Red 202, and C.I. Pigment Violet 19 is preferable.

As pigments used in yellow ink, C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, 213 can be cited. Among them, at least one type selected from the group consisting of C.I. Pigment Yellow 74, 155, and 213 is preferable.

As pigments used in color inks other than those described above, such as green ink and orange ink, known pigments can be cited.

The average particle diameter of the pigments is preferably no more than 250 nm because clogging in the nozzle 21 can be suppressed and the ejection stability is further improved. Note that the average particle diameter in this specification takes a volume-based value. Regarding a measurement method for particle size distribution, for example, a particle size distribution measuring apparatus using a laser diffraction-scattering method as a measurement principle can measure the particle size distribution. As the particle size distribution measuring apparatus, for example, a particle size distribution meter using a dynamic light-scattering method as a measurement principle (for example, Microtrac UPA, manufactured by Nikkiso Co., Ltd.) can be cited.

1-2. Dye

As a coloring material, dye can be used. The dye is not limited to any specific one, and an acidic dye, a direct dye, a reactive dye, and a basic dye can be used. It is preferable for the content of the coloring material to be 0.4 to 12 mass %, and more preferable to be no less than 2 mass % and no more than 5 mass %, with respect to the total mass of ink (100 mass %).

2. Resin

Ink contains a resin. By the ink containing a resin, a resin film is formed on a medium, and as a result, the ink is sufficiently fixed on the medium so that an effect of improving abrasion resistance of the image is mainly exhibited. Therefore, it is preferable for a resin emulsion to be a thermoplastic resin. It is preferable for the heat distortion temperature of a resin to be no less than 40° C., and more preferable to be no less than 60° C. because it is possible to obtain an advantageous effect that the clogging of the nozzle 21 is unlikely to occur and the medium can have abrasion resistance.

Here, "heat distortion temperature" in this specification is a temperature value expressed in a glass transition temperature (Tg) or a minimum film forming temperature (MFT). In other words, "the heat distortion temperature is no less than 40° C." means that it is sufficient for any one of Tg and MFT to be no less than 40° C. It is easier to understand the redispersibility of a resin by the MFT than the Tg, and therefore it is preferable that the heat distortion temperature be a temperature value expressed in the MFT. In the case where the ink has excellent redispersibility of the resin, since the ink does not stick to the nozzle 21, the nozzle 21 is unlikely to be clogged.

Although not specifically limited, the following can be cited as specific examples of the above-mentioned thermoplastic resin: polyacrylic (methacrylic) acid ester or a copolymer thereof; polyacrylonitrile or a copolymer thereof; a (meth)acrylic polymer such as poly-cyanoacrylate, polyacrylamide, and polyacrylic (methacrylic) acid; polyethylene, polypropylene, polybutene, polyisobutylene, polystyrene, and a copolymer thereof; a polyolefin polymer such as petroleum resin, coumarone-indene resin, and terpene resin; polyvinyl acetate or a copolymer thereof; a vinyl acetate or vinyl alcohol polymer such as polyvinyl alcohol, polyvinyl acetal, and polyvinyl ether; polyvinyl chloride or a copolymer thereof; a halogen containing polymer such as polyvinylidene chloride, fluororesin, and fluororubber; polyvinyl carbazole, polyvinyl-pyrrolidone, or a copolymer thereof; a nitrogen containing vinyl polymer such as polyvinyl-pyridine and polyvinyl-imidazole; polybutadiene or a copolymer thereof; a diene polymer such as polychloroprene and polyisoprene (butyl rubber); and other ring-opening polymerization resins, condensation polymerization resins, and natural polymer resins.

It is preferable for the content of the resin to be 1 to 30 mass %, and more preferable to be 1 to 5 mass % with respect to the total mass of the ink (100 mass %). In the case where the content falls within the above range, it is possible to further enhance excellence in glossiness and abrasion resistance of the overcoat image to be formed. Examples of the resin allowed to be contained in the ink include a resin dispersant, a resin emulsion, and wax, for example.

2-1. Resin Emulsion

Ink may contain a resin emulsion. When a medium is heated, the resin emulsion preferably forms a resin film along with wax (emulsion), thereby sufficiently fixing the ink on the medium and exhibiting an effect of improving the abrasion resistance of the image. Due to the above effect, in the case where printing is performed on a medium using ink containing a resin emulsion, the ink is particularly excellent in abrasion resistance on an ink non-absorbable or poorly-absorbable medium.

Further, a resin emulsion which functions as a binder is contained in an emulsion state in ink. By containing a resin which functions as a binder in the ink in the emulsion state, it is possible to easily adjust the viscosity of the ink within an appropriate range in an ink jet recording system and to enhance storage stability and ejection stability of the ink.

Examples of the resin emulsion include, but not limited to, a homopolymer or copolymer of (meth) acrylic acid, (meth) acrylic acid ester, acrylonitrile, cyanoacrylate, acrylamide, olefin, styrene, vinyl acetate, vinyl chloride, vinyl alcohol, vinyl ether, vinylpyrrolidone, vinylpyridine, vinylcarbazole, vinylimidazole and vinylidene chloride, fluororesin, and natural resin. Among them, any one of methacrylic resin and styrene-methacrylic acid copolymer resin is preferred, any one of acrylic resin and styrene-acrylic acid copolymer resin is more preferred, and styrene-acrylic acid copolymer resin is further more preferred. Note that the above-mentioned copolymer may be any one of a random copolymer, a block copolymer, an alternating copolymer, and a graft copolymer.

It is preferable for the average particle size of the resin emulsion to be in a range of 5 nm to 400 nm, and more preferable to be in a range of 20 nm to 300 nm, in order to further improve the storage stability and ejection stability of the ink. Also in the resin, it is preferable for the content of the resin emulsion to fall within a range of 0.5 to 7 mass % with respect to the total mass of ink (100 mass %). In the case where the content falls within the above range, it is possible to decrease the concentration of the solid content so that it is possible to further improve the ejection stability.

2-2. Wax

Ink may contain wax. By the ink containing wax, it is possible to enhance the fixing property of the ink on an ink non-absorbable medium and an ink poorly-absorbable medium. Among the wax, an emulsion type of wax is more preferable. Examples of the wax include, but not limited to, polyethylene wax, paraffin wax, and polyolefin wax, and among them, polyethylene wax to be described later is preferable. In this specification, the term "wax" mainly means a material in which solid wax particles are dispersed in water using a surfactant to be described later.

By the ink containing polyethylene wax, it is possible to improve the abrasion resistance of the ink. It is preferable for the average particle size of the polyethylene wax to be in a range of 5 nm to 400 nm, and more preferable to be in a range of 50 nm to 200 nm, in order to further improve the storage stability and ejection stability of the ink.

It is preferable for the content (in terms of solid content) of the polyethylene wax to be in a range of 0.1 to 3 mass %, more preferable to be in a range of 0.3 to 3 mass %, and still more preferable to be in a range of 0.3 to 1.5 mass %, with respect to the total mass of the ink (100 mass %), independently of each other. In the case where the content falls within the above range, the ink can be satisfactorily solidified or fixed even on an ink non-absorbable medium or an ink poorly-absorbable medium, and the storage stability and ejection stability of the ink can be further improved.

3. Surfactant

Ink may contain a surfactant. An example of the surfactant includes, but not limited to, a nonionic surfactant. A nonionic surfactant has action of uniformly spreading ink on a medium. Therefore, when printing is performed using ink containing a nonionic surfactant, a high-definition image with little bleeding can be obtained. Examples of such nonionic surfactants include, but not limited to, surfactants based on silicone, polyoxyethylene alkyl ether, polyoxypropylene alkyl ether, polycyclic phenyl ether, sorbitan derivatives, and fluorine. Among them, a silicone-based surfactant is preferable.

It is preferable for the content of the surfactant to be within a range from 0.1 mass % to 3 mass % with respect to the total mass of the ink (100 mass %), so as to further improve the storage stability and ejection stability of the ink.

4. Organic Solvent

Ink may contain a known volatile water-soluble organic solvent. However, as described above, it is preferable that ink be substantially free from glycerin (boiling point is 290° C. under 1 atm), which is a kind of organic solvent, and also be substantially free from alkyl-polyols (excluding the above-mentioned glycerin) whose boiling point is equal to or higher than 280° C. under an atmospheric pressure equivalent to 1 atm.

5. Aprotic Polar Solvent

Ink may contain an aprotic polar solvent. By containing an aprotic polar solvent in the ink, the above-discussed resin particles contained in the ink dissolve so that the clogging of the nozzle 21 can be effectively suppressed during printing. In addition, since the stated solvent has characteristics that dissolve a medium such as vinyl chloride, adhesiveness of the image is enhanced.

Although not specifically limited, it is preferable for the aprotic polar solvent to contain at least one type selected from pyrrolidones, lactones, sulfoxides, imidazolidinones, sulfolanes, urea derivatives, dialkylamides, cyclic ethers, and amide ethers. Representative examples of pyrrolidones include 2-pyrrolidone, N-methyl-2-pyrrolidone, and N-ethyl-2-pyrrolidone; representative examples of lactones include γ-butyrolactone, γ-valerolactone, and ε-caprolactone; and representative examples of sulfoxides include dimethylsulfoxide and tetramethylene sulfoxide.

Representative examples of imidazolidinones include 1, 3-dimethyl-2-imidazolidinone; representative examples of sulfolanes include sulfolane and dimethylsulfolane; and representative examples of urea derivatives include dimethylurea and 1, 1, 3, 3-tetramethylurea. Representative examples of dialkylamides include dimethylformamide and dimethylacetamide, and representative examples of cyclic ethers include 1, 4-dioxane and tetrahydrofuran.

Of these, pyrrolidones, lactones, sulfoxides, and amide ethers are particularly preferred, and 2-pyrrolidone is most preferred, from the viewpoint of the above-mentioned effects. It is preferable for the content of the above-mentioned aprotic polar solvent to be in a range of 3 to 30 mass %, and more preferable to be in a range of 8 to 20 mass %, with respect to the total mass of the ink (100 mass %).

6. Other Ingredients

In addition to the above ingredients, ink may further contain a fungicide, a rust inhibitor, a chelating agent, and the like.

Next, ingredients of a surfactant to be mixed in a moisturizing liquid will be described.

Examples of the surfactant include: cationic surfactants such as alkylamine salts and quaternary ammonium salts; anionic surfactants such as dialkylsulfosuccinic acid salts, alkylnaphthalenesulfonates, and fatty acid salts; amphoteric surfactants such as alkyl dimethyl amine oxide and alkyl carboxy betaine; and nonionic surfactants such as polyoxyethylene alkyl ethers, polyoxyethylene alkyl allyl ethers, acetylene glycols, and polyoxyethylene polyoxypropylene block copolymers. Among these, an anionic surfactant or a nonionic surfactant is particularly preferred.

It is preferable for the content of the surfactant to be 0.1 to 5.0 mass % with respect to the total mass of the moisturizing liquid. Further, from the viewpoint of foamability and de-foamability after foaming, it is preferable for the content of the surfactant to be 0.5 to 1.5 mass % with respect to the total mass of the moisturizing liquid. There may be only one type of surfactant, or two or more types of surfactants for use. In addition, it is preferable that the surfactant contained in the moisturizing liquid be the same as the surfactant contained in the ink (liquid). In the case where the surfactant contained in the ink (liquid) is a nonionic surfactant, examples of the surfactant include, but not limited to, surfactants based on silicone, polyoxyethylene alkyl ether, polyoxypropylene alkyl ether, polycyclic phenyl ether, sorbitan derivatives, and fluorine. Among these, a silicone-based surfactant is preferable.

In particular, in order to cause the height of foam immediately after the foaming by using the Ross-Miles method and the height thereof after five minutes have passed since the above foaming to fall within the above range (the foam height immediately after the foaming is no less than 50 mm and the foam height after five minutes having passed since the foaming is no more than 5 mm), it is preferable to use an adduct in which ethylene oxide (EO) is added, to acetylene diol, in an addition mole number of 4 to 30 as a surfactant, and to make the content of the adduct be 0.1 to 3.0 wt. % with respect to the total weight of the cleaning liquid. Further, in order to cause the foam height immediately after the foaming by using the Ross-Miles method and the foam height after five minutes have passed since the above foaming to fall within the above-mentioned preferred range (the foam height immediately after the foaming is no less than 100 mm and the foam height after five minutes having passed since the foaming is no more than 5 mm), it is preferable to use an adduct in which ethylene oxide (EO) is added, to acetylene diol, in an addition mole number of 10 to 20, and to make the content of the adduct be 0.5 to 1.5 wt. % with respect to the total weight of the cleaning liquid. However, if the content of the ethylene oxide adduct in the acetylene diol is excessively large, there is a risk of reaching critical micelle concentration to bring about an emulsion state.

The surfactant has a function of facilitating wetting and spreading of an aqueous ink on a recording medium. There is no particular limitation on the surfactant that can be used in the aspects of the invention, and the following can be used: anionic surfactants such as dialkylsulfosuccinic acid salts, alkylnaphthalenesulfonates, and fatty acid salts; nonionic surfactants such as polyoxyethylene alkyl ethers, polyoxyethylene alkyl allyl ethers, acetylene glycols, and polyoxyethylene polyoxypropylene block copolymers; cationic surfactants such as alkylamine salts and quaternary ammonium salts; silicone-based surfactants; fluorine-based surfactants; and the like.

In addition, the surfactant has an effect of finely dividing and dispersing an aggregate by the surfactant effect between the moisturizing liquid and the aggregate. Further, since the surfactant has a function of lowering the surface tension of the cleaning liquid, the cleaning liquid can easily enter the gap between the aggregate and the nozzle surface 20*a*, so that there is an effect that the aggregate can be easily separated from the nozzle surface 20*a*.

Any of the surfactants can be preferably used as long as the surfactant is a compound including a hydrophilic portion and a hydrophobic portion in the same molecule. As specific examples, those represented by the following formulas (I) to (IV) are preferable. That is, polyoxyethylene alkyl phenyl ether-based surfactants of formula (I), acetylene glycol-based surfactants of formula (II), polyoxyethylene alkyl ether-based surfactants of formula (III), and polyoxyethylene polyoxypropylene alkyl ether-based surfactants of formula (IV) can be cited.

(I)

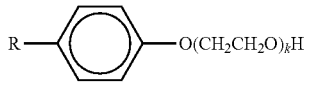

(R is a hydrocarbon chain with a carbon number of 6 to 14 which may be branched, k: 5 to 20)

(II)

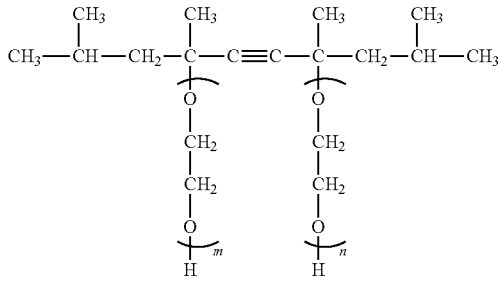

(m, n≤20, 0<m+n≤40)

$$R—(OCH_2CH_2)nH \quad \text{(III)}$$

(R is a hydrocarbon chain with a carbon number of 6 to 14 which may be branched, n is 5 to 20)

(IV)

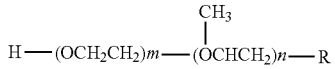

(R is a hydrocarbon chain with a carbon number of 6 to 14, m and n are a number equal to or smaller than 20)

In addition to the compounds of the above formula (I) to (IV), for example, the following can be used: alkyl and aryl ethers of polyhydric alcohol such as diethylene glycol monophenyl ether, ethylene glycol monophenyl ether, ethylene glycol monoallyl ether, diethylene glycol monophenyl ether, diethylene glycol monobutyl ether, propylene glycol monobutyl ether, and tetraethylene glycol chlorophenyl ether; a nonionic surfactant such as a polyoxyethylene polyoxypropylene block copolymer; a fluorine-based surfactant; and lower alcohols such as ethanol and 2-propanol. Among these, diethylene glycol monobutyl ether is particularly preferred.

What is claimed is:

1. A cap device designed to form a space surrounding an opening of a nozzle of a liquid ejecting head when the cap device is in contact with the liquid ejecting head including the nozzle for ejecting a liquid, the cap device comprising:

a moisturizing chamber to which a moisturizing fluid for moisturizing the space is supplied; and a partition wall having gas permeability and configured to partition the space and the moisturizing chamber, wherein part of the partition wall is formed of a flexible portion configured to deform in response to a pressure change in the space.

2. The cap device according to claim 1, wherein the partition wall liquid-tightly partitions the space and the moisturizing chamber, and the partition wall has higher gas permeability than other walls constituting the moisturizing chamber.

3. The cap device according to claim 1, wherein the flexible portion deforms at a pressure smaller than a pressure at which a gas-liquid interface formed in the nozzle breaks.

4. The cap device according to claim 1, wherein an inner bottom surface of a recessed portion including the partition wall and forming the space, is flat.

5. The cap device according to claim 1, wherein the moisturizing chamber includes an atmospheric communication portion communicating with the atmosphere, in a wall different from the partition wall.

6. The cap device according to claim 1, wherein the moisturizing chamber includes an introduction portion for introducing the moisturizing fluid, the cap device further includes a connection flow path connected to the introduction portion, and a supply mechanism designed to supply a moisturizing liquid as the moisturizing fluid through the connection flow path, and the supply mechanism supplies the moisturizing liquid so as to secure a space in the moisturizing chamber where the partition wall is deflected and displaced.

7. The cap device according to claim 6, further comprising:

a capillary member having capillary force and disposed so as to extend from an inside of the connection flow path into the moisturizing chamber, wherein the supply mechanism supplies the moisturizing liquid so that a liquid level of the moisturizing liquid is positioned in the capillary member.

8. The cap device according to claim 6, wherein the supply mechanism includes a moisturizing liquid storage section designed to store the moisturizing liquid and a moisturizing liquid container designed to store the moisturizing liquid to be supplied to the moisturizing liquid storage section, and the moisturizing liquid storage section includes an outlet to which the connection flow path is connected, an inlet for introducing the moisturizing liquid supplied from the moisturizing liquid container, and a float valve for opening and closing the inlet in accordance with a change in a liquid level of the moisturizing liquid in the moisturizing liquid storage section.

9. A liquid ejecting apparatus comprising:

a liquid ejecting head including a nozzle for ejecting a liquid; and a cap device designed to form a space surrounding an opening of the nozzle when the cap device is in contact with the liquid ejecting head, wherein the cap device includes a moisturizing chamber to which a moisturizing fluid for moisturizing the above space is supplied, and a partition wall having gas permeability and configured to partition the space and the moisturizing chamber, and part of the partition wall is formed of a flexible portion.

10. A liquid ejecting apparatus comprising:

a liquid ejecting head including a nozzle for ejecting a liquid;

a cap including a recessed portion designed to form a space surrounding an opening of the nozzle when the cap is in contact with the liquid ejecting head; and a cap cover for covering the recessed portion at a cover position when the cap is at a separate position distanced from the liquid ejecting head.

11. The liquid ejecting apparatus according to claim 10, wherein the cap includes a contact portion that contacts the liquid ejecting head when forming the above-mentioned space; and the cap cover at the cover position is disposed above the recessed portion with a gap present between the cap cover and the contact portion.

12. The liquid ejecting apparatus according to claim 10, further comprising:

a supply mechanism designed to supply a moisturizing fluid for moisturizing the space to the cap.

13. The liquid ejecting apparatus according to claim 10, wherein the cap cover includes a cover portion positioned above the recessed portion when the cap cover is at the cover position, and an enclosure portion extending downward from the cover portion in such a manner as to enclose an upper end of the cap.

14. The liquid ejecting apparatus according to claim 10, further comprising:

a cap holding portion designed to movably hold the cap, wherein the cap holding portion supports the cap cover so that the cap cover is movable between the cover position and a retracted position retracted from above the recessed portion.

15. The liquid ejecting apparatus according to claim 14, further comprising:

a biasing member designed to bias the cap cover toward the retracted position.

16. The liquid ejecting apparatus according to claim 14, wherein, in a case where the position of the cap is taken as a capping position at a time when the cap makes contact with the liquid ejecting head to form the above-mentioned space, when the cap holding portion moves downward, the cap moves from the capping position to the separate position, and the cap cover moves from the retracted position to the cover position.

17. The liquid ejecting apparatus according to claim 16, further comprising:

a movable member that is movable together with the cap holding portion, and moves the cap cover when the movable member having moved relative to the cap holding portion;

a support base designed to movably support the cap holding portion;

an engaging member that is engaged with the movable member while the cap holding portion moving downward; and an elastic member disposed between the support base and the engaging member, wherein the movable member moves relative to the cap holding portion when the movable member having been engaged with the engaging member, and the elastic member is elastically deformed when force received by the engaging member from the movable member becomes larger than a set value.

18. The liquid ejecting apparatus according to claim 10, wherein the liquid ejecting head includes a nozzle surface to which the nozzle opens, and reciprocates between an ejection region in which the liquid is ejected toward a medium and a maintenance region in which the cap contacts the liquid ejecting head, and the cap cover extends in a direction along the nozzle surface and rotates about a rotation shaft intersecting with a reciprocation path of the liquid ejecting head.

19. The liquid ejecting apparatus according to claim 18, wherein the cap cover includes a first cover and a second cover configured to rotate in opposite directions to each other, and the first cover and the second cover respectively include cover portions that are positioned above the recessed portion and make contact with each other when the cover portions are at the cover position.

20. A cap device comprising:

a cap including a recessed portion designed to form a space surrounding an opening of a nozzle of a liquid ejecting head when the cap is in contact with the liquid ejecting head including the nozzle for ejecting a liquid; and a cap cover for covering the above recessed portion at a cover position when the cap is at a separate position distanced from the liquid ejecting head.

* * * * *